US006446702B1

(12) United States Patent
Murakami et al.

(10) Patent No.: US 6,446,702 B1
(45) Date of Patent: Sep. 10, 2002

(54) APPARATUS AND METHOD FOR PRODUCING METALLIC RIBBON

(75) Inventors: Junichi Murakami; Akinori Kojima; Yutaka Yamamoto; Akihiro Makino; Takashi Hatanai, all of Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/324,994

(22) Filed: Jun. 2, 1999

(30) Foreign Application Priority Data

Jun. 9, 1998 (JP) ..... 10-161155
Aug. 18, 1998 (JP) ..... 10-232118
Aug. 26, 1998 (JP) ..... 10-240818

(51) Int. Cl.[7] ..... B22D 11/00; B22D 11/06
(52) U.S. Cl. ..... 164/423; 164/463; 164/415
(58) Field of Search ..... 164/423–463, 164/415, 66.1

(56) References Cited

U.S. PATENT DOCUMENTS 6,047,763 A * 4/2000 Murakami et al. ..... 164/423

FOREIGN PATENT DOCUMENTS

| | | | |
|---|---|---|---|
| EP | 0 183 220 A2 | | 4/1986 |
| EP | 0183220 | * | 4/1986 |
| JP | 56-17167 | | 2/1981 |
| JP | 04 356336 A | | 10/1992 |
| JP | 8-309493 | | 11/1996 |

* cited by examiner

*Primary Examiner*—Tom Dunn
*Assistant Examiner*—I.-H. Lin
(74) *Attorney, Agent, or Firm*—Brinks Hofer Gilson & Lione

(57) ABSTRACT

An apparatus for producing a metallic ribbon includes a cooling roll, a melt nozzle, and an air-cutoff unit provided to cover at least a portion of the periphery of the cooling roll and at least the melt blowout end of the melt nozzle, for preventing an inflow of air due to rotation of the cooing roll. The air-cutoff unit has a roll top air-cutoff plate provided above the cooling roll to extent from the front side to the rear side in the rotation direction of the cooling roll in such a manner that it approaches the cooling surface in the direction opposite to the rotation direction of the cooling roll. The melt blowout end of the melt nozzle is arranged to pass through a nozzle mounting hole provided in the roll top air-cutoff plate and face the cooling surface of the cooling roll.

11 Claims, 33 Drawing Sheets

APPARATUS AND METHOD FOR PRODUCING METALLIC RIBBON

BACKGROUND OF THE INVENTION

1. Field of the Invention

The present invention relates to an apparatus and method for producing a metallic ribbon of an amorphous metal or the like.

2. Description of the Related Art

As a method for producing a metallic ribbon, a single roll method using a single cooling roll is most popular at present. FIG. 33 shows a principal portion of a conventional apparatus for producing a metallic ribbon by using the single roll method.

The single roll method comprises blowing a melt 103 out of a melt nozzle 102 adjacent to the top of the cooling surface of a cooling roll 101, which is rotated at high speed, to draw out the melt 103 in the rotation direction (the direction of arrow A) of the cooling roll while rapidly solidifying it by the cooling surface of the cooling roll 101.

The melt 103 blown out of the melt nozzle 102 forms a puddle 104 between the end of the melt nozzle 102 and the cooling surface of the cooling roll 101, and the melt 103 is successively drawn out of the puddle 104 with rotation of the cooling roll 101, and rapidly solidified on the surface of the cooling roll 101 to continuously form a ribbon 105.

Where the material supplied in the single roll method has a highly oxidizable composition, the melt nozzle 102 is clogged due to oxidation of the material, hindering ejection of the melt.

In order to solve the problem of a conventional single roll method, a method is proposed in which the whole apparatus for producing a metallic ribbon is arranged in a chamber in which the oxygen concentration near the melt nozzle is deceased by an inert gas atmosphere, thereby preventing oxidation of material.

The method of forming an inert gas atmosphere in the chamber is very effective means for preventing clogging of the melt nozzle, but has a problem of workability because the whole apparatus is arranged in the chamber. For example, the conventional single roll method requires a complicated work comprising opening the chamber to fill a melt furnace or crucible with a metal mother material master alloy in each time of charge, closing the chamber, and then substituting air in the chamber with an inert gas atmosphere.

There is also a problem in which an additional equipment for holding an inert gas atmosphere in the chamber is expensive.

SUMMARY OF THE INVENTION

The present invention has been achieved for solving the above problems, and an object of the invention is to provide an apparatus for producing a metallic ribbon which can decrease the oxygen concentration of the atmosphere near a melt nozzle without providing a large-scale additional equipment exhibiting low workability, such as a chamber.

Unlike a conventional method, if only the vicinity of the melt nozzle can be brought into an inert gas atmosphere for decreasing the oxygen amount in order to prevent clogging of the melt nozzle, the whole apparatus for producing a metallic ribbon need not be placed in an inert gas atmosphere. Equipment in which only the vicinity of the melt nozzle is brought into an inert gas atmosphere permits improvement in workability and a decrease in equipment cost, as compared with a conventional chamber.

As a result of research with consideration of this point, the inventors found that by providing, at appropriate positions, air-cutoff means for preventing air from flowing into the periphery of the melt nozzle by rotation of the cooling roll, and gas flow means for supplying an inert gas to the periphery of the melt nozzle, the oxygen amount of the periphery of the melt nozzle can effectively be decreased.

An apparatus for producing a metallic ribbon of the present invention is achieved on the basis of the above findings. The apparatus comprises a cooling roll having a cooling surface for cooling a metal melt, a melt nozzle facing the cooling surface with a predetermined gap therebetween, roll periphery air-cutoff means which covers at least a portion of the periphery of the cooling roll and at least the melt blowout end of the melt nozzle, for preventing an inflow of air due to rotation of the cooling roll, wherein the body of the melt nozzle is arranged outside the roll periphery air-cutoff means.

In the apparatus for producing a metallic ribbon of the present invention, the roll periphery air-cutoff means is provided on at least the front side and the rear side on the basis of the melt nozzle (referred to as "the front side" and "the rear side" hereinafter) in the rotation direction of the cooling roll, and an air retention portion is provided on the front side in the rotation direction of the cooling roll.

The air retention portion may be provided either inside or outside the roll periphery air-cutoff means. The air retention portion preferably has an aperture area larger than the aperture area of the roll periphery air-cutoff means. In addition, the inside of the air retention portion may be divided by a plurality of partitions.

In the apparatus for producing a metallic ribbon of the present invention, the roll periphery air-cutoff means comprises at least a roll face air-cutoff plate provided ahead of the cooling roll on the front side in the rotation direction thereof, a pair of front air-cutoff plates provided on both sides of the cooling roll on the front side in the rotation direction thereof so as to hold the cooling roll therebetween and contact the roll face air-cutoff plate, a roll top air-cutoff plate located above the cooling roll so as to extend from the front side to the rear side in the rotation direction of the cooling roll and contact the upper edges of the roll front air-cutoff plates, and a roll surface air-cutoff plate provided on the rear side in the rotation direction of the cooling roll so as to contact the cooling surface of the cooling roll, wherein the roll top air-cutoff plate is provided in such a manner that it approaches the cooling surface of the cooling roll in the direction opposite to the rotation direction of the cooling roll, and the melt blowout end of the melt nozzle is passed through a nozzle mounting hole provided in the roll top air-cutoff plate so as to face the cooling surface of the cooling roll.

The roll top air-cutoff plate preferably evenly extends from the frond side in the rotation direction of the cooling roll to the cooling surface.

Also the roll top air-cutoff plate may extend from the frond side in the rotation direction of the cooling roll to the cooling surface in such a manner that it is curved along the inside of the roll periphery air-cutoff means.

Furthermore, at least one partition may be provided on the roll top air-cutoff plate so as to project into the roll periphery air-cutoff means.

Further, a passage hole is preferably provided in the roll face air-cutoff plate to pass the metallic ribbon formed by cooling with the cooling roll therethrough.

The apparatus for producing a metallic ribbon of the present invention further comprises gas flow supply means for supplying inert gases to the periphery of the melt nozzle.

The gas flow supply means is preferably provided at two positions on each of the front side and the rear side in the rotation direction of the cooling roll on the basis of the melt nozzle. Particularly, the two gas flow supply means arranged on the rear side in the rotation direction of the cooling roll preferably comprise one arranged so that a slit thereof faces the melt nozzle end, and the other arranged between the melt nozzle and the one gas flow supply means to supply a gas flow onto the gas flow supplied from the one gas flow supply means.

The gas flow velocity of the gas flow supply means is preferably 2 to 80 m/sec, and the gas flow rate is preferably 200 to 1400 l/min.

The inventors also found that by providing a plurality of gas flow supply means preferably including first gas flow supply means and second gas flow supply means, the oxygen amount of the periphery of the melt nozzle can effectively be decreased.

Namely, the apparatus for producing a metallic ribbon in which a metal melt is cooled by blowing it toward the cooling surface of the rotating cooling roll to obtain a metallic ribbon, comprises the cooling roll; the melt nozzle for blowing the metal melt toward the cooling surface with a gap between the melt nozzle and the cooling roll; air-cutoff means which covers from at least the melt blowout end of the melt nozzle to at least the position where the metallic ribbon is separated from the cooling surface, along the rotation direction of the cooling roll, for preventing an inflow of air due to rotation of the cooling roll; roll surface air-cutoff means located behind the position where the melt nozzle and the cooling roll are opposed to each other, in the rotation direction of the cooling roll so as to contact the cooling surface, for cutting off an inflow of air into the periphery of the melt nozzle along the cooling surface due to rotation of the cooling roll; roll periphery air-cutoff means extending from at least the position where the metallic ribbon is separated from the cooling surface to the position where the roll surface air-cutoff means is provided, along the rotation direction of the cooling roll so as to surround the cooling roll and cover the cooling surface with a gap between the roll periphery air-cutoff means and the cooling surface; first gas flow supply means for supplying an inert gas to the periphery of the melt nozzle; and second gas flow supply means provided between the position where the metallic ribbon is separated from the cooling surface and the position where the air-cutoff means is provided, for supplying an inert gas to the cooling surface with a gap between the second gas flow supply means and the cooling surface.

The body of the melt nozzle is preferably arranged outside the roll periphery air-cutoff means.

In the above-described apparatus for producing a metallic ribbon of the present invention, the air-cutoff means comprises at least a roll face air-cutoff plate provided at a position forward of the melt nozzle on the front side in the rotation direction of the cooling roll; a pair of roll front air-cutoff plates provided on both sides of the cooling roll at a position forward of the melt nozzle in the rotation direction of the cooling roll so as to hold the cooling roll therebetween and contact the roll face air-cutoff plate; a roll top air-cutoff plate located above the cooling roll so as to extend from the front side to the rear side in the rotation direction of the cooling roll and contact the upper edges of the roll front air-cutoff plates; and a pair of roll side air-cutoff plates provided so as to hold the cooling roll therebetween and contact the roll front air-cutoff plates and the roll periphery air-cutoff means; wherein the roll top air-cutoff plate is provided in such a manner that it approaches the cooling surface of the cooling roll in the direction opposite to the rotation direction of the cooling roll, and the melt blowout end of the melt nozzle is arranged so as to pass through the nozzle mounting hole provided in the roll top air-cutoff plate and face the cooling surface of the cooling roll.

The roll top air-cutoff plate preferably flatly extends from the front side in the rotation direction of the cooling roll to the cooling surface.

Also the roll top air-cutoff plate may extend from the front side in the rotation direction of the cooling roll to the cooling surface in such a manner that it is curved along the inside of the roll periphery air-cutoff means.

Furthermore, at least one partition may be provided on the roll top air-cutoff plate so as to project into the roll periphery air-cutoff means.

Further, a passage hole is preferably provided in the roll face air-cutoff plate so that the metallic ribbon formed by cooling with the cooling roll is passed therethrough.

The flow rate of the first gas flow supply means is preferably 200 to 400 l/min.

The flow rate of the second gas flow supply means is preferably 150 to 350 l/min.

The gas flow supply means is preferably provided at two positions on each of the front side and the rear side in the rotation direction of the cooling roll on the basis of the melt nozzle. Particularly, the two gas flow supply means arranged on the rear side in the rotation direction of the cooling roll preferably comprise one arranged so that a slit thereof faces the melt nozzle end, and the other arranged between the melt nozzle and the one gas flow supply means to supply gas flow onto the gas flow supplied from the one gas flow supply means.

The apparatus for producing a metallic ribbon of the present invention further comprises an air retention portion provided at a position forward of the melt nozzle in the rotation direction of the cooling roll.

The air retention portion may be provided either inside or outside the roll periphery air-cutoff means. The air retention portion preferably has an opening area larger than the opening area of the roll periphery air-cutoff means. In addition, the inside of the air retention portion may be divided by a plurality of partitions.

As the inert gas, at least two inert gases are preferably used, and inert gases of $N_2$, He, Ar, Kr, Xe and Rn are more preferably used.

The apparatus for producing a metallic ribbon of the present invention further comprises a sixth gas flow nozzle provided so as to surround the end of the melt nozzle so that when a gas flows from many holes provided at positions slightly inward of the center between the outer periphery and inner periphery of the sixth gas flow nozzle to surround the melt nozzle, the oxygen concentration in the vicinity of the melt nozzle can be further decreased by the sixth gas flow from the six gas flow nozzle.

The sixth gas flow nozzle may have a plurality of holes provided in a ring at the center between the outer and inner diameters thereof, or a ring slit in place of the holes. The sixth gas flow nozzle may be formed to a spiral shape or a double shape in which the melt nozzle is surrounded.

The apparatus for producing a metallic ribbon of the present invention further comprises a first gas flow nozzle directed toward the end of the melt nozzle in the direction substantially normal to the cooling roll, for flowing an inert gas heavier than the inert gases supplied from the other gas flow nozzles; and a second gas flow nozzle provided between the melt nozzle and the first gas flow nozzle, for providing a gas flow onto the gas flow from the first gas flow nozzle.

The gas flow rate of the first gas flow supply means is preferably 200 to 600 l/min.

The present invention also provides a method of producing a metallic ribbon comprising rapidly cooling an alloy melt by blowing the alloy melt out of a melt nozzle, which faces a cooling surface of a cooling roll, toward the rotating cooling roll with a predetermined gap held between the cooling roll and the melt nozzle to form a metallic ribbon, wherein the alloy melt is blown toward the cooling roll to form a metallic ribbon with the air-cutoff means provided so as to cover at least a portion of the periphery of the cooling roll and at least the melt blowout end of the melt nozzle, for preventing an inflow of air due to rotation of the cooling roll.

In the production method, the metal alloy is more preferably blown out with the inert gas supplied to the periphery of at least one of the melt nozzle and the cooling roll, to form a metallic ribbon.

The inert gas may be supplied from a plurality of gas flow supply means, and a metallic ribbon is more preferably formed under the supply of at least two inert gases.

As the two inert gases, $N_2$ and Ar are more preferable.

BRIEF DESCRIPTION OF THE DRAWINGS

FIG. 1 is a drawing showing an apparatus for producing a metallic ribbon in accordance with a first embodiment of the present invention, in which

FIG. 5 is a drawing showing an apparatus for producing a metallic ribbon in accordance with the first embodiment of the present invention, in which

FIG. 6 is a drawing showing an apparatus for producing a metallic ribbon in accordance with the first embodiment of the present invention, in which

FIG. 7 is a drawing showing an apparatus for producing a metallic ribbon in accordance with the first embodiment of the present invention, in which

FIG. 8 is a drawing showing a roll rear air-cutoff plate in accordance with the first to third embodiments of the present invention, in which

FIG. 10 is a drawing showing second, third and fourth gas flow nozzles in accordance with the first to third embodiments of the present invention, in which

FIG. 11 is a drawing showing a first gas flow nozzle in accordance with the first to third embodiments of the present invention, in which

FIG. 12 is a drawing showing an apparatus for producing a metallic ribbon in accordance with a second embodiment of the present invention, in which

FIG. 14 is a drawing showing an apparatus for producing a metallic ribbon in accordance with the second embodiment of the present invention, in which

FIG. 15 is a drawing showing an apparatus for producing a metallic ribbon in accordance with the second embodiment of the present invention, in which

FIG. 16 is a drawing showing an apparatus for producing a metallic ribbon in accordance with the second embodiment of the present invention, in which

FIG. 17 is a drawing showing an apparatus for producing a metallic ribbon in accordance with a third embodiment of the present invention, in which

FIG. 19 is a drawing showing a first example of a sixth gas flow nozzle, in which

FIG. 20 is a drawing showing a second example of the sixth gas flow nozzle, in which

FIG. 21 is a drawing showing a third example of the sixth gas flow nozzle, in which

FIG. 22 is a drawing showing the sixth gas flow nozzle used in Test Examples 7 to 9, in which

FIG. 23 is a drawing showing an apparatus for producing a metallic ribbon in accordance with the third embodiment of the present invention, in which

FIG. 24 is a drawing showing an apparatus for producing a metallic ribbon in accordance with the third embodiment of the present invention, in which

FIG. 25 is a drawing showing an apparatus for producing a metallic ribbon in accordance with the third embodiment of the present invention, in which

DESCRIPTION OF THE PREFERRED EMBODIMENT

An apparatus for producing a metallic ribbon in accordance with a first embodiment of the present invention will be described below with reference to the drawings.

Figure 1A:
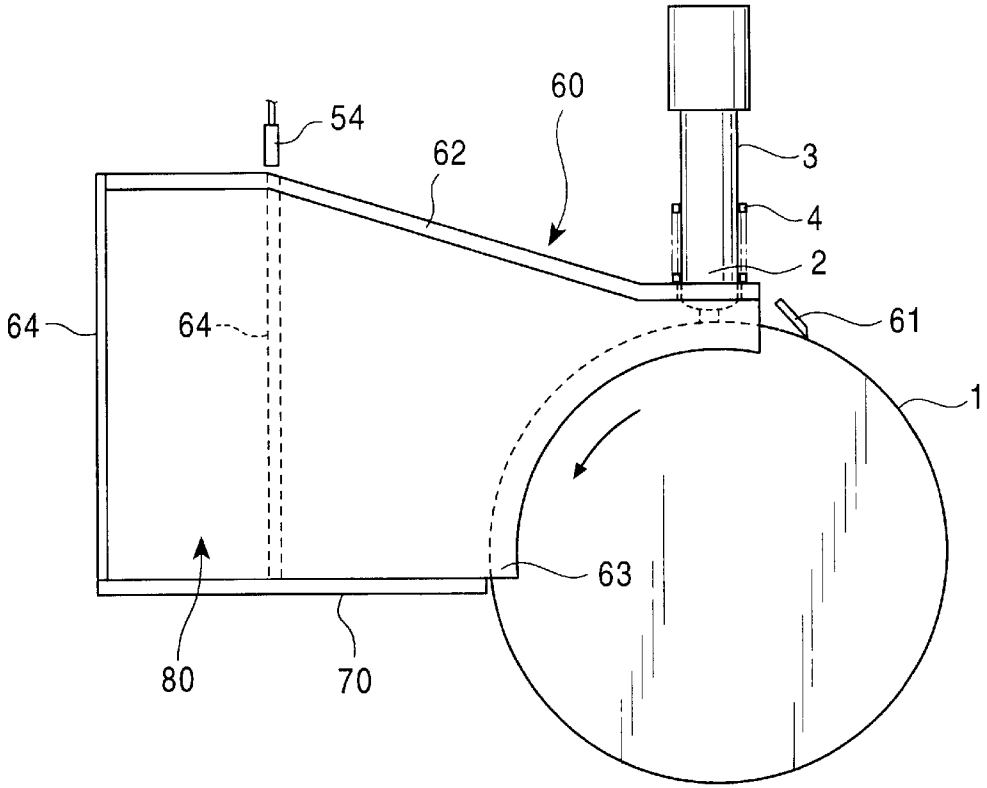
FIG. 1A is a side view of the apparatus.
Figure 1B:
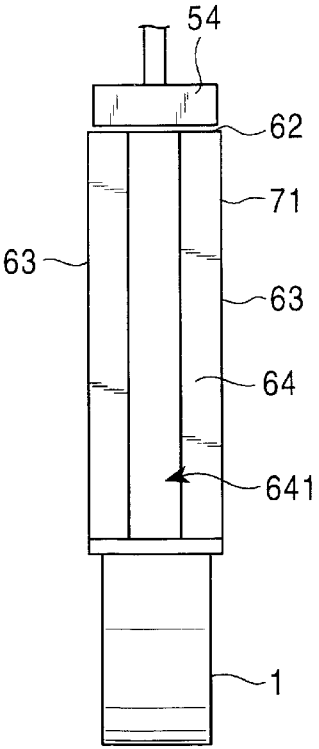
FIG. 1B is a front view thereof.
Figure 2:
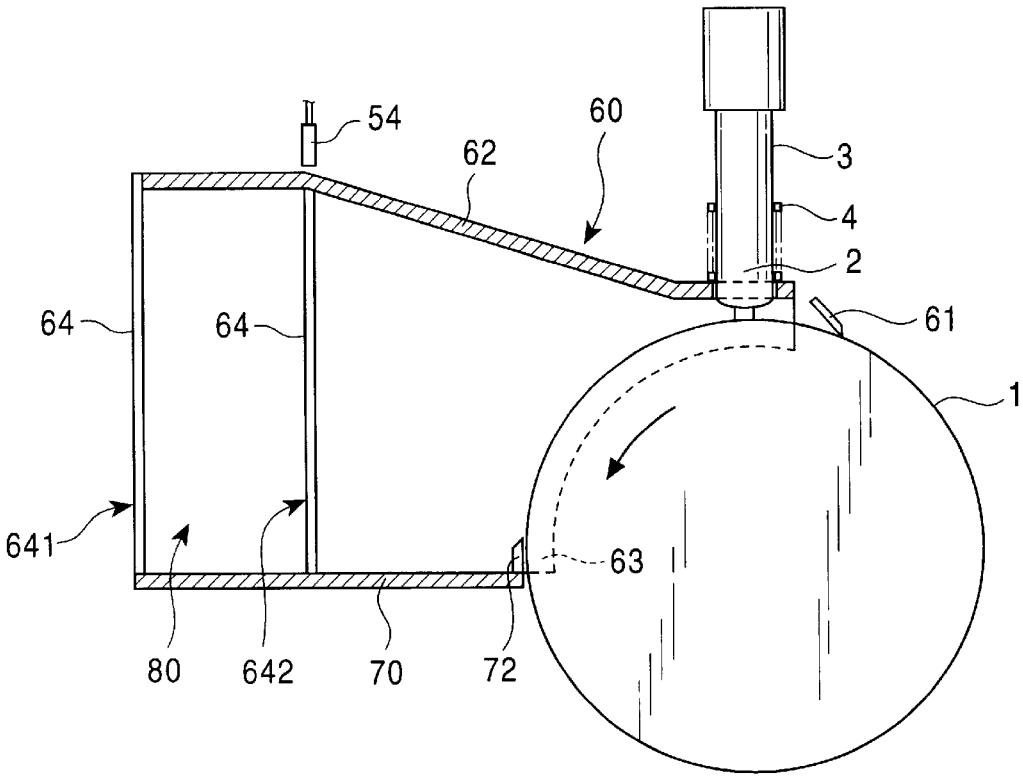
FIG. 2 is a sectional side view of the metallic ribbon producing apparatus shown in FIG. 1.
Figure 3:
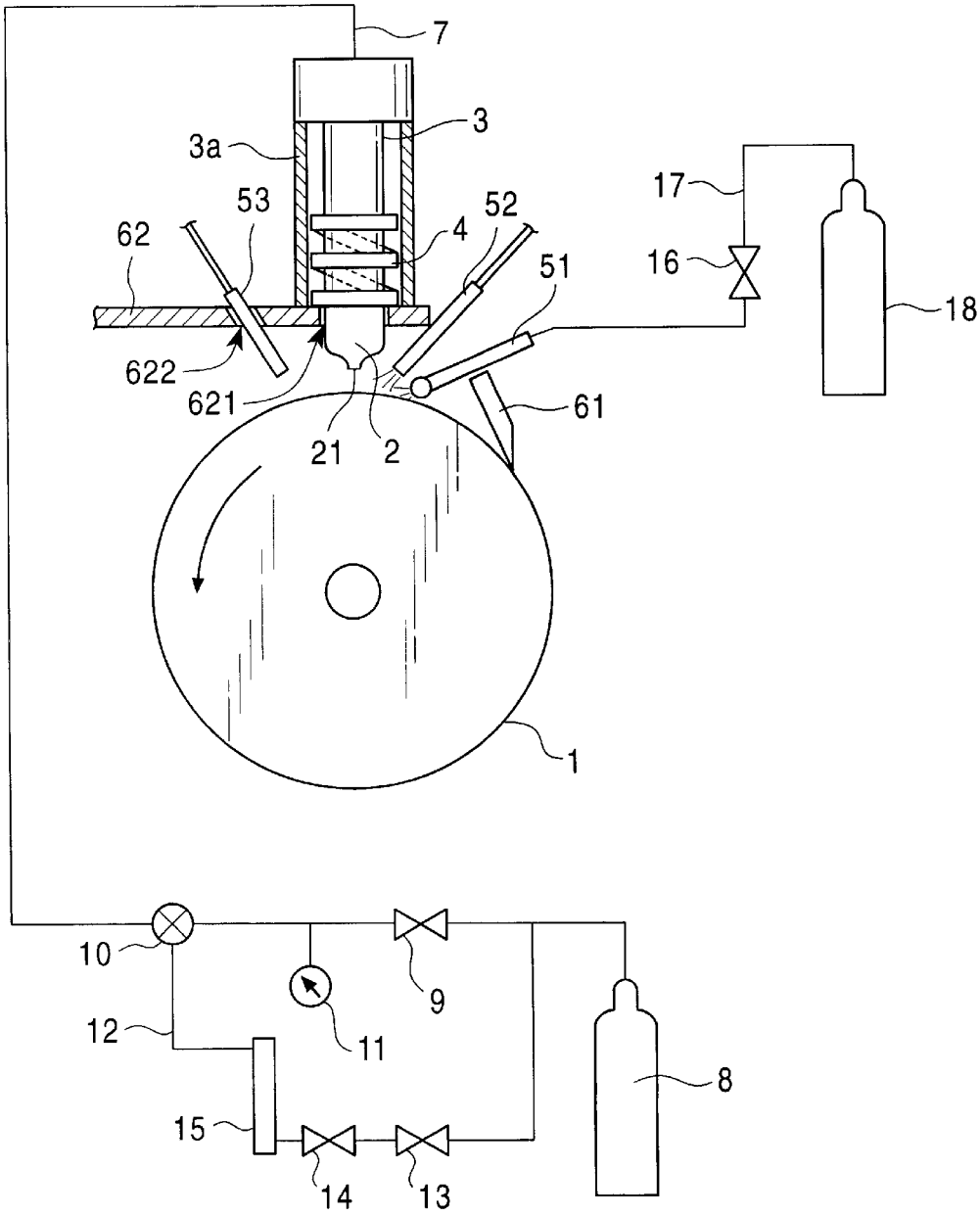
FIG. 3 is a drawing showing the configuration of a principal portion of the metallic ribbon producing apparatus shown in FIG. 1.

Referring to FIGS. 1, 2 and 3, the metallic ribbon producing apparatus of this embodiment basically comprises a cooling roll 1, a melt nozzle 2 connected to the lower end of a crucible 3 which contains a melt, a heating coil 4 wound on the outer periphery of the melt nozzle 2 and the crucible 3, first to fourth gas flow nozzles 51 to 54 serving as gas flow supply means for flowing inert gases, air-cutoff means 60 for cutting off an inflow of air into the vicinity of the melt nozzle 2, and an air retention portion 80.

The cooling roll 1 is rotated in the direction of an arrow (counterclockwise) by a motor not shown in the drawings. At least the surface of the cooling roll 1 is preferably made of carbon steel, a Fe-based alloy such as JIS (Japan Industrial Standard) S45C, brass (Cu—Zn alloy) or pure Cu. With the cooling roll 1 having at least the surface made of brass or pure Cu, the cooling roll 1 has high thermal conductivity, and thus exhibits a high cooling effect and is suitable for rapidly cooling a melt. In order to improve the cooling effect, a water-cooling structure is preferably provided in the cooling roll 1.

In FIG. 3, the melted metal in the crucible 3 is blown out of the melt nozzle 2 at the lower end of the crucible 3 toward the surface of the cooling roll 1. The upper portion of the crucible 3 is connected to a gas supply source 8 for an Ar gas or the like through a supply pipe 7 in which a pressure-regulating valve 9 and a solenoid valve 10 are provided, a pressure gage 11 being provided between the pressure-regulating valve 9 and the solenoid valve 10 in the supply pipe 7. An auxiliary pipe 12 is connected in parallel with the supply pipe 7, the auxiliary pipe 12 containing a pressure-regulating valve 13, a flow control valve 14, and a flow mater 15. Therefore, a gas such as an Ar gas is supplied into the crucible 3 from the gas supply source 8 to blow the melt out of the melt nozzle 2 toward the cooling roll 1.

In the production of a metallic ribbon, the melt is blown out of the nozzle 2 arranged near the top of the cooing roll 1 which is rotated at high speed, or arranged slightly ahead of the top, to drawn out a ribbon in the rotation direction of the cooling roll 1 while solidifying the melt by rapid cooling by the surface of the cooling roll 1. Although the melt blowout portion of the melt nozzle has a rectangular shape, the blowout width (the width of the cooling roll 1 in the rotation direction thereof) is preferably about 0.2 to 0.8 mm. With a blowout width of less than 0.2 mm, the melt nozzle is readily clogged according to the composition of the melt, while with a blowout width of over 0.8 mm, sufficient cooling is difficult.

In the production of the metallic ribbon, the distance between the cooling roll 1 and the melt nozzle 2 is preferably selected in the range of 0.1 to 0.8 mm. With a distance of less than 0.1 mm, ejection of the melt is difficult with the possibility of damaging the melt nozzle 2, while with a distance of over 0.8 mm, production of a ribbon having good properties is difficult. The crucible 3 can be moved upward and downward by lifting means not shown so that the distance between the cooling roll 1 and the melt nozzle 2 can be adjusted. Since the temperature is increased to increase the diameter of the cooling roll 1 due to thermal expansion of the surface after the start of production of a metallic ribbon, it is preferable for producing a metallic ribbon with high thickness precision to gradually increase the distance between the cooling roll 1 and the melt nozzle 2 after the start of production.

As shown in FIGS. 1 and 2, a ribbon guide plate 70 and a scraper 72 are provided in the lower portion of the cooling roll 1 on the front side in the rotation direction thereof. The metallic ribbon formed on the cooling surface of the cooing roll 1 is separated from the cooling roll 1 by the scraper 72, guided by the ribbon guide plate 70, and then discharged to the outside of the metallic ribbon producing apparatus through a passage hole 641.

The inert gas can be supplied from either or both of the rear side and front side on the basis of the melt nozzle 2. It is preferably to supply two-system gas flows from the rear and front sides.

Figure 11A:
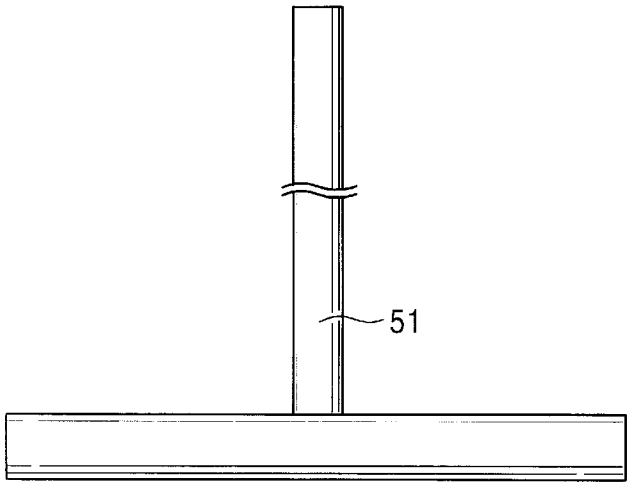
FIG. 11A is a plan view.
Figure 11C:
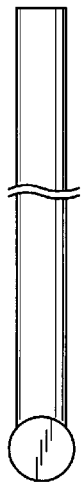
FIG. 11C is a side view.
Figure 11B:
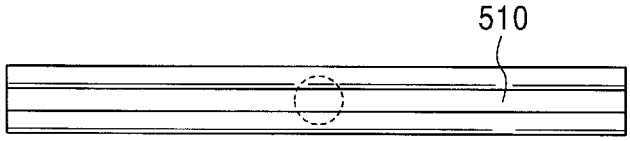
FIG. 11B is a front view.

In FIG. 3, the first gas flow nozzle 51 is one of means for supplying the two-system gas flows, which is arranged on the rear side on the basis of the melt nozzle 2, for providing a flow of gas to the vicinity (hereinafter, a puddle) of the end of the melt nozzle 2 from the rear side of the cooling roll 1 in the direction substantially normal to the cooling roll 1. As shown in FIG. 11, the first gas flow nozzle 51 has a relatively thin slit 510 having a width of 5 mm to flow the gas at a more or less high flow rate.

The second gas flow nozzle 52 is the other means for supplying the two-system gas flows, and is provided between the melt nozzle 2 and the first gas flow nozzle 51, for supplying a gas flow to cut off the gas supplied from the first gas flow nozzle 51 from air, preventing an inflow of air. As shown in FIG. 10, the second gas flow nozzle 52 has a slit 520 wider than the first gas flow nozzle 51 to provide a gas flow at a rate lower than the first gas flow.

The third gas flow nozzle 53 is one of means for supplying the two-system gas flows, which is arranged on the front side on the basis of the melt nozzle 2, for preventing an inflow of air from the front side in the rotation direction of the cooling roll 1. The third gas flow nozzle 53 has the same shape as the second gas flow nozzle 52, but a slit 540 thereof has a smaller width of 2.5.

As shown in FIGS. 1 and 2, the fourth gas flow nozzle 54 is one of the means for supplying the two-system gas flows, which is arranged above the end of air-cutoff means 60 in front of the melt nozzle 2, for preventing an inflow of air from the hole 641 located in front of the cooling roll 1. As shown in FIG. 10, the fourth gas flow nozzle 54 has the same shape as the second and third gas flow nozzles 52 and 53, but a slit 550 has a width of 3 mm.

Of course, the first to fourth gas flow nozzles can be used singly or in a combination of a plurality of nozzles. The first and second gas flow nozzles have the highest effect of decreasing the oxygen concentration in the vicinity of the puddle.

Each of the above-described gas flow nozzles is connected to a gas supply source 18 through a connecting pipe 17 to which a pressure control valve 16 is connected, as shown by the first gas flow nozzle 51 in FIG. 3 as an example.

In this way, the first to fourth gas flow nozzles 51 to 54 are arranged around the melt nozzle 2 to permit a decrease in the oxygen concentration in the vicinity of the puddle.

In the production of the ribbon by using the metallic ribbon producing apparatus of the present invention, the supply of inert gases from the gas flow nozzles 51 to 54 is preferably started before the cooling roll 1 is rotated. This is because when the flows of the gases are started before the cooling roll is rotated, the oxygen concentration is rapidly decreased, as compared with the supply of the inert gases is started after the cooling roll is rotated. Therefore, from the viewpoint of production efficiency, it is preferable to measure the oxygen concentration in the atmosphere near the melt nozzle, and then rotate the cooling roll 1 after the oxygen concentration reaches a predetermined value.

In the present invention, an inert gas is supplied under conditions including a flow velocity of 2 to 80 m/sec and a flow rate of 200 to 1400 l/min, more preferably a flow rate of 1330 l/min. This is because with a flow velocity of less than 2 m/sec, there is no effect of decreasing the oxygen amount in the atmosphere near the melt nozzle, while with a flow velocity of over 80 m/sec, the effect of decreasing the oxygen concentration is decreased due to the inflow of air from the periphery, which is caused by the flows of the gases. With a flow rate of less than 200 l/min, there is no effect of decreasing the oxygen amount in the atmosphere of the melt nozzle, while with a flow rate of over 1400 l/min, no effect can be expected for the supply.

In this case, preferably, the flow velocity and the flow rate of one (the first gas flow nozzle) of the two-system gas flows from the rear side are 10 to 35 m/sec and 5 to 400 l/min, respectively, and the flow velocity and the flow rate of the other gas flow (the second gas flow nozzle) are 2 to 10 m/sec and 5 to 400 l/min, respectively. In addition, preferably, the flow velocity and the flow rate of one (the third gas flow nozzle) of the two-system gas flows from the front side are 10 to 50 m/sec and 5 to 400 l/min, respectively, and the flow velocity and the flow rate of the other gas flow (the fourth gas flow nozzle) are 10 to 80 m/sec and 300 to 600 l/min, respectively. The first gas flow is more preferably in the flow velocity range of 15 to 30 m/sec and the flow rate range of 250 to 350 l/min, most preferably at a flow rate of 300 l/min; the second gas flow is more preferably in the flow velocity range of 4 to 8 m/sec and the flow rate range of 230 to 330 l/min, most preferably at a flow rate of 280 l/min; the third gas flow is more preferably in the flow velocity range of 20 to 40 m/sec and the flow rate range of 200 to 300 l/min, most preferably at a flow rate of 250 l/min; the fourth gas flow is more preferably in the flow velocity range of 20 to 70 m/sec and the flow rate range of 400 to 550 l/min.

Particularly, when the flow rate of the fourth gas flow is 450 l/min, more preferably 500 l/min, the oxygen concentration in the vicinity of the puddle can be further decreased.

As the inert gas used in the metallic ribbon producing apparatus of the present invention, one or at least two gases are selected from $N_2$, He, Ar, Kr, Xe and Rn. However, as seen from the examples below, Ar is preferable.

Description will be made of the air-cutoff means 60.

As shown in FIGS. 1 and 2, the air-cutoff means 60 of the present invention comprises at least a roll face air-cutoff plate 64 provided in front of the cooling roll 1 on the front side in the rotation direction thereof, a pair of roll front air-cutoff plates 63 provided on both sides of the cooling roll 1 with the cooling roll 1 held therebetween so as to contact the roll face air-cutoff plate 64 on the front side in the rotation direction of the cooling roll 1, a roll top air-cutoff plate 62 provided above the cooling roll 1 on the front side in the rotation direction thereof so as to contact the upper edges of the roll front air-cutoff plates 63, and a roll surface air-cutoff plate 61 provided on the rear side in the rotation direction of the cooling roll 1 so as to contact the cooling surface of the cooling roll 1.

As shown in FIGS. 1, 2 and 3, the roll surface air-cutoff plate 61 has a plate structure having an acute angle end, and is arranged so that the acute angle end contacts the surface of the cooling roll 1. The roll surface air-cutoff plate 61 is provided for cutting off an inflow of air into the vicinity of the puddle which adheres to the surface of the cooling roll 1. During high-speed rotation of the cooling roll 1, the air which, flows into the vicinity of the puddle which adheres to the surface of the cooling roll 1, is cut off by being scraped off by the roll surface air-cutoff plate 61.

As shown in FIG. 3, since the first and second gas flow nozzles 51 and 52 are arranged between the roll surface air-cutoff plate 61 and the melt nozzle 2, a flow of an inert gas is supplied immediately after the air is cut off by the roll surface air-cutoff plate 61, thereby improving the effect of decreasing the oxygen concentration in the vicinity of the puddle. In order to further effectively cut off an inflow of air into the vicinity of the puddle, a plurality of roll surface air-cutoff plates 61 may be provided.

As shown in FIGS. 1 and 2, the roll front air-cutoff plates 63 are arranged for cutting off an inflow of air from the fronts of both sides of the cooling roll 1.

The roll face air-cutoff plate 64 is arranged for cutting off an inflow of air from the front side opposite to the surface of the cooling surface of the cooling roll 1. Although, in this embodiment, the roll face air-cutoff plate 64 is arranged at two positions including the front ends and the substantially centers of the roll front air-cutoff plates 63, the roll face air-cutoff plate 64 may be provided at one or at least three positions according to demand (refer to FIGS. 1 and 2). In this case, it can be expected that the oxygen concentration in the environment near the melt nozzle 2 can be further decreased. The roll face air-cutoff plate 64 comprises a ribbon pass hole 642 provided at the center thereof so that a ribbon is passed through the ribbon pass hole 642 in the production of the ribbon.

As shown in FIGS. 1 and 2, the roll top air-cutoff plate 62 extends from the front side to the rear side in the rotation direction of the cooling roll 1, and mounted and fixed to the upper edges of the roll front air-cutoff plates 63 to be located above the cooling roll 1. The roll top air-cutoff plate 62 is arranged for cutting off a flow of air to the cooling roll 1 from above.

The roll top air-cutoff plate 62 is provided in such a manner that it approaches the top of the cooling surface of the cooling roll 1 in the direction opposite to the rotation direction of the cooling roll 1.

Figure 4:
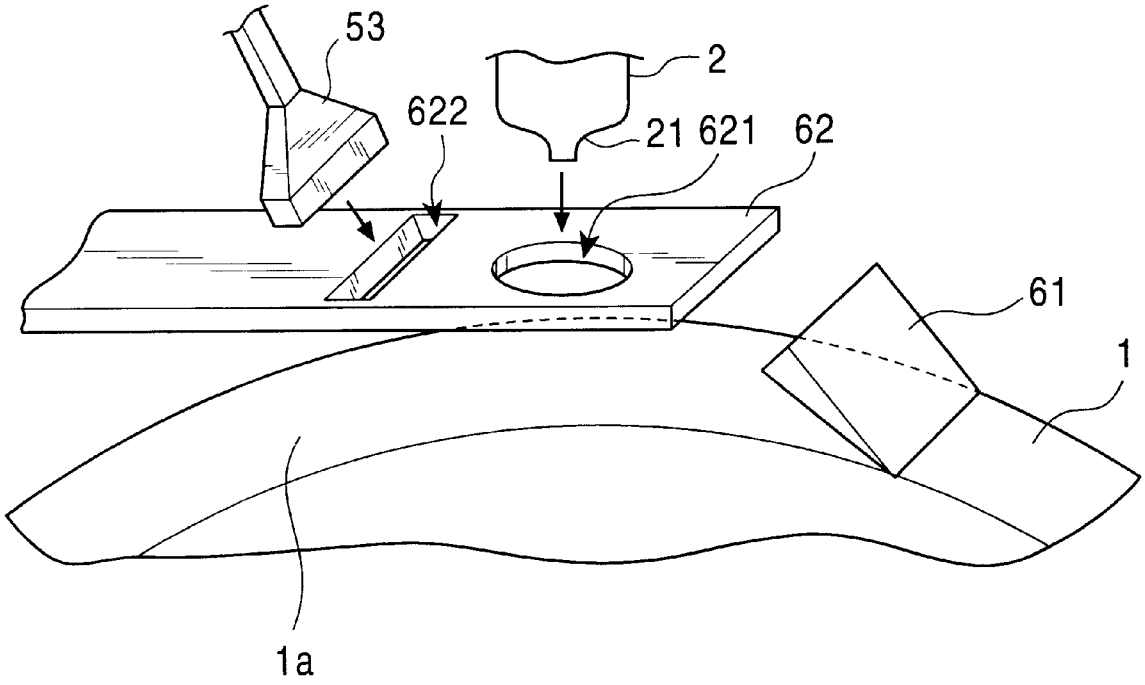
FIG. 4 is a perspective view showing a principal portion of a metallic ribbon producing apparatus in accordance with first to third embodiments of the present invention.

As shown in FIG. 4, the roll top air-cutoff plate 62 comprises a nozzle mounting hole 621. The melt nozzle 2 is passed through the nozzle mounting hole 621 and arranged so that the melt blowout end 21 of the melt nozzle 2 faces the cooling surface of the cooling roll 1.

The crucible 3 is contained in a cylinder 3*a*, as shown in FIG. 3. The cylinder 3*a* closes the nozzle mounting hole 621 to prevent an inflow of air.

Furthermore, the roll top air-cutoff plate 62 comprises a hole 622 through which the third gas flow nozzle 63 is passed, as shown in FIG. 3. The third gas flow nozzle 53 is passed through the hole 622 and arranged so that the end of the nozzle faces the cooling surface of the cooling roll 1. The third gas flow nozzle 53 supplies a flow of the inert gas to the vicinity of the puddle from the front side in the rotation direction of the cooling roll 1.

Since the roll top air-cutoff plate 62 is provided near the cooling surface of the cooling roll 1, the space near the puddle is narrowed. Large amounts of inert gases are supplied to the narrow space from the first to third gas flow nozzles 51 to 53, significantly increasing the concentration of the inert gas and conversely significantly decreasing the oxygen concentration in the vicinity of the puddle.

Only the melt blowout end 21 of the melt nozzle 2 is passed through the roll top air-cutoff plate 62. The body of the melt nozzle 2 is located above the roll top air-cutoff plate 62, i.e., outside the air-cutoff means 60. Therefore, the body of the melt nozzle 2, the crucible 3, and the heating coil 4 wound thereon are located outside the air-cutoff means 60.

Therefore, the melt nozzle 2 can easily be attached to and detached from the air-cutoff means 60.

Figure 5A:
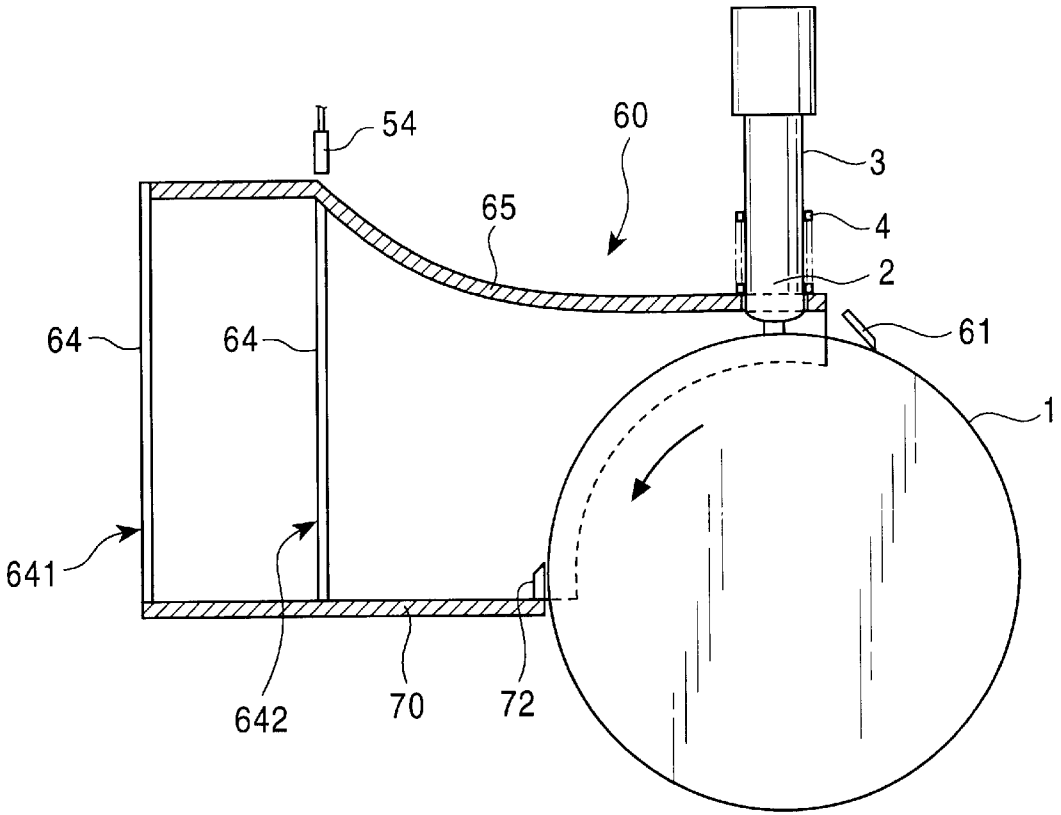
FIG. 5A is a sectional side view of the apparatus.
Figure 5B:
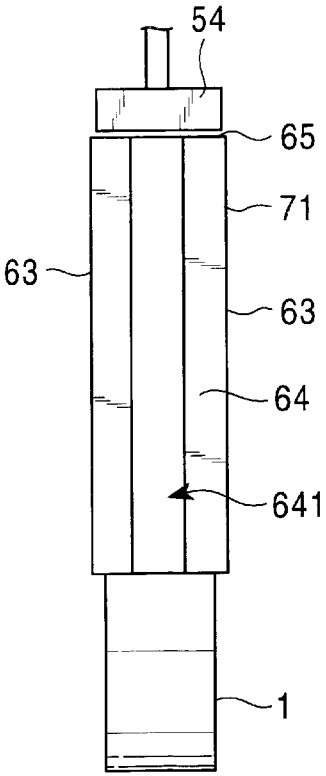
FIG. 5B is a front view thereof.

As shown in FIGS. 1 and 2, the roll top air-cutoff plate 62 flatly extends from the front side in the rotation direction of the cooling roll 1 to the cooling surface thereof. However, the roll top air-cutoff plate 62 is not limited to this, and a roll top air-cutoff plate 65 may be provided, which extends from the front side in the rotation direction of the cooling roll to the cooling surface thereof so as to be curved to the inside of the air-cutoff means 60, as shown in FIG. 5. The roll top air-cutoff plate 65 can cut off an inflow of air from the hole 641, decreasing the oxygen concentration in the vicinity of the puddle.

Figure 6A:
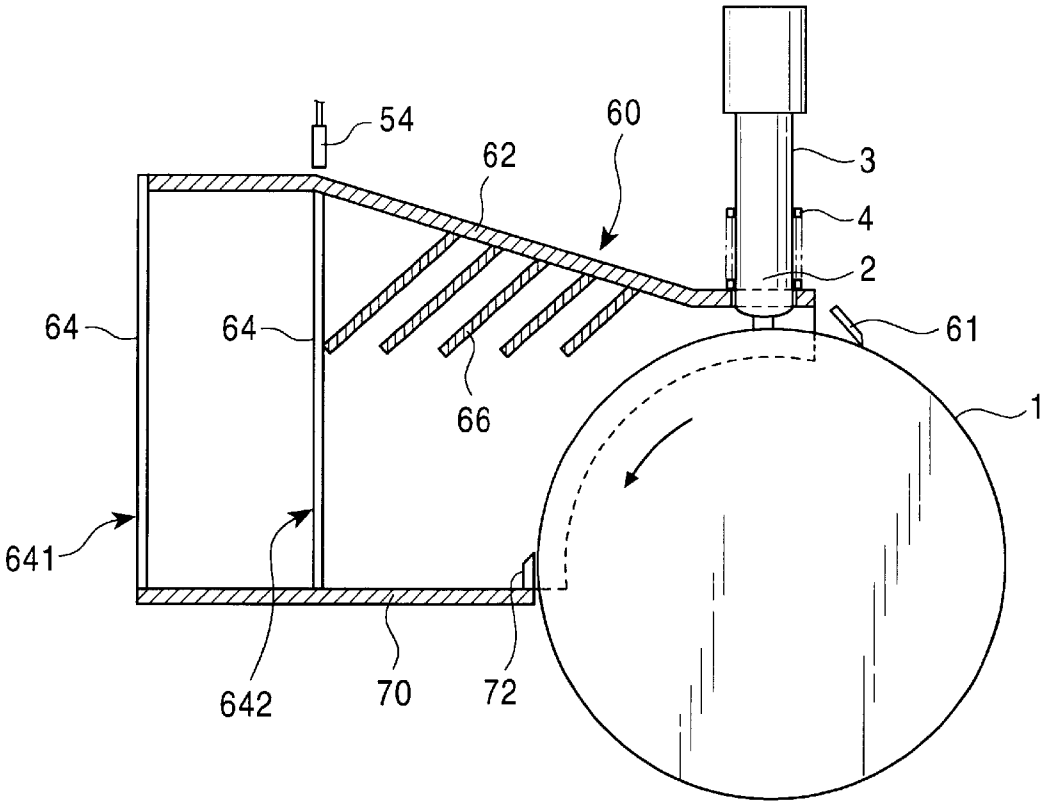
FIG. 6A is a sectional side view of the apparatus.
Figure 6B:
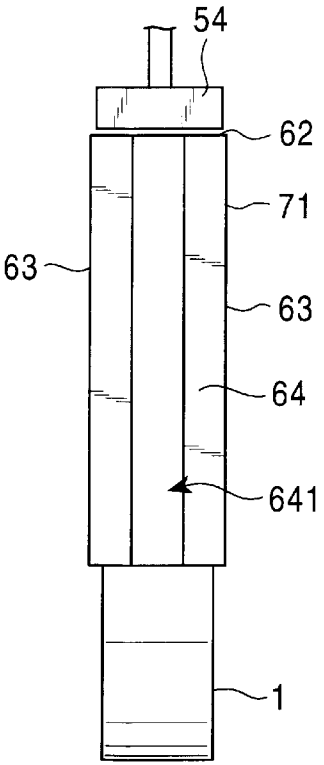
FIG. 6B is a front view thereof.

Further, as shown in FIG. 6, the roll top air-cutoff plate 62 may have at least one partition 66 which extends into the air-cutoff means 60. The partition 66 can cut off an inflow of air from the hole 641, further decreasing the oxygen concentration in the vicinity of the puddle. Unlike the partition 66 shown in FIG. 6, the partition 66 may be vertically projected downward, not projected in the rotation direction of the cooling roll 1.

Figure 7A:
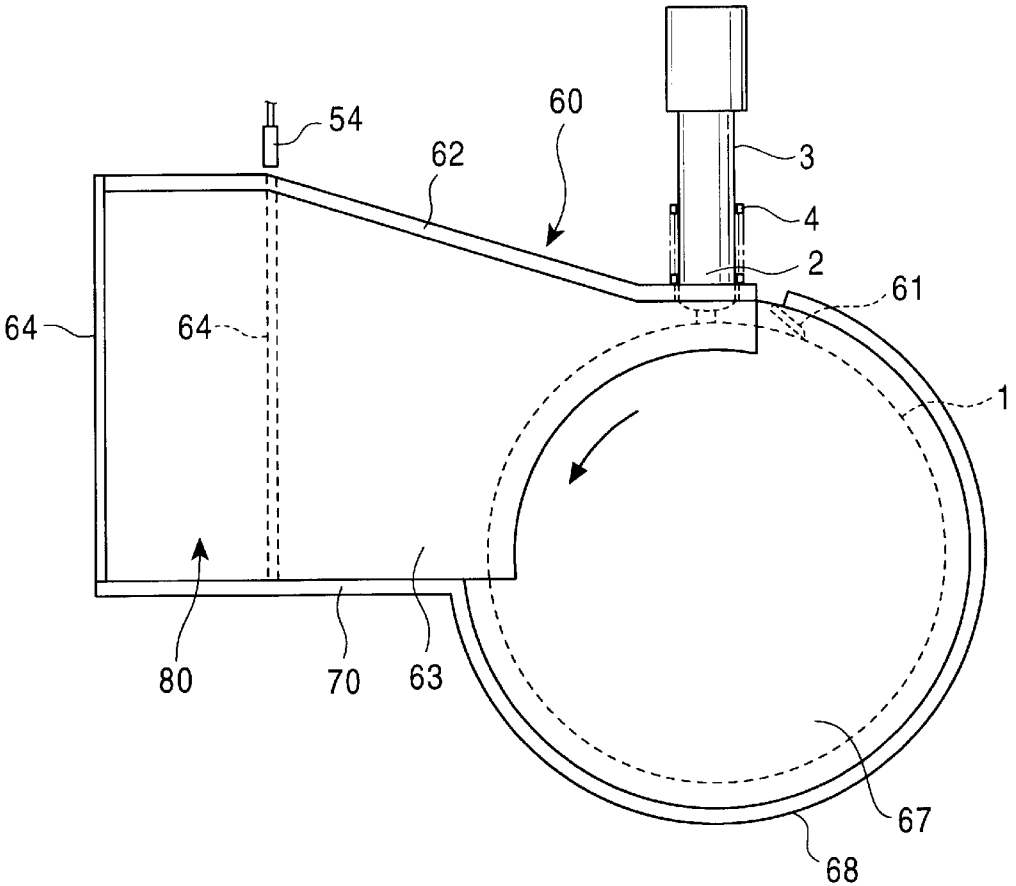
FIG. 7A is a side view of the apparatus.
Figure 7B:
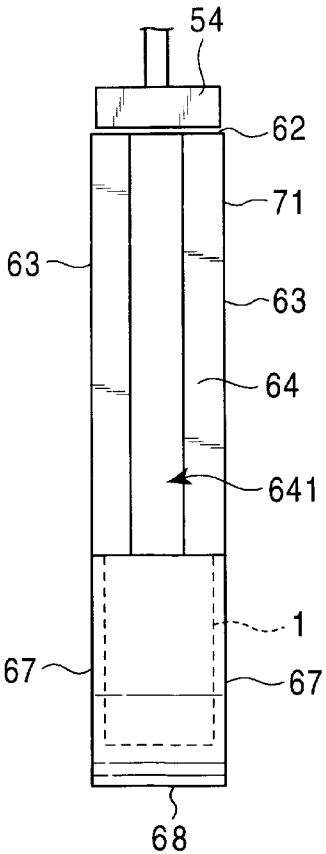
FIG. 7B is a front view thereof.
Figure 8B:
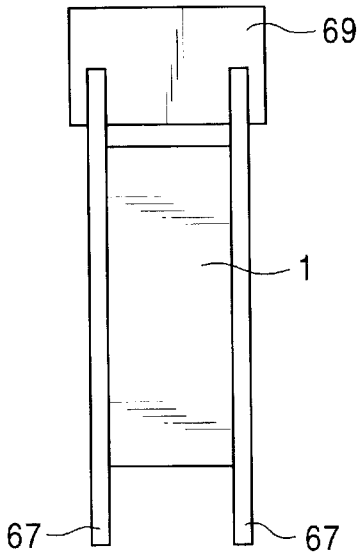
FIG. 8B is a front view.
Figure 8A:
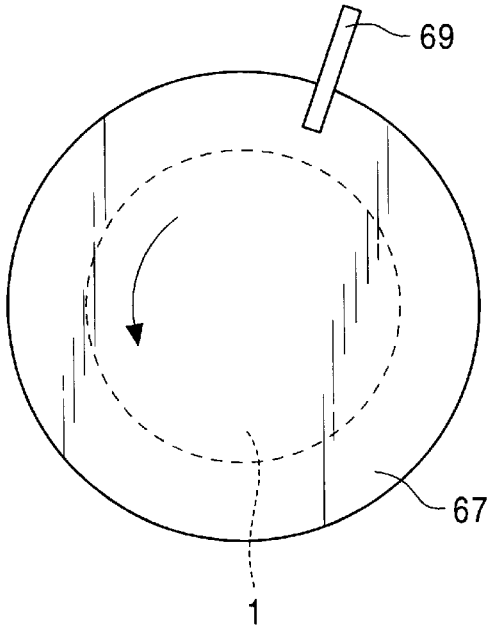
FIG. 8A is a side view.

As the air-cutoff means 60, roll side air-cutoff plates 67, a roll periphery air-cutoff plate 68 and a roll rear air-cutoff plate 69 may also be provided, as shown in FIGS. 7 and 8.

As shown in FIGS. 7 and 8, the roll side air-cutoff plates 67 have a disk form having a larger diameter than the cooling roll 1, and are arranged to contact both sides of the cooling roll 1. The roll side air-cutoff plates 67 are also provided so as to extend from the roll front air-cutoff plates 63 to the rear side of the cooling roll 1.

The roll side air-cutoff plates 67 are arranged for cutting off an inflow of air from the sides of the cooling roll 1.

The roll side air-cutoff plates 67 and the roll front air-cutoff plates 63 may be integrally provided.

The roll periphery air-cutoff plate 68 is arranged at the outer edges of the roll side air-cutoff plates 67 so as to surround the outer periphery of the cooling roll 1. The cooling roll 1 is arranged in the space comparted by the roll periphery air-cutoff plate 68 and the pair of the roll side air-cutoff plates 67. The roll periphery air-cutoff plate 68 can improve the effect of cutting off air by the roll surface air-cutoff plate 61.

As shown in FIG. 8, the roll rear air-cutoff plate 69 has a plate structure having a width larger than the width of the cooling roll 1, and is arranged for cutting off an inflow of air from the lower rear side of the cooling roll 1.

Of course, the above-described air-cutoff plates 61 to 69 can be used singly or in a combination of a plurality of plates. The arrangement of all air-cutoff plates 61 to 69 causes the cooling roll 1 to be substantially surrounded, thereby most improving the effect of decreasing the oxygen concentration in the vicinity of the puddle by the gas flows from the first to fourth gas flow nozzles 51 to 54. When the air-cutoff plates 61 to 69 are used singly, the roll surface air-cutoff plate 61, the roll top air-cutoff plate 62 and the roll side air-cutoff plates 67 have the highest effect of decreasing the oxygen concentration.

In the metallic ribbon producing apparatus shown in FIGS. 1 to 7, the roll face air-cutoff plates 64 are provided at two positions to form a space as an air retention portion 80 between the two roll face air-cutoff plates 64.

Although, in FIGS. 1 to 7, the air retention portion 80 is provided outside the roll periphery air-cutoff means 60, it may be provided in the air-cutoff means 60. Where the air retention portion 80 has an opening area larger than the opening area of the air-cutoff means 60, the air retention effect can be improved. The air retention portion 80 can also improve the air retention effect by partitioning using a plurality of partitions.

Figure 9:
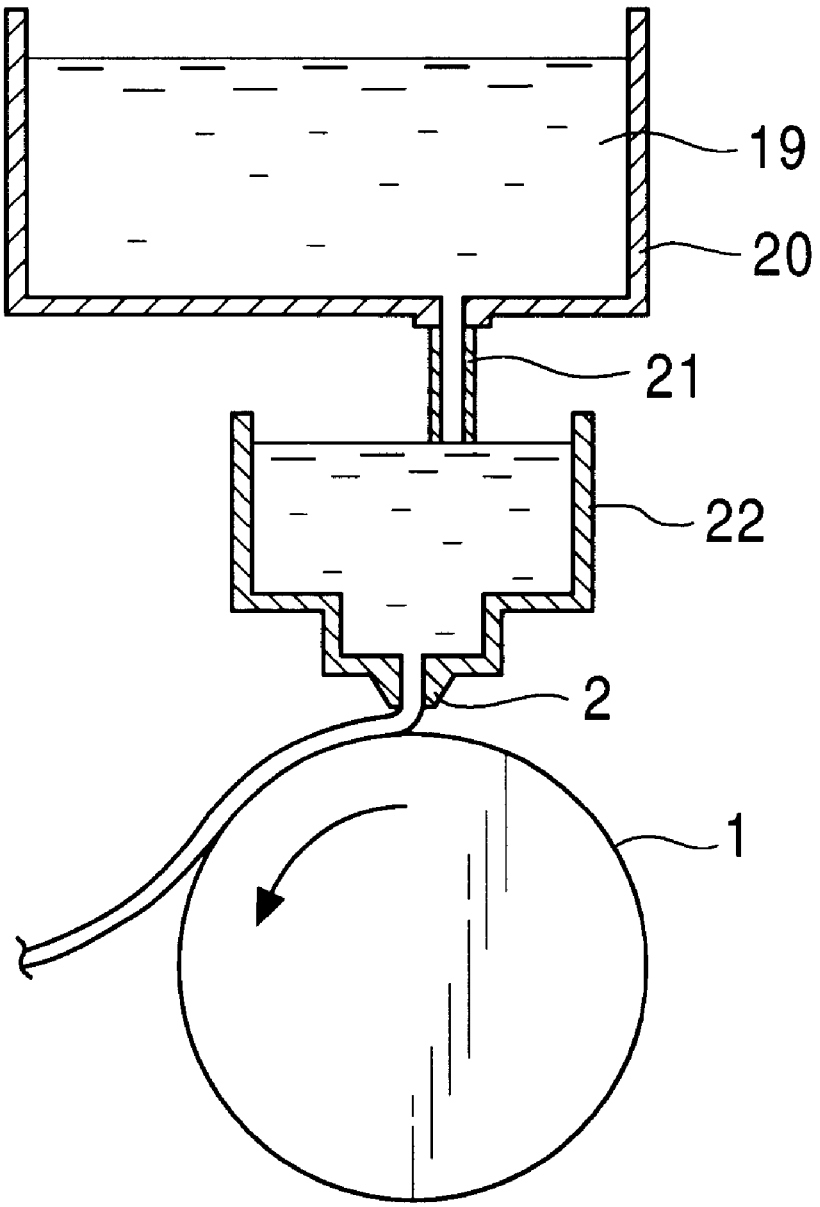
FIG. 9 is a drawing showing a metallic ribbon producing apparatus suitable for continuous production in accordance with the first to third embodiments of the present invention.
Figure 10A:
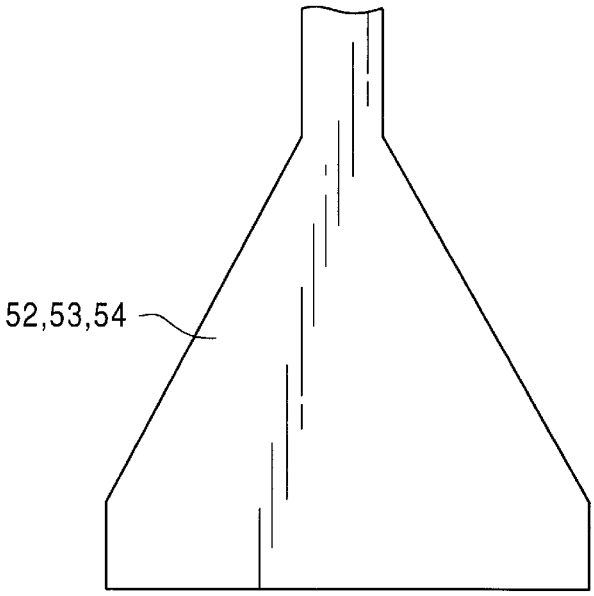
FIG. 10A is a plan view.
Figure 10B:
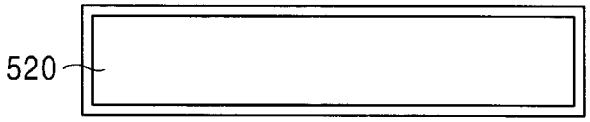
FIG. 10B is a front view of the second gas flow nozzle.
Figure 10C:
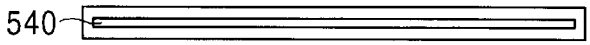
FIG. 10C is a front view of the third gas flow nozzle.
Figure 10D:
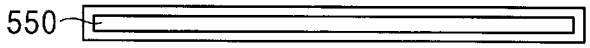
FIG. 10D is a front view of the fourth gas flow nozzle.

The metallic ribbon producing apparatus shown in FIGS. 1 to 7 uses the crucible 3 having a small capacity, and in the continuous production of a large amount of metallic ribbon, thus the gas flows, the air-cutoff means and the air retention portion of the present invention can be applied to a metallic ribbon producing apparatus having the basic construction shown in FIG. 9. Namely, in the metallic ribbon producing apparatus shown in FIG. 9, a melt 19 is held in a melting furnace 20, and is supplied to a tundish 22 from the bottom outlet of the melting furnace 20 through a discharge pipe 21. The melt nozzle 2 is provided at the bottom of the tundish 22 so that the melt is blown out of the melt nozzle 2 toward the surface of the cooling roll 1 which is rotated at a high speed and is solidified to form a ribbon. This apparatus permits successive supply of the melt to the tundish 22 from the melting furnace 20 when the amount of the melt in the tundish 22 is decreased, and is thus suitable for continuous production.

A metallic ribbon producing apparatus in accordance with a second embodiment of the present invention will be described below with reference to the drawings.

Figure 12A:
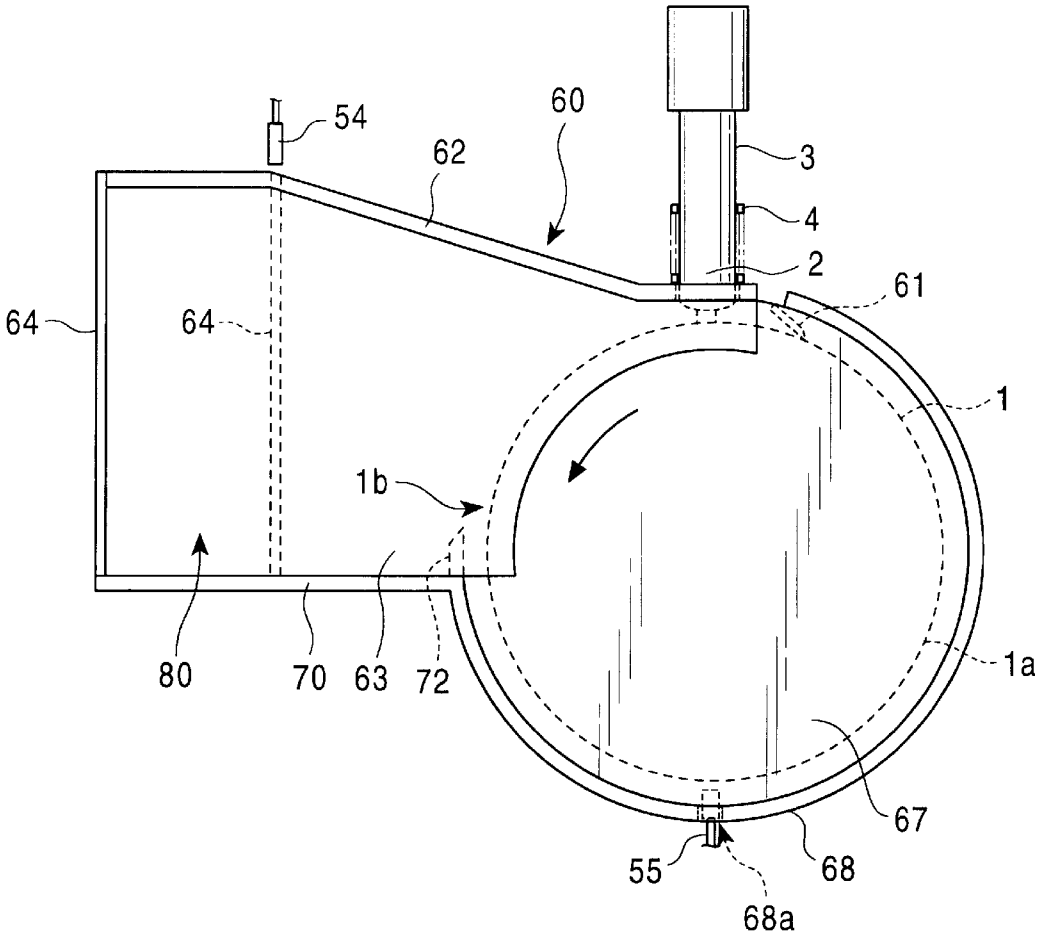
FIG. 12A is a side view of the apparatus.
Figure 12B:
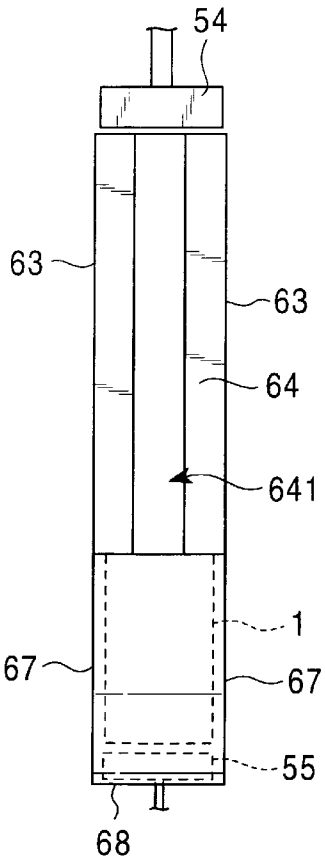
FIG. 12B is a front view thereof.
Figure 13:
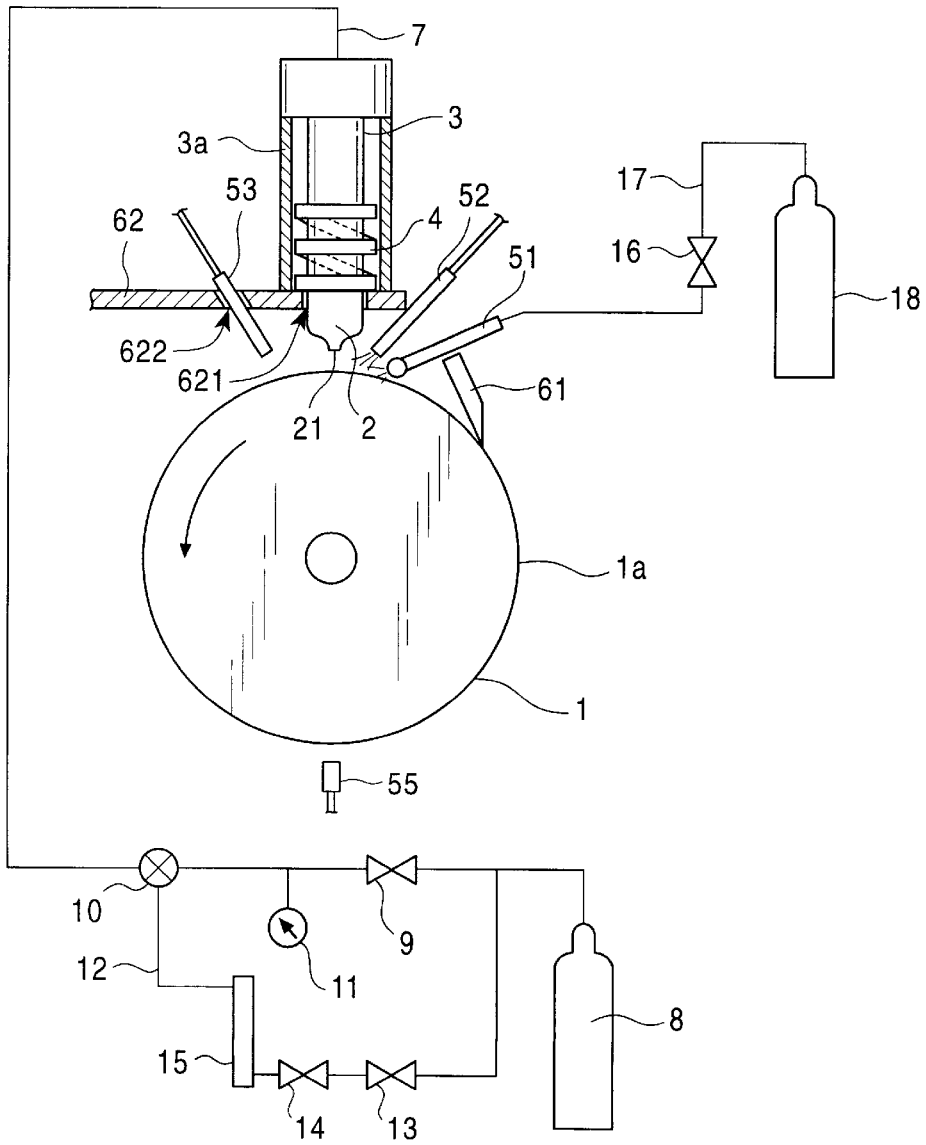
FIG. 13 is a drawing showing the configuration of a principal portion of the metallic ribbon producing apparatus shown in FIG. 12.

In the metallic ribbon producing apparatus of this embodiment shown in FIGS. 12, 13 and 4, a melt is ejected to the cooling surface 1*a* of a rotating cooling roll 1 and cooled by the cooling surface 1*a* to obtain a metallic ribbon.

The metallic ribbon producing apparatus basically comprises the cooling roll 1; a melt nozzle 2 connected to the lower end of a crucible 3 which holds a melt; a heating coil 4 wound on the peripheries of the melt nozzle 2 and the crucible 3; air-cutoff means 60 which covers, along the rotation direction of the cooling roll 1, the cooling surface 1*a* from at least the melt blowout end of the melt nozzle 2 to position 1*b* where the metallic ribbon is separated from the cooling surface 1*a*, for preventing an inflow of air due to rotation of the cooing roll 1; a roll surface air-cutoff plate 61 serving as roll surface air-cutoff means in contact with the cooling surface 1*a*, which is provided at a position shifted from the position where the melt nozzle 2 is opposite to the cooling roll 1, in the direction opposite to the rotation direction of the cooling roll 1; a roll periphery air-cutoff plate 68 serving as roll periphery air-cutoff means; first to fourth gas flow nozzles 51 to 54 which constitute first gas flow supply means for flowing an inert gas to the vicinity of the melt nozzle 2; a fifth gas flow nozzle 55 serving as second gas flow supply means for flowing inert gases to the cooling surface 1*a* of the cooling roll 1; and an air retention portion 80.

The cooling roll 1 is rotated in the direction of an arrow (counterclockwise) by a motor not shown. The cooling surface 1*a* of the cooling roll 1 is preferably made of carbon steel, a Fe-based alloy such as JIS (Japan Industrial Standard) S45C, brass (Cu—Zn alloy) or pure Cu. With the cooling roll 1 having the cooling surface 1*a* made of brass or pure Cu, the cooling roll 1 has high thermal conductivity, and thus exhibits a high cooling effect and is suitable for rapidly cooling a melt. In order to improve the cooling effect, a water-cooling structure is preferably provided in the cooling roll 1.

In FIG. 13, the melt in the crucible 3 is blown out of the melt nozzle 2 at the lower end of the crucible 3 toward the cooling surface 1*a* of the cooling roll 1. The upper portion of the crucible 3 is connected to a gas supply source 8 for an Ar gas or the like through a supply pipe 7 in which a pressure-regulating valve 9 and a solenoid valve 10 are provided, a pressure gage 11 being provided between the pressure-regulating valve 9 and the solenoid valve 10 in the supply pipe 7. An auxiliary pipe 12 is connected in parallel with the supply pipe 7, the auxiliary pipe 12 containing a pressure-regulating valve 13, a flow control valve 14, and a flow meter 15. Therefore, a gas such as an Ar gas is supplied into the crucible 3 from the gas supply source 8 to blow the melt out of the melt nozzle 2 to the cooling roll 1.

In the production of a metallic ribbon, the melt is blown out of the nozzle 2 arranged near the top of the cooing roll 1 which is rotated at high speed, or arranged slightly ahead of the top, to drawn out a ribbon in the rotation direction of the cooling roll 1 while solidifying the melt by rapid cooling by the surface of the cooling roll 1. Although the melt blowout portion of the melt nozzle has a rectangular shape, the blowout width (the width of the cooling roll 1 in the rotation direction thereof) is preferably about 0.2 to 0.8 mm. With a blowout width of less than 0.2 mm, the melt nozzle is readily clogged according to the composition of the melt, while with a blowout width of over 0.8 mm, sufficient cooling is difficult.

In the production of the metallic ribbon, the distance between the cooling roll 1 and the melt nozzle 2 is preferably selected in the range of 0.1 to 0.8 mm. With a distance of less than 0.1 mm, blowing of the melt is difficult with the possibility of damaging the melt nozzle 2, while with a distance of over 0.8 mm, production of a ribbon having good properties is difficult. The crucible 3 can be moved upward and downward by lifting means not shown so that the distance between the cooling roll 1 and the melt nozzle 2 can be adjusted. Since the temperature is increased to increase the diameter of the cooling roll 1 due to thermal expansion of the surface after the start of production of a metallic ribbon, it is preferable for producing a metallic ribbon with high thickness precision to gradually increase the distance between the cooling roll 1 and the melt nozzle 2 after the start of production.

As shown in FIG. 12, a ribbon guide plate 70 and a scraper 72 are provided in the lower portion of the cooling roll 1 on the front side in the rotation direction thereof. The metallic ribbon formed by cooling the melt on the cooling surface 1*a* of the cooing roll 1 is separated from the cooling roll 1 by the scraper 72, guided by the ribbon guide plate 70, and then discharged to the outside of the metallic ribbon producing apparatus through a passage opening 641. Therefore, the position 1*b* where the metallic ribbon is separated from the cooling surface 1*a* is near the scraper 72.

As shown in FIGS. 12, 13 and 4, the roll surface air-cutoff plate 61 is located behind the position where the melt nozzle 2 is opposite to the cooling roll 1, in the rotation direction of the cooing roll 1, has a plate structure having an acute angle end, and is arranged so that the acute angle end contacts the surface of the cooling roll 1. The roll surface air-cutoff plate 61 is provided for cutting off an inflow of air into the vicinity of the puddle which adheres to the surface of the cooling roll 1. During high-speed rotation of the cooling roll 1, the air which flows into the vicinity of the puddle which adheres to the surface of the cooling roll 1, is cut off by being scraped off by the roll surface air-cutoff plate 61.

The roll periphery air-cutoff plate 68 serving as roll periphery air-cutoff means is provided at a distance from the cooling surface 1*a* so as to extend along the rotation direction of the cooling roll 1 from the position 1*b* where the metallic ribbon is separated from the cooling surface 1*a* to the position where the roll surface air-cutoff plate 61 (roll surface air-cutoff means) is provided, to surround the cooling roll 1 with the cooling surface 1*a* covered.

The inert gas can be supplied from the first gas flow supply means on either or both of the rear side and front side on the basis of the melt nozzle 2. It is preferably to supply two-system gas flows from the rear and front sides.

In FIG. 13, like in the above-described first embodiment, the first gas flow nozzle 51 is one of means for supplying the two-system gas flows, which is arranged on the rear side on the basis of the melt nozzle 2, for flowing a gas to the vicinity (hereinafter, a puddle) of the end of the melt nozzle 2 from the rear side of the cooling roll 1 in the direction substantially normal to the cooling roll 1. As shown in FIG. 11, the first gas flow nozzle 51 has a relatively thin slit 510 having a width of 5 mm to provide gas flow at a relatively high flow rate.

The second gas flow nozzle 52 is the other means for supplying the two-system gas flows, and is provided between the melt nozzle 2 and the first gas flow nozzle 51, for supplying a gas flow to cut off the gas supplied from the first gas flow nozzle 51 from air, preventing an inflow of air. As shown in FIG. 10, the second gas flow nozzle 52 has a slit 520 of 20 mm wider than the first gas flow nozzle 51 to flow a gas at a rate lower than the first gas flow.

Since, as shown in FIG. 13, the first and second gas flow nozzles 51 and 52 are arranged between the roll surface air-cutoff plate 61 and the melt nozzle 2, the flow of the inert gas is supplied immediately after the air is cut off by the roll surface air-cutoff plate 61, thereby improving the effect of decreasing the oxygen concentration in the vicinity of the puddle. In order to more effectively cut off an inflow of air into the vicinity of the puddle, a plurality of roll surface air-cutoff plates 61 may be provided.

The third gas flow nozzle 53 is one of means for supplying the two-system gas flows, which is arranged on the front side on the basis of the melt nozzle 2, for preventing an inflow of air from the front side in the rotation direction of the cooling roll 1. The third gas flow nozzle 53 has the same shape as the second gas flow nozzle 52, but a slit 540 thereof has a smaller width of 2.5 mm.

As shown in FIG. 12, the fourth gas flow nozzle 54 is the other means for supplying the two-system gas flows, which is arranged above the end of air-cutoff means 60 on the front side of the melt nozzle 2, for preventing an inflow of air from the hole 641 located in front of the cooling roll 1. As shown in FIG. 10, the fourth gas flow nozzle 54 has the same shape as the second and third gas flow nozzles 52 and 53, but a slit 550 has a width of 3 mm.

Of course, the first to fourth gas flow nozzles can be used singly or in a combination of a plurality of nozzles. The first and second gas flow nozzles have the highest effect of decreasing the oxygen concentration in the vicinity of the puddle.

Each of the first to fourth gas flow nozzles is connected to a gas supply source 18 through a connecting pipe 17 to which a pressure control valve 16 is connected, as shown by the first gas flow nozzle 51 in FIG. 13 as an example.

As shown in FIG. 12, the second gas flow supply means supplies an inert gas to the cooling surface 1*a* of the cooling roll 1, and preferably the inert gas is supplied between the position where the air-cutoff means 60 is provided, more preferably from the position 1*b* where the metallic ribbon is separated from the cooling surface 1*a*, to the position the roll surface air-cutoff plate 61 is provided.

In FIG. 12, the fifth gas flow nozzle 55 serving as the second gas flow supply means is located directly below the cooling roll 1 with a distance from the cooling surface 1*a*, and provided in a hole 68*a* formed at any desired position of the roll periphery air-cutoff plate 68 so as to face the cooling surface 1*a* so that a gas can be flowed to the cooling surface 1*a*.

As shown in FIG. 12, the fifth gas flow nozzel 55 has a relatively thin slit having a width of 3 mm, thereby flowing a gas at a more less high speed.

The inert gas supplied from the fifth gas flow nozzle 55 flows on the cooing surface 1*a* along the rotation direction of the cooling roll 1 with rotation of the cooling roll 1, and reaches the vicinity of the roll surface air-cutoff plate 61. Although the roll surface air-cutoff plate 61 is arranged in contact with the cooling surface 1*a*, a small space is formed between the roll surface air-cutoff plate 61 and the cooling surface 1*a*. Therefore, the inert gas flowing along the cooling surface 1*a* passes through the space and flows into the vicinity of the melt nozzle 2, decreasing the oxygen concentration in the vicinity fo the puddle.

By providing the roll periphery air-cutoff plate 68, the oxygen concentration in the vicinity of the puddle can be further decreased. This is because the cooling surface 1*a* is covered with the roll periphery air-cutoff plate 68 to prevent diffusion of the inert gas flowing from the fifth gas flow nozzle 55 to the roll surface air-cutoff plate 61 along the cooling surface 1*a* up to the time the inert gas reaches the roll surface air-cutoff plate 61, thereby causing a larger amount of inert gas to pass through the roll surface air-cutoff plate 61 and flow into the vicinity of the puddle.

In this way, the fifth gas flow nozzle 55 is arranged substantially directly below the cooling roll 1, the roll surface air-cutoff plate 61 is provided on the rear side on the basis the melt nozzle 2 in the rotation direction of the cooling roll 1, and the first to fourth gas flow nozzles 51 to 54 are arranged around the melt nozzle 2. This permits a decrease in the oxygen concentration in the vicinity of the puddle.

The arrangement position of the fifth gas flow nozzle is not limited to the position directly below the cooling roll 1, and the position of the fifth gas flow nozzle may be between the vicinity of the position 1*b* where the metallic ribbon is separated from the cooling surface 1*a* to the position where the roll surface air-cutoff plate 61 is provided.

Figure 14A:
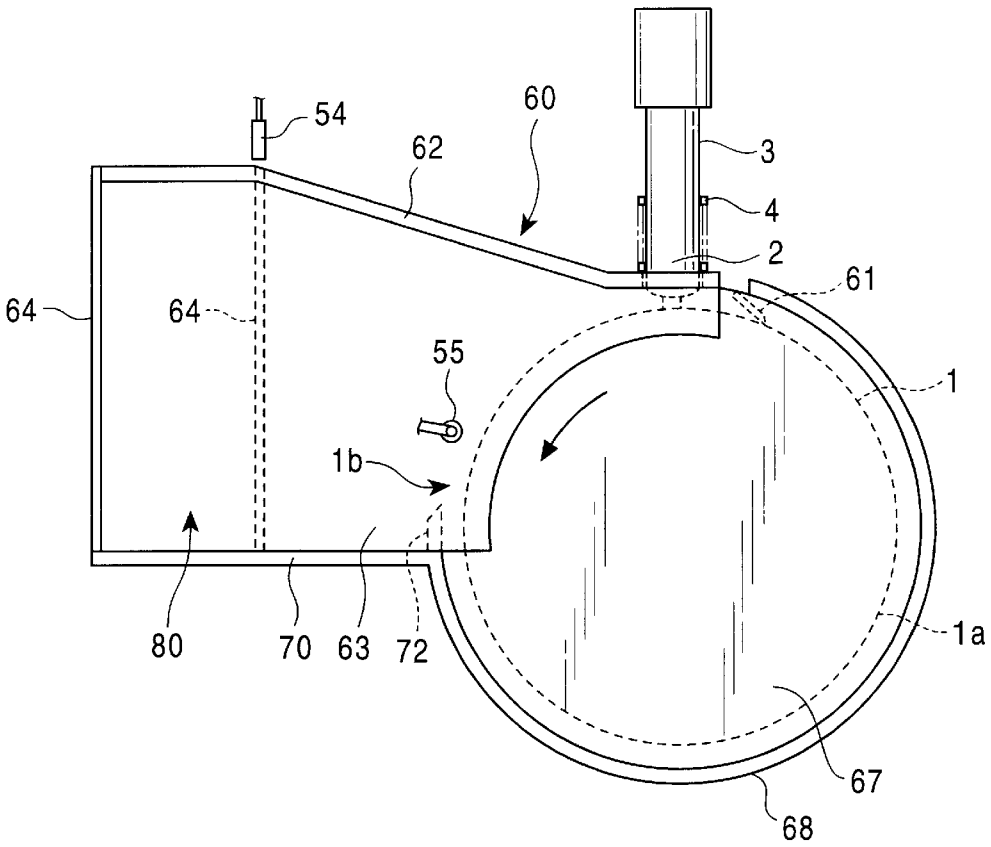
FIG. 14A is a side view of the apparatus.
Figure 14B:
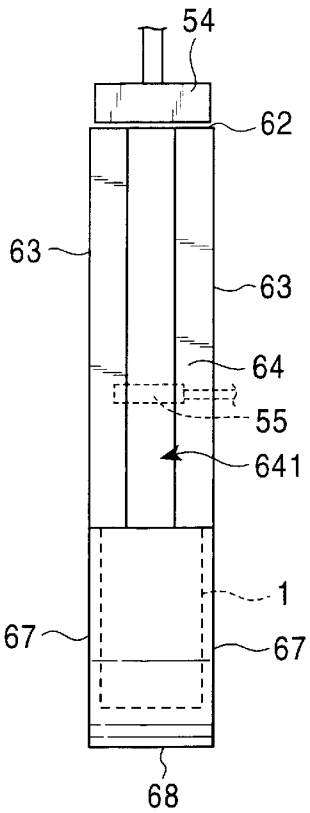
FIG. 14B is a front view thereof.

For example, as shown in FIG. 14, the fifth gas flow nozzle 55 may be provided near the position 1*b* where the metallic ribbon is separated from the cooling surface 1*a*. In this case, the fifth gas flow nozzle 55 is passed through the roll front air-cutoff plate 63 and arranged to face the cooling surface 1*a* from the side of the cooling roll 1.

In this case, the inert gas flowed from the fifth gas flow nozzle 55 flows to the roll surface air-cutoff plate 61 along the rotation direction of the cooling roll 1, as well as flowing to the melt nozzle 2 in the direction opposite to the rotation direction of the cooling roll 1.

In the production of the ribbon by using the metallic ribbon producing apparatus of the present invention, the supply of an inert gas from the gas flow nozzles 51 to 55 is preferably started before the cooling roll 1 is rotated. This is because when the flows of the gases is started before the cooling roll is rotated, the oxygen concentration is rapidly decreased, as compared with the supply of the inert gases is started after the cooling roll is rotated. Therefore, from the viewpoint of production efficiency, it is preferable to measure the oxygen concentration in the atmosphere near the melt nozzle, and then rotate the cooling roll 1 after the oxygen concentration reaches a predetermined value.

In the present invention, the inert gas is preferably supplied from the first gas flow supply means under conditions including a flow rate of 200 to 2000 l/min, more preferably a flow rate of 1830 l/min. This is because with a flow rate of less than 200 l/min, there is no effect of decreasing the oxygen amount in the atmosphere near the melt nozzle, while with a flow rate of over 2000 l/min, the effect of decreasing the oxygen concentration is decreased by an inflow of air from the periphery due to the gas flows, and thus no effect can be expected for the supply.

In this case, preferably, the flow rate of one (the first gas flow nozzle) of the two-system gas flows from the rear side is 5 to 400 l/min, and the flow rate of the other gas flow (the second gas flow nozzle) is 5 to 400 l/min. In addition, preferably, the flow rate of one (the third gas flow nozzle) of the two-system gas flows from the front side is 5 to 400 l/min, and the flow rate of the other gas flow (the fourth gas flow nozzle) is 300 to 600 l/min. The first gas flow is more preferably in the flow rate range of 250 to 350 l/min, most preferably at a flow rate of 300 l/min; the second gas flow is more preferably in the flow rate range of 230 to 330 l/min, most preferably at a flow rate of 280 l/min; the third gas flow is more preferably in the flow rate range of 200 to 300 l/min, most preferably at a flow rate of 250 l/min; the fourth gas flow is more preferably in the flow rate range of 400 to 550 l/min.

Particularly, when the flow rate of the fourth gas flow is 450 l/min, more preferably 500 l/min, the oxygen concentration in the vicinity of the puddle can be further decreased.

In the present invention, the inert gas is preferably supplied from the second gas flow supply means under conditions including a flow rate of 400 to 600 l/min, more preferably a flow rate of 500 l/min. This is because with a flow rate of less than 400 l/min, there is no effect of decreasing the oxygen amount in the atmosphere near the melt nozzle, while with a flow rate of over 600 l/min, no effect can be expected for the supply.

Therefore, the flow rate of the fifth gas flow nozzle 55 is preferably 400 to 750 l/min. The fifth gas flow is preferably in the flow rate range of 450 to 550 l/min, most preferably at a flow rate of 500 l/min.

As the inert gas used in the metallic ribbon producing apparatus of the present invention, one or at least two gases are selected from $N_2$, He, Ar, Kr, Xe and Rn. However, as seen from the examples below, Ar is most preferable.

Description will be made of the air-cutoff means 60.

As shown in FIGS. 12, 13 and 14, the air-cutoff means 60 of the present invention comprises at least a roll face air-cutoff plate 64 provided in front of the cooling roll 1 on the front side in the rotation direction thereof on the basis of the position of the melt nozzle 2, a pair of roll front air-cutoff plates 63 provided on both sides of the cooling roll 1 with the cooling roll 1 held therebetween so as to contact the roll face air-cutoff plate 64 on the front side in the rotation direction of the cooling roll 1, a roll top air-cutoff plate 62 provided above the cooling roll 1 on the front side in the rotation direction thereof so as to contact the upper edges of the roll front air-cutoff plates 63, and a pair of roll side air-cutoff plates 67 provided with the cooling roll 1 held therebetween so as to contact the roll front air-cutoff plates 63 and the roll periphery air-cutoff means.

As shown in FIGS. 12 and 14, the roll front air-cutoff plates 63 are arranged for cutting off an inflow of air from both sides of the cooling roll 1 at the front thereof.

The roll face air-cutoff plate 64 is arranged for cutting off an inflow of air from the front side opposite to the surface of the cooling surface of the cooling roll 1. Although, in this embodiment, the roll face air-cutoff plate 64 is arranged at two positions including the front ends and the substantially centers of the roll front air-cutoff plates 63, the roll face air-cutoff plate 64 may be provided at one or at least three positions according to demand (refer to FIGS. 12 and 14). In this case, it can be expected that the oxygen concentration in the environment near the melt nozzle 2 can be further decreased. The roll face air-cutoff plate 64 comprises a ribbon pass hole 641 provided at the center thereof so that a ribbon is passed through the ribbon pass hole 641 in the production of the ribbon.

As shown in FIGS. 12 and 14, the roll top air-cutoff plate 62 extends from the front side to the rear side on the basis of the position of the melt nozzle 2 in the rotation direction of the cooling roll 1, and mounted and fixed to the upper edges of the roll front air-cutoff plates 63 to be located above the cooling roll 1. The roll top air-cutoff plate 62 is arranged for cutting off a flow of air to the cooling roll 1 from above.

The roll top air-cutoff plate 62 is provided in such a manner that it approaches the top of the cooling surface of the cooling roll 1 in the direction opposite to the rotation direction of the cooling roll 1.

As shown in FIG. 4, the roll top air-cutoff plate 62 comprises a nozzle mounting hole 621. The melt nozzle 2 is passed through the nozzle mounting hole 621 and arranged so that the melt blowout end 21 of the melt nozzle 2 faces the cooling surface 1*a* of the cooling roll 1.

The crucible 3 is contained in a cylinder 3*a*, as shown in FIG. 13. The. cylinder 3*a* closes the nozzle mounting hole 621 to prevent an inflow of air.

Furthermore, the roll top air-cutoff plate 62 comprises a hole 622 through which the third gas flow nozzle 53 is passed, as shown in FIGS. 13 and 14. The third gas flow nozzle 53 is passed through the hole 622 and arranged so that the end of the nozzle faces the cooling surface of the cooling roll 1. The third gas flow nozzle 53 supplies a flow of the inert gas to the vicinity of the puddle from the front side in the rotation direction of the cooling roll 1.

Since the roll top air-cutoff plate 62 is provided near the cooling surface 1*a* of the cooling roll 1, the space near the puddle is narrowed. Large amounts of inert gases are supplied to the narrow space from the first to third gas flow nozzles 51 to 53, significantly increasing the concentration of the inert gas and conversely significantly decreasing the oxygen concentration in the vicinity of the puddle.

Only the melt blowout end 21 of the melt nozzle 2 is passed through the roll top air-cutoff plate 62. The body of the melt nozzle 2 is located above the roll top air-cutoff plate 62, i.e., outside the air-cutoff means 60. Therefore, the body of the melt nozzle 2, the crucible 3, and the heating coil 4 wound thereon are located outside the air-cutoff means 60.

Therefore, the melt nozzle 2 can easily be attached to and detached from the air-cutoff means 60.

Figure 15A:
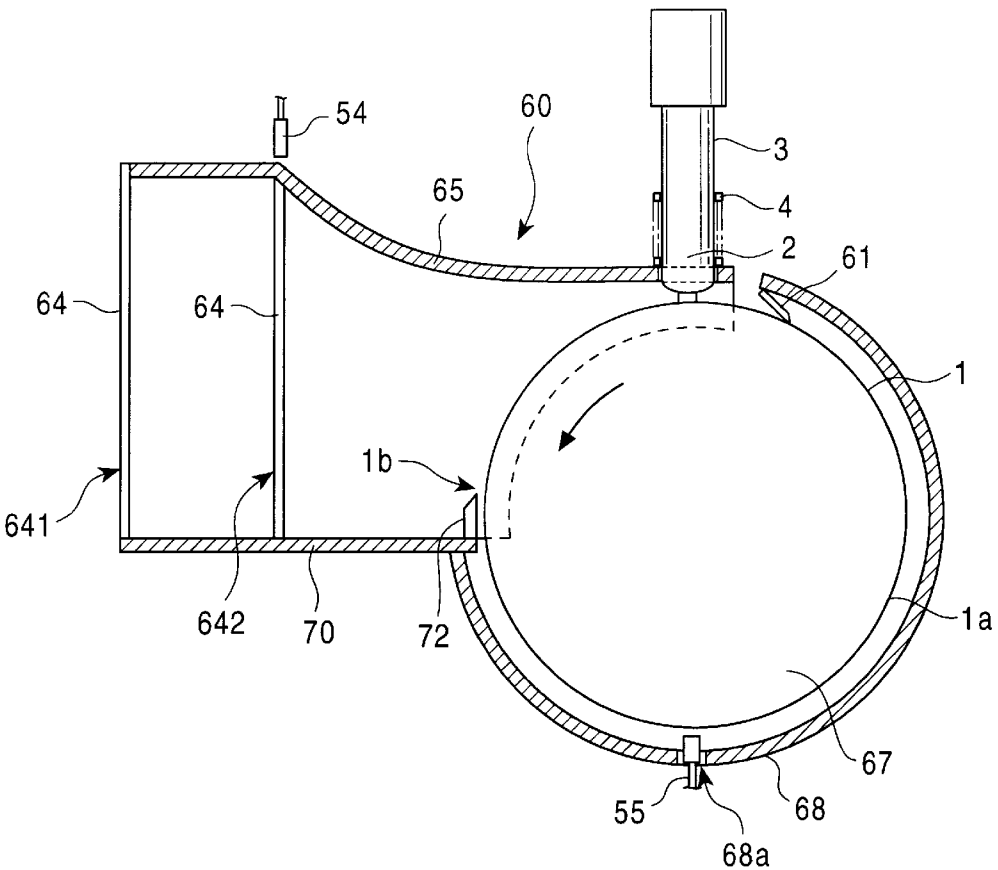
FIG. 15A is a sectional side view of the apparatus.
Figure 15B:
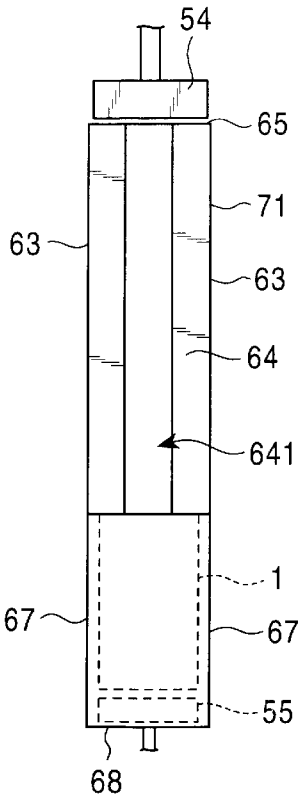
FIG. 15B is a front view thereof.

As shown in FIGS. 12 and 14, the roll top air-cutoff plate 62 flatly extends from the front side in the rotation direction of the cooling roll 1 to the cooling surface thereof. However, the roll top cutoff plate 62 is not limited to this, and a roll top air-cutoff plate 65 may be provided, which extends from the front side in the rotation direction of the cooling roll to the cooing surface 1*a* thereof so as to be curved to the inside of the air-cutoff means 60, as shown in FIG. 15. The roll top air-cutoff plate 65 can cut off an inflow of air through the opening 641 to decrease the oxygen concentration in the vicinity of the puddle.

Figure 16A:
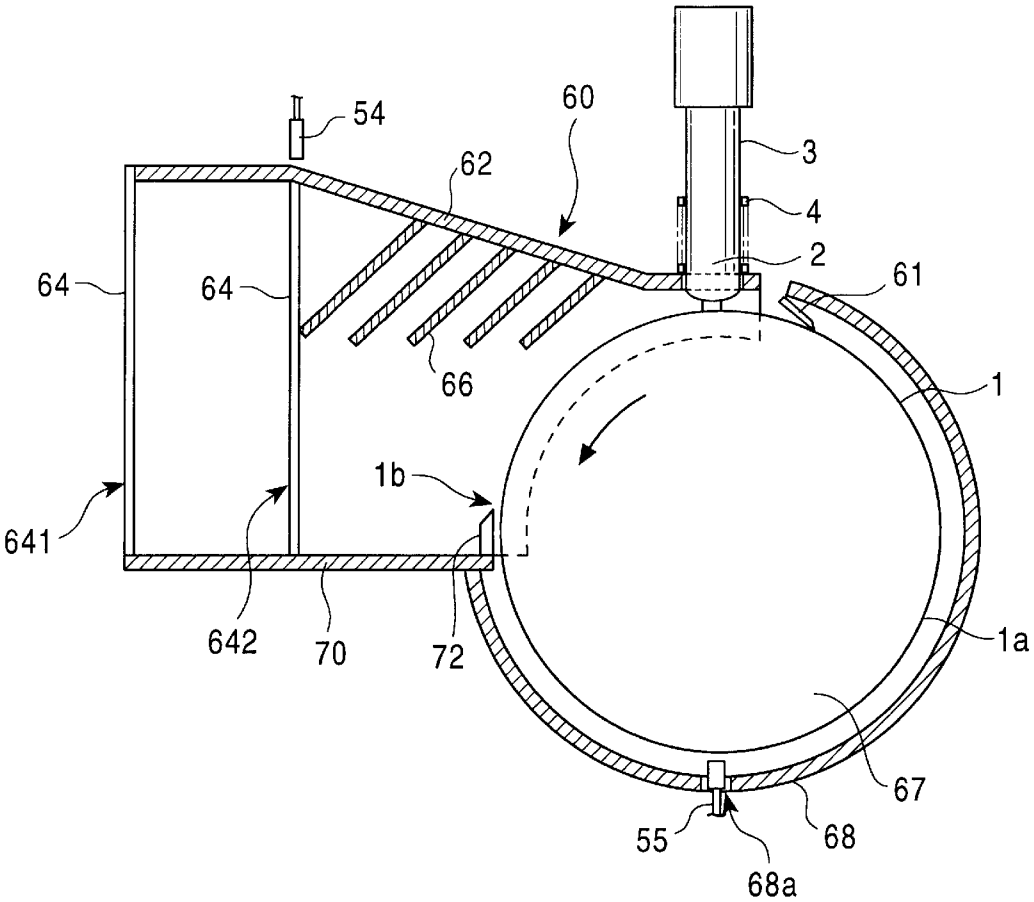
FIG. 16A is a sectional side view of the apparatus.
Figure 16B:
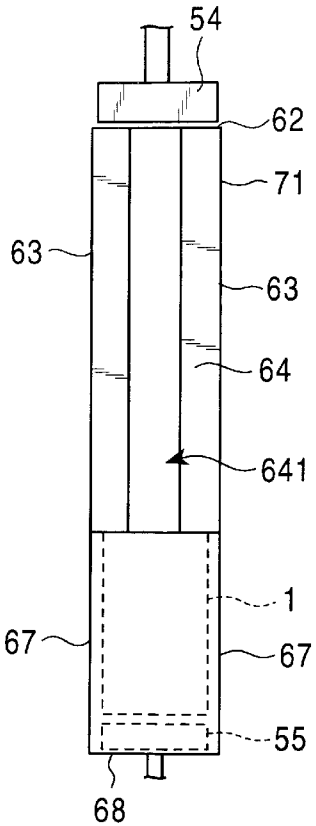
FIG. 16B is a front view thereof.

Further, as shown in FIG. 16, the roll top air-cutoff plate 62 may have at least one partition 66 which extends into the air-cutoff means 60. The partition 66 can cut off an inflow of air through the opening 641, further decreasing the oxygen concentration in the vicinity of the puddle. Unlike the partition 66 shown in FIG. 16, the partition 66 may be vertically projected downward, not projected in the rotation direction of the cooling roll 1.

As shown in FIGS. 12, 14 and 8, the roll side air-cutoff plates 67 have a disk form having a larger diameter than the cooling roll 1, and are arranged to contact both sides of the cooling roll 1. The roll side air-cutoff plates 67 are also provided so as to extend from the roll front air-cutoff plates 63 to the rear side of the cooling roll 1.

The roll side air-cutoff plates 67 are arranged for cutting off an inflow of air from the sides of the cooling roll 1.

The roll side air-cutoff plates 67 and the roll front air-cutoff plates 63 may be integrally provided.

The cooling roll 1 is arranged in the space comparted by the roll periphery air-cutoff plate 68 and the pair of the roll side air-cutoff plates 67. The roll periphery air-cutoff plate 68 can improve the effect of cutting off air by the roll surface air-cutoff plate 61.

As shown in FIG. 8, a roll rear air-cutoff plate 69 may be provided as the air-cutoff means. The roll rear air-cutoff plate 69 has a plate structure having a width larger than the width of the cooling roll 1, and is arranged for cutting off an inflow of air from the lower rear side of the cooling roll 1.

Of course, the above-described air-cutoff plates 61 to 65 and 67 to 69 can be used singly or in a combination of a plurality of plates. The arrangement of all air-cutoff plates 61 to 65 and 67 to 69 causes the cooling roll 1 to be substantially surrounded, thereby most improving the effect of decreasing the oxygen concentration in the vicinity of the puddle by the gas flows from the first to fifth gas flow nozzles 51 to 55.

In the metallic ribbon producing apparatus shown in FIGS. 12 and 14 to 16, the roll face air-cutoff plates 64 are provided at two positions to form a space as an air retention portion 80 therebetween.

Although, in FIGS. 12 and 14 to 16, the air retention portion 80 is provided outside the air-cutoff means 60, it may be provided in the air-cutoff means 60. Where the air retention portion 80 has an opening area larger than the opening area of the air-cutoff means 60, the air retention effect can be improved. The air retention portion 80 can also improve the air retention effect by partitioning using a plurality of partitions.

The metallic ribbon producing apparatus shown in FIGS. 12 and 14 to 16 uses the crucible 3 having a small capacity, and in the continuous production of a large amount of metallic ribbon, the gas flows, the air-cutoff means and the air retention portion of the present invention can thus be applied to a metallic ribbon producing apparatus having the basic construction shown in FIG. 9. Namely, in the metallic ribbon producing apparatus shown in FIG. 9, a melt 19 is held in a melting furnace 20, and is supplied to a tundish 22 from the bottom outlet of the melting furnace 20 through a discharge pipe 21. The melt nozzle 2 is provided at the bottom of the tundish 22 so that the melt is blown out of the melt nozzle 2 to the surface of the cooling roll 1 is rotated at a high speed, and is solidified to form a ribbon. This apparatus permits successive supply of the melt to the tundish 22 from the melting furnace 20 when the amount of the melt in the tundish 22 is decreased, and is thus suitable for continuous production.

A metallic ribbon producing apparatus in accordance with a third embodiment of the present invention will be described below with reference to the drawings.

Figure 17A:
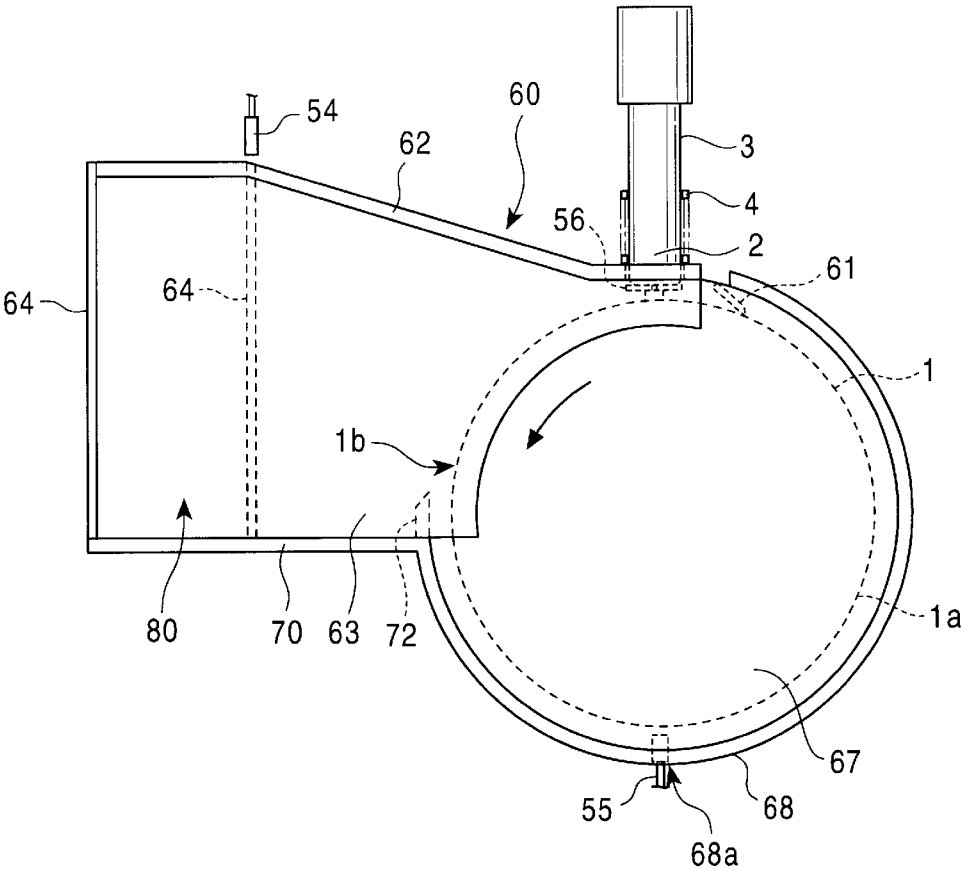
FIG. 17A is a side view of the apparatus.
Figure 17B:
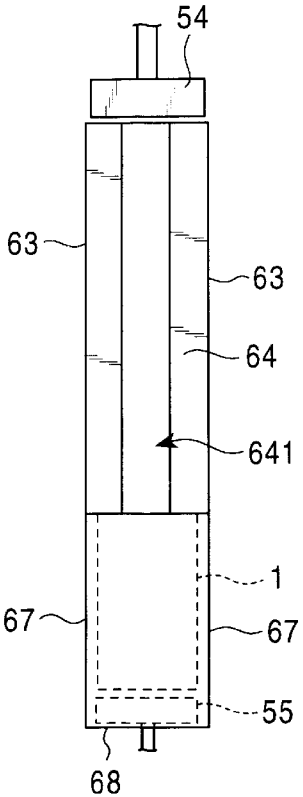
FIG. 17B is a front view thereof.
Figure 18:
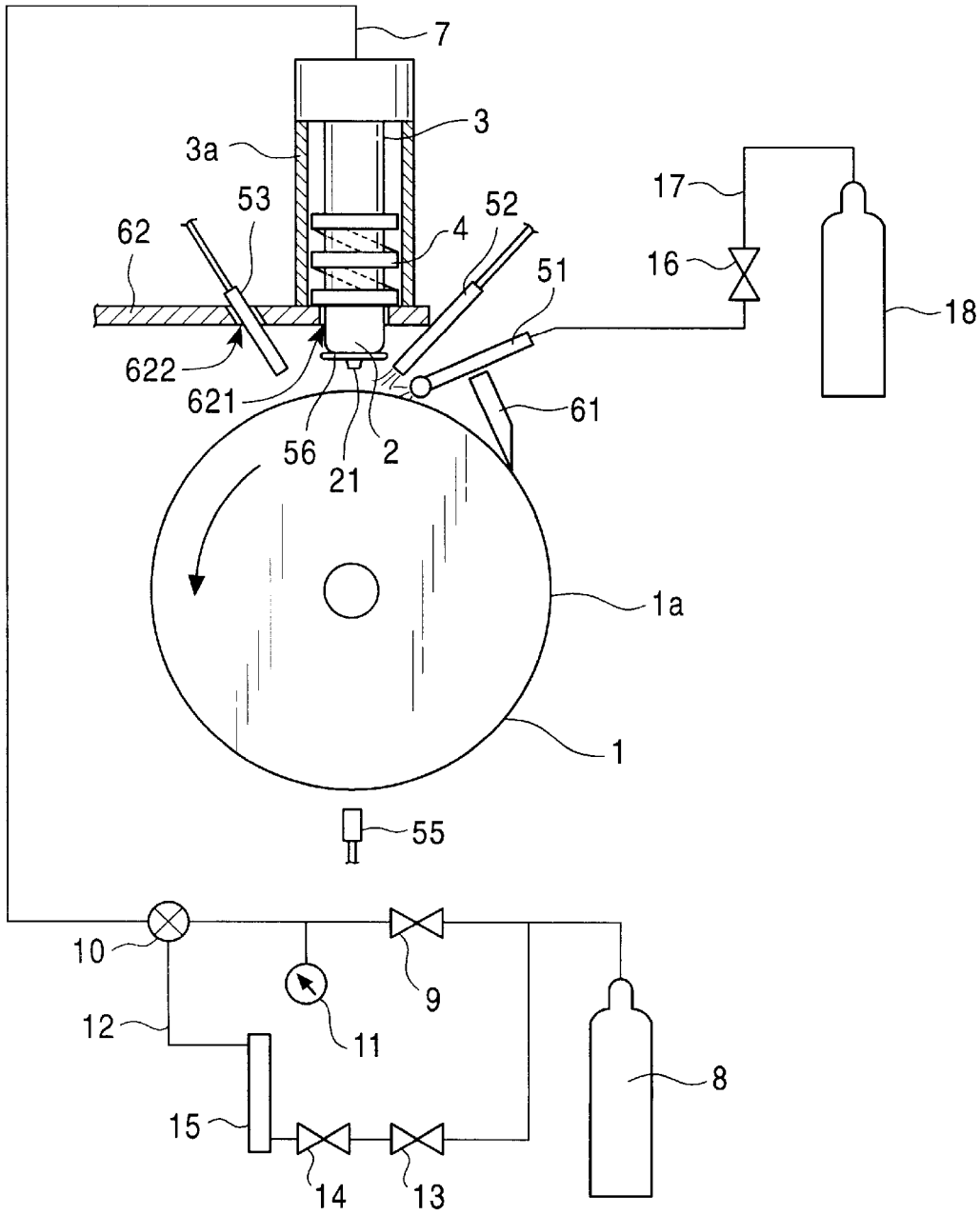
FIG. 18 is a drawing showing the configuration of a principal portion of the metallic ribbon producing apparatus shown in FIG. 17.

In the metallic ribbon producing apparatus of this embodiment shown in FIGS. 17, 18 and 4, a metal melt is blown to a cooling surface 1*a* of a rotating cooling roll 1 and cooled by the cooling surface 1*a* to obtain a metallic ribbon.

The metallic ribbon producing apparatus basically comprises the cooling roll 1; a melt nozzle 2 connected to the lower end of a crucible 3 which holds a melt; a heating coil 4 wound on the peripheries of the melt nozzle 2 and the crucible 3; air-cutoff means 60 which covers, along the rotation direction of the cooling roll 1, the cooling surface 1*a* from at least the melt blowout end of the melt nozzle 2 to position 1*b* where the metallic ribbon is separated from the cooling surface 1*a*, for preventing an inflow of air due to rotation of the cooing roll 1; a roll surface air-cutoff plate 61 serving as roll surface air-cutoff means in contact with the cooling surface 1*a*, which is provided behind the position where the melt nozzle 2 is opposite to the cooling roll 1, in the rotation direction of the cooling roll 1; a roll periphery air-cutoff plate 68 serving as roll periphery air-cutoff means; first to fourth and sixth gas flow nozzles 51, 52, 53, 54 and 56, which constitute first gas flow supply means for flowing at least two inert gases to the vicinity of the melt nozzle 2; a fifth gas flow nozzle 55 which constitutes second gas flow supply means for flowing an inert gas to the cooling surface 1*a* of the cooling roll 1; and an air retention portion 80.

In this metallic ribbon producing apparatus, the at least two inert gases supplied from the first gas flow supply means flow into the vicinity of the melt nozzle 2, and a heavier inert gas of the two inert gases forms a heavier inert gas layer below the lighter inert gas in the air-cutoff means 60, increasing the concentration of the inert gases in the vicinity of the puddle. In addition, the inert gas supplied from the second gas flow supply means flows on the cooling surface of the cooling roll 1 along the rotation direction of the cooling roll 1, passes through the roll surface air-cutoff means and flows into the vicinity of the melt nozzle, decreasing the oxygen concentration in the vicinity of the melt nozzle 2.

The cooling roll 1 is rotated in the direction of an arrow (counterclockwise) by a motor not shown. The cooling surface 1*a* of the cooling roll 1 is preferably made of carbon steel, a Fe-based alloy such as JIS (Japan Industrial Standard) S45C, brass (Cu—Zn alloy) or pure Cu. With the cooling roll 1 having the cooling surface 1*a* made of brass or pure Cu, the cooling roll 1 has high thermal conductivity, and thus exhibits a high cooling effect and is suitable for rapidly cooling a melt. In order to improve the cooling effect, a water-cooling structure is preferably provided in the cooling roll 1.

In FIG. 18, the melt in the crucible 3 is blown out of the melt nozzle 2 at the lower end of the crucible 3 toward the cooling surface 1*a* of the cooling roll 1. The upper portion of the crucible 3 is connected to a gas supply source 8 for an Ar gas or the like through a supply pipe 7 in which a pressure-regulating valve 9 and a solenoid valve 10 are provided, a pressure gage 11 being provided between the pressure-regulating valve 9 and the solenoid valve 10 in the supply pipe 7. An auxiliary pipe 12 is connected in parallel with the supply pipe 7, the auxiliary pipe 12 containing a pressure-regulating valve 13, a flow control valve 14, and a flow meter 15. Therefore, a gas such as an Ar gas is supplied into the crucible 3 from the gas supply source 8 to blow the melt out of the melt nozzle 2 to the cooling roll 1.

In the production of a metallic ribbon, the melt is blown out of the melt nozzle 2 arranged near the top of the cooing roll 1 which is rotated at high speed, or arranged slightly ahead of the top, to drawn out a ribbon in the rotation direction of the cooling roll 1 while solidifying the melt by rapid cooling by the surface of the cooling roll 1. Although the melt blowout portion of the melt nozzle has a rectangular shape, the blowout width (the width of the cooling roll 1 in the rotation direction thereof) is preferably about 0.1 to 0.8 mm. With a blowout width of less than 0.1 mm, the melt nozzle is readily clogged according to the composition of the melt, while with a blowout width of over 0.8 mm, sufficient cooling is difficult.

In the production of the metallic ribbon, the distance between the cooling roll 1 and the melt nozzle 2 is preferably selected in the range of 0.1 to 0.8 mm. With a distance of less than 0.1 mm, blowing of the melt is difficult with the possibility of damaging the melt nozzle 2, while with a distance of over 0.8 mm, production of a ribbon having good properties is difficult. The crucible 3 can be moved upward and downward by lifting means not shown so that the distance between the cooling roll 1 and the melt nozzle 2 can be adjusted. Since the diameter of the cooling roll 1 is increased by thermal expansion of the surface due to a temperature rise after the start of production of a metallic ribbon, it is preferable for producing a metallic ribbon with high thickness precision to gradually increase the distance between the cooling roll 1 and the melt nozzle 2 after the start of production.

As shown in FIG. 17, a ribbon guide plate 70 and a scraper 72 are provided in the lower portion of the cooling roll 1 on the front side in the rotation direction thereof. The metallic ribbon formed by cooing the melt on the cooling surface 1*a* of the cooing roll 1 is separated from the cooling roll 1 by the scraper 72, guided by the ribbon guide plate 70, and then discharged to the outside of the metallic ribbon producing apparatus through a passage opening 641. Therefore, the position 1*b* where the metallic ribbon is separated from the cooing surface 1*a* is near the scraper 72.

As shown in FIGS. 17, 18 and 4, the roll surface air-cutoff plate 61 is located behind the position where the melt nozzle 2 is opposite to the cooling roll 1, in the rotation direction of the cooing roll 1, has a plate structure having an acute angle end, and is arranged so that the acute angle end contacts the surface of the cooling roll 1. The roll surface air-cutoff plate 61 is provided for cutting off an inflow of air into the vicinity of the puddle which adheres to the surface of the cooling roll 1. During high-speed rotation of the cooling roll 1, the air which flows into the vicinity of the puddle which adheres to the surface of the cooling roll 1, is cut off by being scraped off by the roll surface air-cutoff plate 61.

The roll periphery air-cutoff plate 68 serving as roll periphery air-cutoff means is provided at a distance from the cooling surface 1*a* so as to extend along the rotation direction of the cooling roll 1 from the position 1*b* where the metallic ribbon is separated from the cooling surface 1*a* to the position where the roll surface air-cutoff plate 61 (roll surface air-cutoff means) is provided, to surround the cooling roll 1 with the cooling surface 1*a* covered.

Inert gases are preferably supplied from the first gas flow supply means comprising the first and second gas flow nozzles 51 and 52 arranged on the rear side on the basis of the melt nozzle 2, the first and fourth gas flow nozzles 53 and 54 arranged on the front side on the basis of the melt nozzle 2, and the sixth gas flow nozzle 56 arranged so as to surround the end of the melt nozzle 2.

In FIG. 18, the first gas flow nozzle 51 is one of the gas flow supply means arranged on the rear side on the basis of the melt nozzle 2, for flowing a gas to the vicinity (hereinafter, a puddle forming portion) of the end of the melt nozzle 2 from the rear side of the cooling roll 1 in the direction substantially normal to the cooling roll 1. As shown in FIG. 10, the first gas flow nozzle 51 has a relatively thin slit 510 having a width of 5 mm to flow the gas at a more or less high flow rate.

The second gas flow nozzle 52 is the other gas flow supply means arranged on the rear side, and is provided between the melt nozzle 2 and the first gas flow nozzle 51, for supplying a gas flow onto the gas flow supplied from the first gas flow nozzle 51 from air to cut off the gas flow supplied from the first gas flow nozzle 51 from air, preventing an inflow of air. As shown in FIG. 9, the second gas flow nozzle 52 has a slit 520 of 20 mm wider than the first gas flow nozzle 51 to flow a gas at a rate lower than the first gas flow.

Since, as shown in FIG. 18, the first and second gas flow nozzles 51 and 52 are arranged between the roll surface air-cutoff plate 61 and the melt nozzle 2, the flow of the inert gas is supplied immediately after the air is cut off by the roll surface air-cutoff plate 61, thereby improving the effect of decreasing the oxygen concentration in the vicinity of the puddle forming portion. In order to more effectively cut off an inflow of air into the vicinity of the puddle forming portion, a plurality of roll surface air-cutoff plates 61 may be provided.

The third gas flow nozzle 53 is one of the gas flow supply means arranged on the front side on the basis of the melt nozzle 2, for preventing an inflow of air from the front side in the rotation direction of the cooling roll 1. The third gas flow nozzle 53 has the same shape as the second gas flow nozzle 52, but a slit 540 thereof has a smaller width of 2.5 mm.

As shown in FIGS. 17, the fourth gas flow nozzle 54 is the other gas flow supply means arranged on the front side of the melt nozzle 2, and is provided above the end of the roll air-cutoff means 60, for preventing an inflow of air through the opening 641 located in front of the cooling roll 1. As shown in FIG. 9, the fourth gas flow nozzle 54 has the same shape as the second and third gas flow nozzles 52 and 53, but a slit 550 has a width of 3 mm.

Figure 19A:
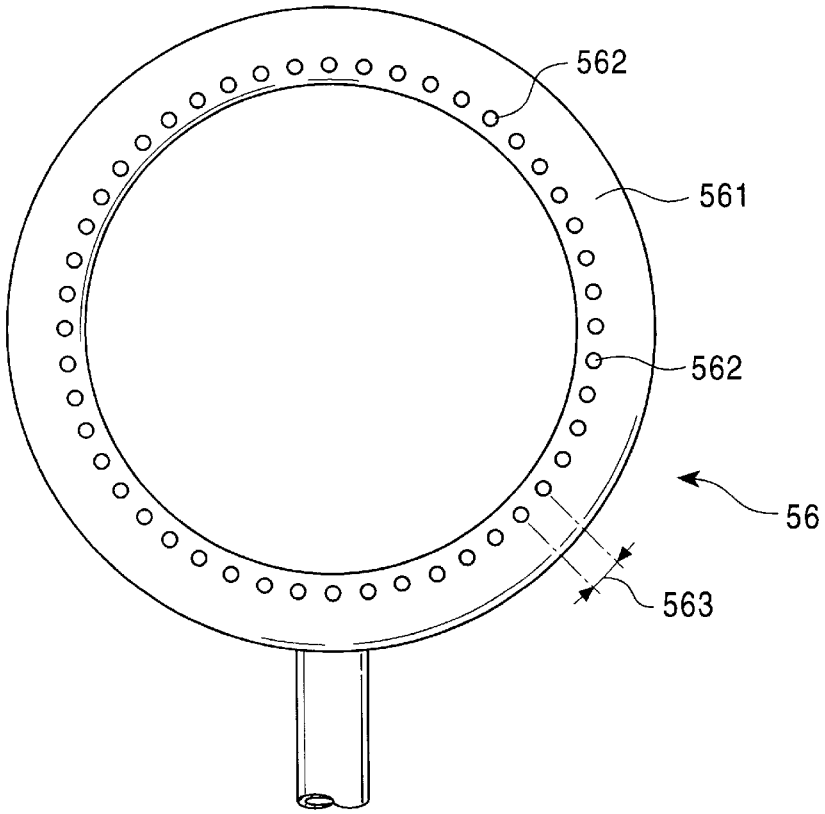
FIG. 19A is a plan view.
Figure 19B:
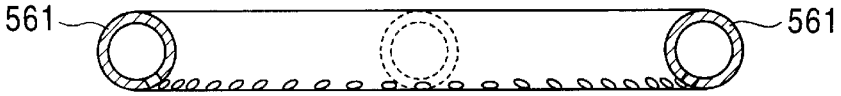
FIG. 19B is a sectional view.

The sixth gas flow nozzle 56 is gas flow supply means arranged to surround the end of the melt nozzle 2, for flowing a gas so as to surround the end of the melt nozzle 2. As shown in FIG. 19, the sixth gas flow nozzle comprises a ring pipe 561 having an outer diameter of 6 mm and formed in a ring having an outer diameter of 57 mm and an inner diameter of 45 mm. The sixth gas flow nozzle 56 has many holes 562 having an outer diameter of 1.5 mm and formed with a pitch 563 of 3.5 mm at a position slightly inward of the center between the outer periphery and the inner periphery thereof.

Of course, the first to fourth and sixth gas flow nozzles 51, 52, 53, 54 and 56 can be used singly or in a combination of a plurality of nozzles. The first and second gas flow nozzles have the highest effect of decreasing the oxygen concentration in the vicinity of the puddle forming portion.

Each of the first to fourth and sixth gas flow nozzles 51, 52, 53, 54 and 56 is connected to a gas supply source 18 through a connecting pipe 17 to which a pressure control valve 16 is connected, as shown by the first gas flow nozzle 51 in FIG. 18 as an example.

As shown in FIG. 17, the second gas flow supply means supplies an inert gas to the cooling surface 1*a* of the cooling roll 1, and preferably the inert gas is supplied between the position where the air-cutoff means 60 is provided, more preferably from the position 1*b* where the metallic ribbon is separated from the cooling surface 1*a*, to the position the roll surface air-cutoff plate 61 is provided.

In FIG. 17, the fifth gas flow nozzle 55 serving as the second gas flow supply means is located substantially directly below the cooling roll 1 with a distance from the cooling surface 1*a*, and provided in a hole 68*a* formed at any desired position of the roll periphery air-cutoff plate 68 to face the cooling surface 1*a* so that a gas can flow to the cooling surface 1*a*.

As shown in FIG. 10, the fifth gas flow nozzle 55 has a relatively thin slit 550 having a width of 2.5 mm, thereby providing gas flow at a relatively high speed.

The inert gas supplied from the fifth gas flow nozzle 55 flows on the cooing surface 1*a* along the rotation direction of the cooling roll 1 with rotation of the cooling roll 1, and reaches the vicinity of the roll surface air-cutoff plate 61. Although the roll surface air-cutoff plate 61 is arranged in contact with the cooling surface 1*a*, a small space is formed between the roll surface air-cutoff plate 61 and the cooling surface 1*a*. Therefore, the inert gas flowing along the cooling surface 1*a* passes through the space and flows into the vicinity of the melt nozzle 2, decreasing the oxygen concentration in the vicinity of the puddle forming portion.

By providing the roll periphery air-cutoff plate 68, the oxygen concentration in the vicinity of the puddle forming portion can be further decreased. This is because the cooling surface 1*a* is covered with the roll periphery air-cutoff plate 68 to prevent diffusion of the inert gas flowing from the fifth gas flow nozzle 55 to the roll surface air-cutoff plate 61 along the cooling surface 1*a* up to the time the inert gas reaches the roll surface air-cutoff plate 61, thereby causing a larger amount of inert gas to pass through the roll surface air-cutoff plate 61 and flow into the vicinity of the puddle forming portion.

In this way, the fifth gas flow nozzle 55 is arranged substantially directly below the cooling roll 1, the roll surface air-cutoff plate 61 is provided on the rear side on the basis the melt nozzle 2 in the rotation direction of the cooling roll 1, and the first to fourth and sixth gas glow nozzles 51, 52, 53, 54 and 56 are arranged around the melt nozzle 2. This permits a decrease in the oxygen concentration in the vicinity of the puddle forming portion.

The arrangement position of the fifth gas flow nozzle 55 is not limited to the position directly below the cooling roll 1, and the position of the fifth gas flow nozzle 55 may be between the vicinity of the position 1*b* where the metallic ribbon is separated from the cooling surface 1*a* to the position where the roll surface air-cutoff plate 61 is provided.

Figure 23A:
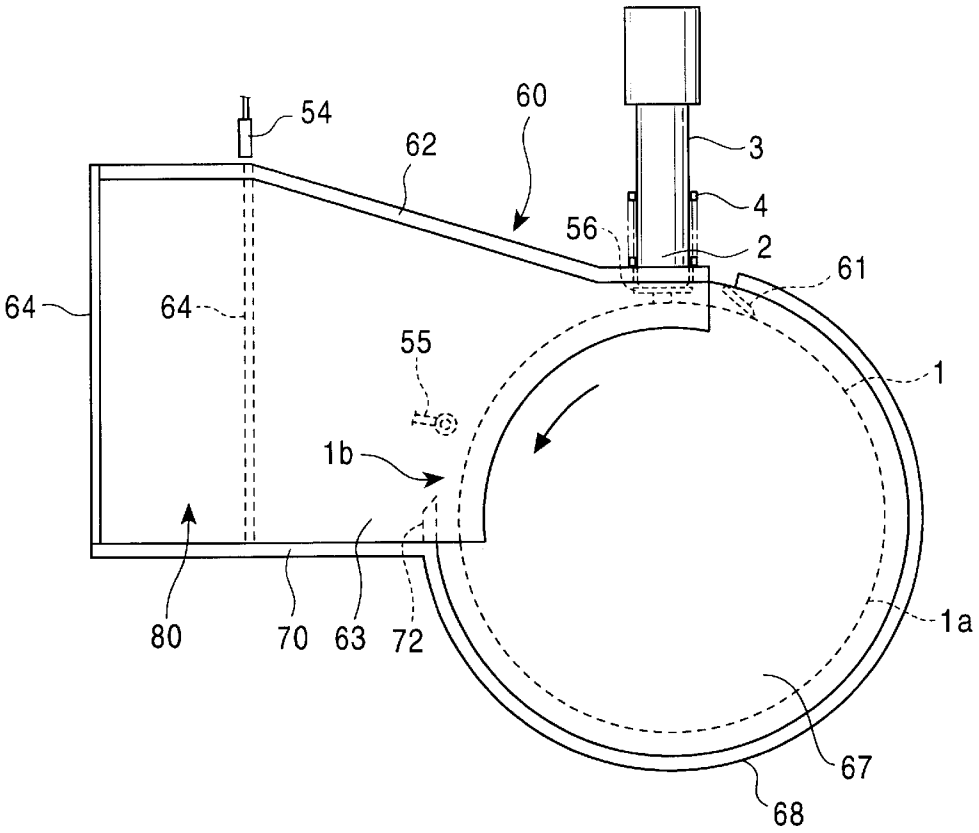
FIG. 23A is a side view of the apparatus.
Figure 23B:
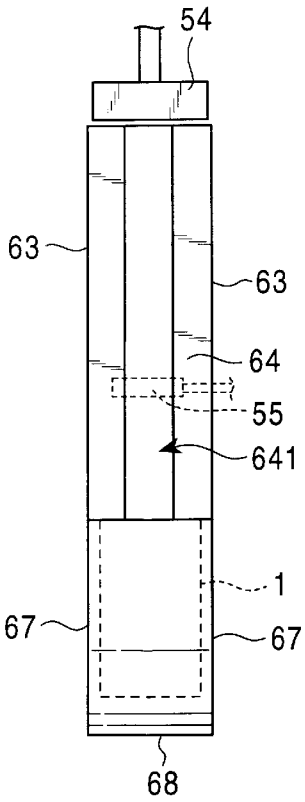
FIG. 23B is a front view thereof.

For example, as shown in FIG. 23, the fifth gas flow nozzle 55 may be provided near the position 1*b* where the metallic ribbon is separated from the cooling surface 1*a*. In this case, the fifth gas flow nozzle 55 is passed through the roll front air-cutoff plates 63 and arranged to face the cooling surface 1*a* from the sides of the cooling roll 1.

In this case, the inert gas supplied from the fifth gas flow nozzle 55 flows to the roll surface air-cutoff plate 61 along the rotation direction of the cooling roll 1, as well as flowing to the melt nozzle 2 in the direction opposite to the rotation direction of the cooling roll 1.

As shown in FIG. 19, the sixth gas flow nozzle 56 comprises a plurality of the holes 562 provided at a position slightly inward of the center between the outer periphery and the inner periphery thereof. However, it is possible to use a sixth gas flow nozzle 566 shown in FIG. 20 in which a plurality holes 564 are provided in a ring form at the center between the outer periphery and the inner periphery, a sixth gas flow nozzle 567 shown in FIG. 21 in which a ring slit 565 is provided in place of the holes 564 shown in FIG. 20, or a sixth gas flow nozzle 568 shown in FIG. 22 in which it is spirally formed to surround double the end of the melt nozzle 2.

In the production of the ribbon by using the metallic ribbon producing apparatus of the present invention, the supply of inert gases from the first to sixth gas flow nozzles 51 to 56 is preferably started before the cooling roll 1 is rotated. This is because when the flows of the gases are started before the cooling roll is rotated, the oxygen concentration is rapidly decreased, as compared with the supply of the inert gases is started after the cooling roll is rotated. Therefore, from the viewpoint of production efficiency, it is preferable to measure the oxygen concentration in the atmosphere near the melt nozzle, and then rotate the cooling roll 1 after the oxygen concentration reaches a predetermined value.

In the present invention, the inert gas is preferably supplied from the first gas flow supply means under conditions including a flow rate of 200 to 1800 l/min, more preferably a flow rate of 1760 l/min. This is because with a flow rate of less than 200 l/min, there is no effect of decreasing the oxygen amount in the atmosphere near the melt nozzle, while with a flow rate of over 1800 l/min, the effect of decreasing the oxygen concentration is decreased by an inflow of air from the periphery due to the gas flows, and thus no effect can be expected for the supply.

In this case, preferably, the flow rate of the first gas flow which is the gas flow from the first gas flow nozzle 51 is 330 to 530 l/min, and the flow rate of the second gas flow which is the gas flow from the second gas flow nozzle 52 is 180 to 380 l/min. In addition, preferably, the flow rate of the third gas flow which is the gas flow from the third gas flow nozzle 53 is 150 to 350 l/min, and the flow rate of the fourth gas flow which is the gas flow from the fourth gas flow nozzle 54 is 400 to 600 l/min. The flow rate of the sixth gas flow which is the gas flow from the sixth gas flow nozzle 56 is preferably 200 to 400 l/min.

The first gas flow is more preferably in the flow rate range of 380 to 480 l/min, most preferably at a flow rate of 430 l/min; the second gas flow is more preferably in the flow rate range of 230 to 330 l/min, most preferably at a flow rate of 280 l/min; the third gas flow is more preferably in the flow rate range of 150 to 350 l/min, most preferably at a flow rate of 250 l/min; the fourth gas flow is more preferably in the flow rate range of 400 to 600 l/min; the sixth gas flow is more preferably in the flow rate range of 200 to 400 l/min.

Particularly, when the flow rate of the fourth gas flow is 450 l/min, more preferably 500 l/min, the oxygen concentration in the vicinity of the puddle can be further decreased.

In the present invention, the inert gas is preferably supplied from the second gas flow supply means under conditions including a flow rate of 250 to 750 l/min, more preferably a flow rate of 500 l/min. This is because with a flow rate of less than 250 l/min, there is no effect of decreasing the oxygen amount in the atmosphere near the melt nozzle, while with a flow rate of over 750 l/min, no effect can be expected for the supply.

Therefore, the flow rate of the fifth gas flow nozzle 55 is preferably 250 to 750 l/min. The fifth gas flow is preferably in the flow rate range of 400 to 600 l/min, most preferably at 500 l/min.

As the inert gas used in the metallic ribbon producing apparatus of the present invention, at least two gases are selected from $N_2$, He, Ar, Kr, Xe and Rn. However, as seen from the examples below, $N_2$ and Ar are preferable.

It is also preferable to use a heavier inert gas for the first gas flow than those for the second to sixth gas flows. For the first gas flow, an inert gas heavier than air is more preferably used.

Description will be made of the air-cutoff means 60.

As shown in FIGS. 17, 18 and 23, the air-cutoff means 60 of the present invention comprises at least a roll face air-cutoff plate 64 provided in front of the cooling roll 1 on the front side on the basis of the position of the melt nozzle 2 in the rotation direction of the cooling roll 1, a pair of roll front air-cutoff plates 63 provided on the front side in the rotation direction of the cooling roll 1 so as to hold the cooling roll 1 therebetween and contact the roll face air-cutoff plate 64, a roll top air-cutoff plate 62 provided above the cooling roll 1 on the front side in the rotation direction thereof so as to contact the upper edges of the roll front air-cutoff plates 63, and a pair of roll side air-cutoff plates 67 provided with the cooling roll 1 held therebetween so as to contact the roll front air-cutoff plates 63 and the roll periphery air-cutoff means.

As shown in FIGS. 17 and 23, the roll front air-cutoff plates 63 are arranged for cutting off an inflow of air from both sides of the cooling roll 1 at the front thereof.

The roll face air-cutoff plate 64 is arranged for cutting off an inflow of air from the front side opposite to the cooling surface of the cooling roll 1. Although, in this embodiment, the roll face air-cutoff plate 64 is arranged at two positions including the front ends and the substantially centers of the roll front air-cutoff plates 63, the roll face air-cutoff plate 64 may be provided at one or at least three positions according to demand (refer to FIGS. 17 and 23). In this case, it can be expected that the oxygen concentration in the environment near the melt nozzle 2 can be further decreased. The roll face air-cutoff plate 64 comprises a ribbon pass hole 641 provided at the center thereof so that a ribbon is passed through the ribbon pass hole 641 in the production of the ribbon.

As shown in FIGS. 17 and 23, the roll top air-cutoff plate 62 extends from the front side to the rear side on the basis of the position of the melt nozzle 2 in the rotation direction of the cooling roll 1, and mounted and fixed to the upper edges of the roll front air-cutoff plates 63 to be located above the cooling roll 1. The roll top air-cutoff plate 62 is arranged for cutting off a flow of air to the cooling roll 1 from above.

The roll top air-cutoff plate 62 is provided in such a manner that it approaches the top of the cooling surface of the cooling roll 1 in the direction opposite to the rotation direction of the cooling roll 1.

As shown in FIG. 4, the roll top air-cutoff plate 62 comprises a nozzle mounting hole 621. The melt nozzle 2 is passed through the nozzle mounting hole 621 and arranged so that the melt blowout end 21 of the melt nozzle 2 faces the cooling surface 1*a* of the cooling roll 1.

The crucible 3 is contained in a cylinder 3*a*, as shown in FIG. 18. The cylinder 3*a* closes the nozzle mounting hole 621 to prevent an inflow of air.

Furthermore, the roll top air-cutoff plate 62 comprises a hole 622 through which the third gas flow nozzle 53 is passed, as shown in FIGS. 18 and 4. The third gas flow nozzle 53 is passed through the hole 622 and arranged so that the end of the nozzle faces the cooling surface of the cooling roll 1. The third gas flow nozzle 53 supplies a flow of the inert gas to the vicinity of the puddle forming portion from the front side in the rotation direction of the cooling roll 1.

Since the roll top air-cutoff plate 62 is provided near the cooling surface 1*a* of the cooling roll 1, the space near the puddle forming portion is narrowed. Large amounts of inert gases are supplied to the narrow space from the first to third and sixth gas flow nozzles 51, 52, 53 and 56, significantly increasing the concentration of the inert gas and conversely significantly decreasing the oxygen concentration in the vicinity of the puddle forming portion.

Only the melt blowout end 21 of the melt nozzle 2 is passed through the roll top air-cutoff plate 62. The body of the melt nozzle 2 is located above the roll top air-cutoff plate 62, i.e., outside the air-cutoff means 60. Therefore, the body of the melt nozzle 2, the crucible 3, and the heating coil 4 wound thereon are located outside the air-cutoff means 60.

Therefore, the melt nozzle 2 can easily be attached to and detached from the air-cutoff means 60.

Figure 24A:
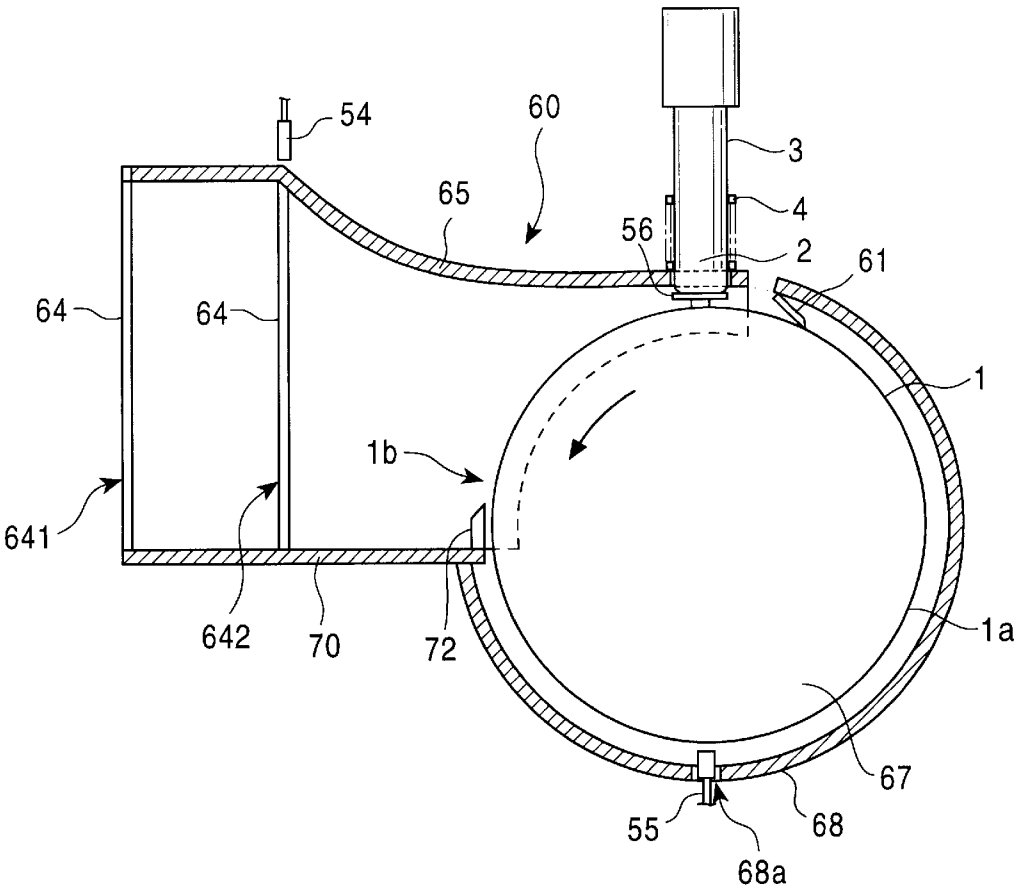
FIG. 24A is a sectional side view of the apparatus.
Figure 24B:
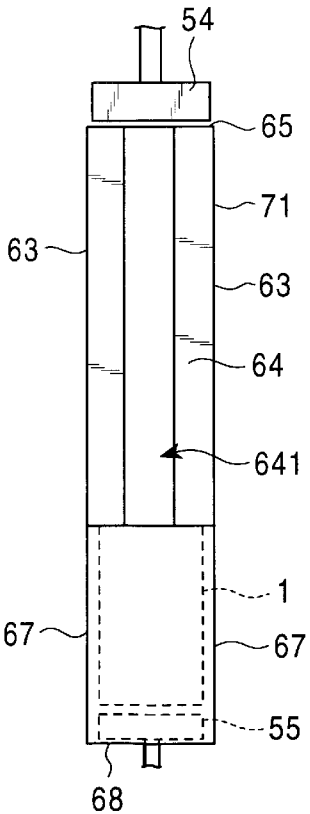
FIG. 24B is a front view thereof.

As shown in FIGS. 17 and 23, the roll top air-cutoff plate 62 flatly extends from the front side in the rotation direction of the cooling roll 1 to the cooling surface thereof. However, the roll top cutoff plate 62 is not limited to this, and a roll top air-cutoff plate 65 may be provided, which extends from the front side in the rotation direction of the cooling roll to the cooing surface 1*a* thereof so as to be curved to the inside of the air-cutoff means 60, as shown in FIG. 24. The roll top air-cutoff plate 65 can cut off an inflow of air through the opening 641, decreasing the oxygen concentration in the vicinity of the puddle forming portion.

Figure 25A:
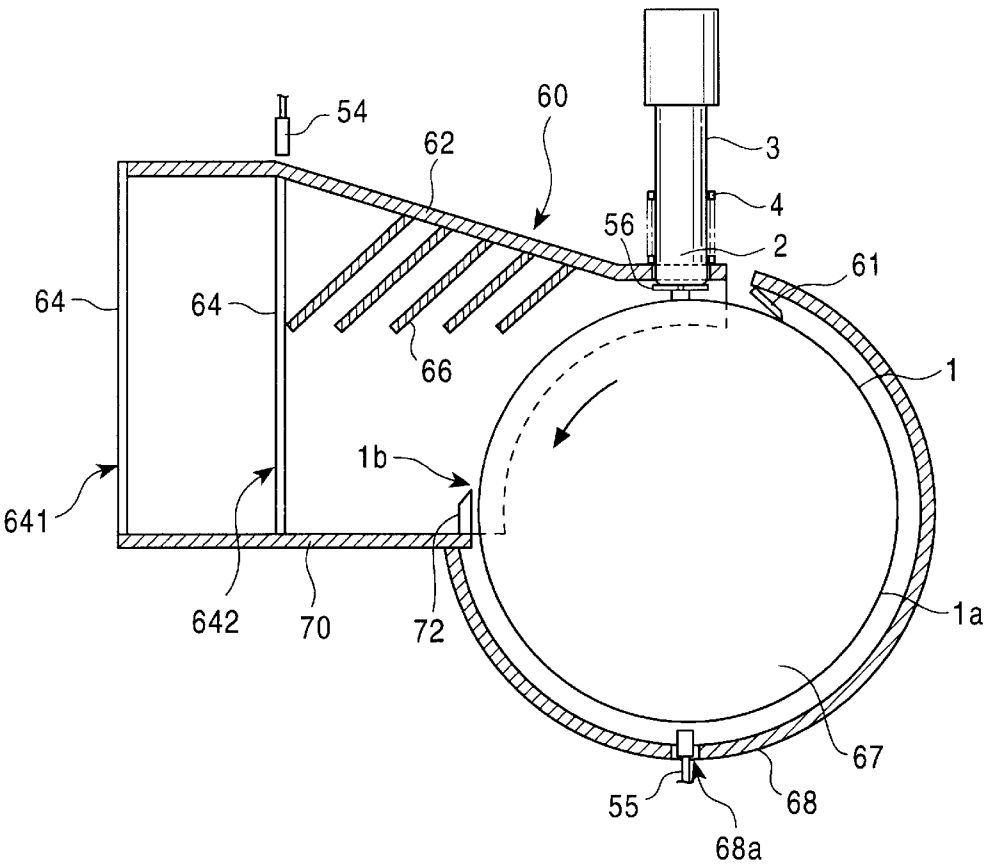
FIG. 25A is a sectional side view of the apparatus.
Figure 25B:
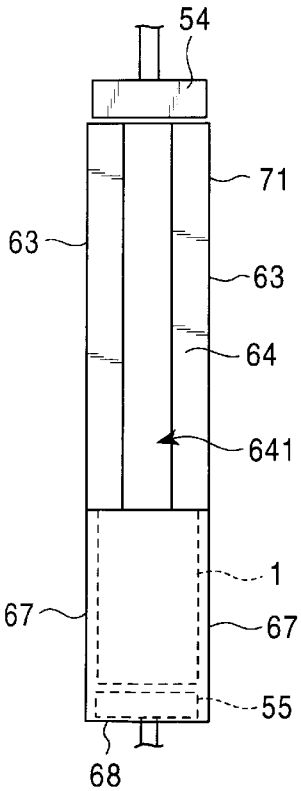
FIG. 25B is a front view thereof.

Further, as shown in FIG. 25, the roll top air-cutoff plate 62 may have at least one partition 66 which extends into the air-cutoff means 60. The partition 66 can cut off an inflow of air through the opening 641, further decreasing the oxygen concentration in the vicinity of the puddle forming portion. Unlike the partition 66 shown in FIG. 25, the partition 66 may be vertically projected downward, not projected in the rotation direction of the cooling roll 1, with the effect of decreasing the oxygen concentration.

As shown in FIGS. 17, 23 and 8, the roll side air-cutoff plates 67 have a disk form having a larger diameter than the cooling roll 1, and are arranged to contact both sides of the cooling roll 1. The roll side air-cutoff plates 67 are also provided so as to extend from the roll front air-cutoff plates 63 to the rear side of the cooling roll 1.

The roll side air-cutoff plates 67 are arranged for cutting off an inflow of air from the sides of the cooling roll 1.

The roll side air-cutoff plates 67 and the roll front air-cutoff plates 63 may be integrally provided.

The cooling roll 1 is arranged in the space comparted by the roll periphery air-cutoff plate 68 and the pair of the roll side air-cutoff plates 67. The roll periphery air-cutoff plate 68 can improve the effect of cutting off air by the roll surface air-cutoff plate 61.

As shown in FIG. 8, a roll rear air-cutoff plate 69 may be provided as the air-cutoff means. The roll rear air-cutoff plate 69 has a plate structure having a width larger than the width of the cooling roll 1, and is arranged for cutting off an inflow of air from the lower rear side of the cooling roll 1.

Of course, the above-described air-cutoff plates 61 to 65 and 67 to 69 can be used singly or in a combination of a plurality of plates. The arrangement of all air-cutoff plates 61 to 65 and 67 to 69 causes the cooling roll 1 to be substantially surrounded, thereby most improving the effect of decreasing the oxygen concentration in the vicinity of the puddle forming portion by the gas flows from the first to sixth gas flow nozzles 51 to 56.

In the metallic ribbon producing apparatus shown in FIGS. 17 and 23 to 25, the roll face air-cutoff plates 64 are provide at two positions to form a space as an air retention portion 80 therebetween.

Although, in FIGS. 17 and 23 to 25, the air retention portion 80 is provided outside the roll periphery air-cutoff means 60, it may be provided in the air-cutoff means 60. Where the air retention portion 80 has an opening area larger than the opening area of the air-cutoff means 60, the air retention effect can be improved. The air retention portion 80 can also improve the air retention effect by partitioning using a plurality of partitions.

The metallic ribbon producing apparatus shown in FIGS. 17 and 23 to 25 uses the crucible 3 having a small capacity, and in the continuous production of a large amount of metallic ribbon, the gas flows, the air-cutoff means and the air retention portion of the present invention can thus be applied to a metallic ribbon producing apparatus having the basic construction shown in FIG. 9. Namely, in the metallic ribbon producing apparatus shown in FIG. 9, a melted metal 19 is held in a melting furnace 20, and is supplied to a tundish 22 from the bottom outlet of the melting furnace 20 through a discharge pipe 21. The melt nozzle 2 is provided at the bottom of the tundish 22 so that the melted metal is blown out of the melt nozzle 2 to the surface of the cooling roll 1 rotated at a high speed, and is solidified to form a ribbon. This apparatus permits successive supply of the melt to the tundish 22 from the melting furnace 20 when the amount of the melted metal in the tundish 22 is decreased, and is thus suitable for continuous production.

A metallic ribbon producing method in accordance with a fourth embodiment of the present invention uses the metallic ribbon producing apparatus of each of the first to third embodiments and comprises rapidly cooling an alloy melt by blowing the melt to rotating cooling roll 1 from the melt nozzle 2 which faces the cooling surface 1*a* of the cooling roll 1 with a predetermined space held between the melt nozzle 2 and the cooling roll 1 having the cooling surface la in, to form a metallic ribbon, wherein at least a portion of the periphery of the cooling roll 1 and at least the melt blowout end of the melt nozzle 2 are covered with air-cutoff means for preventing an inflow of air due to rotation of the cooing roll 1 in blowing of the alloy melt toward the cooling roll 1 to form a metallic ribbon.

In the production method, the alloy melt is preferably blown out to form a metallic ribbon with the inert gas supplied to the periphery of at least one of the melt nozzle 2 and the cooling roll 1.

The inert gas is preferably supplied from the first and/or second gas flow supply means, and more preferably, at least two inert gases are supplied in the formation of a metallic ribbon.

As the two inert gases, $N_2$ and Ar are more preferably used. The production of a metallic ribbon by the above-described production method permits the easy production of a metallic ribbon, which is liable to be oxidized, without a large-scale additional equipment having poor workability.

Effective materials which can be applied to the present invention include the following:

$$Fe_aB_xM_y$$

wherein M is at least one element (necessarily including any of Zr, Hf and Nb) selected from Ti, Zr, Hf, V, Nb, Ta, Mo and W, b is 75 to 93 atomic %, x is 0.5 to 18 atomic %, and y is 4 to 9 atomic %.

$$(Fe_{1-a}Z_a)_bB_xM_y$$

wherein Z is at least one of Ni and Co, M is at least one element (necessarily including any of Zr, Hf and Nb) selected from Ti, Zr, Hf, V, Nb, Ta, Mo and W, a is not more than 0.2, b is 75 to 93 atomic %, x is 0.5 to 18 atomic %, and y is 4 to 9 atomic %.

$$Fe_bB_xM_yX_z$$

wherein M is at least one element (necessarily including any of Zr, Hf and Nb) selected from Ti, Zr, Hf, V, Nb, Ta, Mo and W, X is at least one element selected from Cu, Ag, Cr, Ru, Rh and Ir, b is 75 to 93 atomic %, x is 0.5 to 18 atomic %, y is 4 to 9 atomic %, and z is not more than 5 atomic %.

$$(Fe_{1-a}Z_a)_bB_xM_yX_z$$

wherein Z is at least one of Ni and Co, M is at least one element (necessarily including any of Zr, Hf and Nb) selected from Ti, Zr, Hf, V, Nb, Ta, Mo and W, X is at least one element selected from Cu, Ag, Cr, Ru, Rh and Ir, a is not more than 0.2, b is 75 to 93 atomic %, x is 0.5 to 18 atomic %, y is 4 to 9 atomic %, and z is not more than 5 atomic %.

$$Fe_bB_xM_yX'_t$$

wherein M is at least one element (necessarily including any of Zr, Hf and Nb) selected from Ti, Zr, Hf, V, Nb, Ta, Mo and W, X' is at least one element selected from Si, Al, Ge and Ga, b is 75 to 93 atomic %, x is 0.5 to 18 atomic %, y is 4 to 9 atomic %, and t is not more than 4 atomic %.

$$(Fe_{1-a}Z_a)_bB_xM_yX'_t$$

wherein Z is at least one of Ni and Co, M is at least one element (necessarily including any of Zr, Hf and Nb) selected from Ti, Zr, Hf, V, Nb, Ta, Mo and W, X' is at least one element selected from Si, Al, Ge and Ga, a is not more than 0.2, b is 75 to 93 atomic %, x is 0.5 to 18 atomic %, y is 4 to 9 atomic %, and t is not more than 4 atomic %.

$$Fe_bB_xM_yX_zX'_t$$

wherein M is at least one element (necessarily including any of Zr, Hf and Nb) selected from Ti, Zr, Hf, V, Nb, Ta, Mo and W, X is at least one element selected from Cu, Ag, Cr, Ru, Rh and Ir, X' is at least one element selected from Si, Al, Ge and Ga, b is 75 to 93 atomic %, x is 0.5 to 18 atomic %, y is 4 to 9 atomic %, z is not more than 5 atomic %, and t is not more than 4 atomic %.

$$(Fe_{1-a}Z_a)_bB_xM_yX_zX'_t$$

wherein Z is at least one of Ni and Co, M is at least one element (necessarily including any of Zr, Hf and Nb) selected from Ti, Zr, Hf, V, Nb, Ta, Mo and W, X is at least one element selected from Cu, Ag, Cr, Ru, Rh and Ir, X' is at least one element selected from Si, Al, Ge and Ga, a is not more than 0.2, b is 75 to 93 atomic %, x is 0.5 to 18 atomic %, y is 4 to 9 atomic %, z is not more than 5 atomic %, and t is not more than 4 atomic %.

The amorphous alloy ribbon having the above composition obtained by the present invention is subjected to heat treatment comprising heating at the crystallization temperature or more (for example, 500 to 600° C.) and then annealing, to obtain a soft magnetic alloy ribbon having a fine crystalline structure comprising crystals of 100 to 200 angstroms.

In the metallic ribbon producing apparatus of the first embodiment, the melt blowout end 21 of the melt nozzle 2 is covered with the air-cutoff means 60, and the body of the melt nozzle 2 and the crucible 3 are arranged outside the air-cutoff means 60, thereby permitting easy charge of a melt mother material to the crucible 3 while maintaining the atmosphere in the air-cutoff means 60.

Since the metallic ribbon producing apparatus comprises the air-cutoff means 60 provided on the front and rear sides in the rotation direction of the cooing roll 1, it is possible to cut off an inflow of air into the vicinity of the puddle from the front and rear sides in the rotation direction with the rotation of the cooling roll 1.

Further, since the air retention portion 80 is provided on the front side in the rotation direction of the cooling roll 1, it is possible to prevent an inflow of air into the air-cutoff means 60 by the air retention effect.

The metallic ribbon producing apparatus comprises the roll top air-cutoff plate 62 which is provided on the upper side of the cooling roll 1 on the front side in the rotation direction thereof so as to contact the upper edges of the roll front air-cutoff plates 63. Since the roll top air-cutoff plate 62 is provided so as to extend from the front side to the rear side in the rotation direction of the cooling roll 1 in such a manner that it approaches the cooling surface of the cooling roll in the direction opposite to the rotation direction of the cooling roll 1, the space near the puddle in the roll air-cutoff means 60 is narrowed and thus not affected by the composition distribution of the atmosphere near the puddle, producing a metallic ribbon having uniform characteristics.

The melt blowout end 21 of the melt nozzle 2 is passed through the nozzle mounting hole 621 and arranged to face the cooling roll 1, and the body of the melt nozzle 2, the crucible 3 and the heating coil 4 are located outside the air-cutoff means 60. Therefore, the melt nozzle 2 can easily be attached to and detached from the air-cutoff means 60, and the position of the melt nozzle 2 can freely be changed with respect to the air-cutoff means 60 so that a ribbon having a uniform thickness can be constantly produced by adjusting the distance between the cooling roll 1 and the melt nozzle 2.

In the above-described metallic ribbon producing apparatus, the roll top air-cutoff plate 62 extends to the rear side in the rotation direction of the cooling roll 1 so as to be curved to the inside of the air-cutoff means 60, thereby cutting off an inflow of air into the vicinity of the puddle.

In the metallic ribbon producing apparatus, the roll top air-cutoff plate 62 also comprises the partition 66 which projects into the air-cutoff means 60, thereby cutting off an inflow of air into the vicinity of the puddle.

The metallic ribbon producing apparatus comprises the ribbon guide plate 70 and the scraper 72 which are provided in the lower portion on the front side in the rotation direction of the cooling roll 1, and the roll face air-cutoff plate 64 comprises the pass hole 641 through which the metallic ribbon is passed. Therefore, the metallic ribbon can be separated from the cooling roll 1 by the scraper 72, guided by the ribbon guide plate 70, passed through the pass hole 641 and then smoothly discharged to the outside of the metallic ribbon producing apparatus.

The metallic ribbon producing apparatus comprises the gas flow supply means for supplying an inert gas to the periphery of the melt nozzle 2, so that a large amount of inert gas can be supplied to the space near the puddle, which is comparted by the cooling roll 1 and the roll top air-cutoff plate 62, thereby significantly increasing the inert gas concentration and decreasing the oxygen concentration in the vicinity of the puddle.

The metallic ribbon producing apparatus of the second embodiment comprises the fifth gas flow nozzle 55 arranged substantially directly below the cooling roll 1, the roll surface air-cutoff plate 61 provided on the rear side on the basis of the position of the melt nozzle 2 in the rotation direction of the cooling roll 1, and the first to fourth gas flow nozzles 51 to 54 arranged around the melt nozzle 2. Therefore, the inert gas supplied from the fifth gas flow nozzle flows on the cooling surface 1*a* along the rotation direction of the cooling roll 1, passes through the small space between the roll surface air-cutoff plate 61 and the cooling surface 1*a*, and flows into the vicinity of the melt nozzle 2, decreasing the oxygen concentration in the vicinity of the puddle.

The metallic ribbon producing apparatus also comprises the roll periphery air-cutoff plate 68 serving as roll periphery air-cutoff means which covers the cooling surface 1*a* so as to surround the cooling roll 1, the fifth gas flow nozzle 55 being arranged at any desired position of the roll periphery air-cutoff plate 68 so as to face the cooling surface 1*a*. Therefore, a large amount of inert gas flows from the fifth gas flow nozzle 55 to the roll surface air-cutoff plate 61 along the cooling surface 1*a*, passes through the roll surface air-cutoff plate 61 without diffusing up to the time the gas reaches the roll surface air-cutoff plate 61, and flows into the vicinity of the puddle, thereby further decreasing the oxygen concentration in the vicinity of the puddle.

Furthermore, the air retention portion 80 is provided on the front side in the rotation direction of the cooling roll, so that an inflow of air into the air-cutoff means 60 can be prevented by the air retention effect.

The metallic ribbon producing apparatus comprises the roll top air-cutoff plate 62 which is provided above the cooling roll 1 on the front side in the rotation direction thereof so as to contact the upper edges of the roll front air-cutoff plates 63 and extent from the front side to the rear side in the rotation direction of the cooling roll 1 in such a manner that the roll top air-cutoff plate 62 approaches the cooling surface 1*a* of the cooing roll 1 in the direction opposite to the rotation direction of the cooling roll 1. Therefore, the space near the puddle in the air-cutoff means 60 is narrowed, and is not affected by the composition distribution in the atmosphere near the puddle, thereby producing a metallic ribbon having uniform characteristics.

The metallic ribbon producing apparatus of the third embodiment comprises the air-cutoff means 60, the roll surface air-cutoff means 61, the roll periphery air-cutoff means 68, the first gas low supply means and the second gas flow supply means. Thus, at least two inert gases supplied from the first gas flow supply means flow into the vicinity of the melt nozzle 2, and heavier inert gas of the two inert gases forms a heavier inert gas layer below the lighter inert gas in the air-cutoff means 60 to increase the inert gas concentration in the vicinity of the puddle forming portion. In addition, the inert gas supplied from the second gas flow supply means flows on the cooling surface 1*a* of the cooling roll 1 along the rotation direction of the cooling roll 1, passes through the roll surface air-cutoff means 61 and flows into the vicinity of the puddle forming portion, decreasing the oxygen concentration in the vicinity of the puddle forming portion.

The first gas flow supply means comprises the first and second gas flow nozzles 51 and 52 which are arranged behind the position where the melt nozzle 2 is opposite to the cooing roll 1 on the rear side in the rotation direction of the cooling roll 1, the third and fourth gas flow nozzles 53 and 54 which are arranged on the front side in the rotation direction of the cooling roll 1, and the sixth gas flow nozzle 56, 566, 567 or 568 having the form of a hollow ring and provided to surround the end of the melt nozzle 2, for supplying an inert gas surrounding the end of the melt nozzle 2. It is thus possible to supply inert gases from positions on the front and rear sides in the rotation direction of the cooling roll 1, and the position where the end of the melt nozzle 2 is surrounded, further decreasing the oxygen concentration in the vicinity of the puddle forming portion.

The first gas flow nozzle 51 is directed to the end of the melt nozzle 2 in the direction normal to the cooling roll 1, for flowing an inert gas heavier than the inert gases supplied from the other gas flow nozzles, and the second gas flow nozzle 52 is arranged between the melt nozzle 2 and the first gas flow nozzle 51, for flowing a gas onto the gas flow supplied from the first gas flow nozzle 51. Therefore, the heavier inert gas supplied from the first gas flow nozzle 51 is loaded on the cooling roll 1 near the puddle forming portion by the second gas flow supplied from the second gas flow nozzle 52, increasing the inert gas concentration in the vicinity of the puddle forming portion. It is thus possible to further decrease the oxygen concentration in the vicinity of the puddle forming portion.

Furthermore, the sixth gas flow nozzle 56 has the shape of a hollow ring and is arranged to surround the end of the melt nozzle 2, for flowing a gas from the many holes provided at a position slightly inward of the center between the outer periphery and the inner periphery of the sixth gas flow nozzle 56 to surround the end of the melt nozzle 2. Therefore, the oxygen concentration in the vicinity of the puddle forming portion can be further decreased by the sixth gas flow supplied from the sixth gas flow nozzle 56.

EXAMPLES

Test Example 1

Changes in the oxygen concentration with the flow time of inert gas were examined by using the above-described metallic ribbon producing apparatus of the first embodiment. The results obtained are described below. In the examples below, the cooling roll 1 having a diameter of 300 mm was used, and the melt nozzle 2 was arranged at a position 4 mm ahead of the top of the cooing roll 1. Ar was used as an inert gas.

In order to measure the oxygen concentration, conditions for the gas flow nozzles and the air-cutoff plates were set as described below, and the air retention portion was set to the state shown in FIGS. 1 and 2 (Apparatus No. 1). Ar was used as a flow gas. The cooling roll 1 was rotated at 100 rpm after an elapse of 15 minutes after the start of the gas flow, and then further rotated at a rotational speed of 2000 rpm for 3 minutes after an elapse of 2 minutes. The oxygen concentration was measured, by using LC-700H produced by Toray Co., Ltd., at a position 0.3 mm apart from the surface of the cooling roll 1 on the front side of the melt nozzle 2. The oxygen concentration was measured with no melt blown. As comparison, the oxygen concentration was also measured when the air retention portion was not provided (Apparatus No. 2).

The flow rate of the gas flow was measured by using flow panel-mounted flow meter F-7 produced by Yutaka Co., Ltd.

Conditions for Gas Flow Nozzles

First gas flow nozzle (flow rate: 245 l/min, flow velocity: 19 m/sec)

Second gas flow nozzle (flow rate: 250 l/min, flow velocity: 4.8 m/sec)

Third gas flow nozzle (flow rate: 200 l/min, flow velocity: 38 m/sec)

Fourth gas flow nozzle (flow rate: 500 l/min, flow velocity: 50 m/sec)

Conditions for Air-cutoff Plates

Roll surface air-cutoff plate, roll front air-cutoff plate, roll top air-cutoff plate, and roll face air-cutoff plate The oxygen concentrations measured at the start of rotation of the cooling roll, after an elapse of 2 minutes after the start of rotation of the cooling roll and after an elapse of 5 minutes after the start of rotation of the cooling roll are described below. It was confirmed that by providing the air retention portion, it is possible to suppress an increase in the oxygen concentration in the vicinity of the puddle when the cooling roll was rotated at a high speed, with improvement in the effect.

| Apparatus No. | At the start of rotation | Elapse of 2 min. | Elapse of 5 min. |
|---|---|---|---|
| 1 | 0.217% | 0.212% | 0.66% |
| 2 | 0.005% | 0.008% | 3.41% |

Test Example 2

Changes in the oxygen concentration with the flow time of inert gas were examined by using the above-described metallic ribbon producing apparatus of the second embodiment. The results obtained are described below. In the example below, the cooling roll 1 having a diameter of 300 mm was used, and the melt nozzle 2 was arranged at a position 4 mm ahead of the top of the cooing roll 1. $N_2$ was used as an inert gas.

In order to measure the oxygen concentration, conditions for the gas flow nozzles and the air-cutoff plates were set as described below, and the air retention portion was set to the state shown in FIG. 13. $N_2$ was used as a flow gas. The cooling roll 1 was rotated at 100 rpm after an elapse of 5 minutes after the start of the gas flow, and then further rotated at a rotational speed of 2000 rpm for 3 minutes after an elapse of 2 minutes. One minute after the rotational speed of the cooling roll 1 was increased to 2000 rpm, the melt nozzle 2 was brought near the cooling surface 1*a* of the cooling roll 1. The oxygen concentration was measured, by using LC-700H produced by Toray Co., Ltd., at a position 0.3 mm apart from the surface of the cooling roll 1 on the front side of the melt nozzle 2. The oxygen concentration was measured with no melt blown. As comparison, the oxygen concentration was also measured by the same method as described above except that no gas was supplied from the fifth gas flow nozzle.

The flow rate of the gas flow was measured by using flow panel-mounted flow meter F-7 produced by Yutaka Co., Ltd.

Conditions for Gas Flow Nozzles

First gas flow nozzle (flow rate: 245 l/min, flow velocity: 19 m/sec)

Second gas flow nozzle (flow rate: 250 l/min, flow velocity: 4.8 m/sec)

Third gas flow nozzle (flow rate: 200 l/min, flow velocity: 38 m/sec)

Fourth gas flow nozzle (flow rate: 500 l/min, flow velocity: 50 m/sec)

Fifth gas flow nozzle (flow rate: 250 to 750 l/min, flow velocity: 5 to 60 m/sec)

Conditions for Air-cutoff Plates

Figure 26:
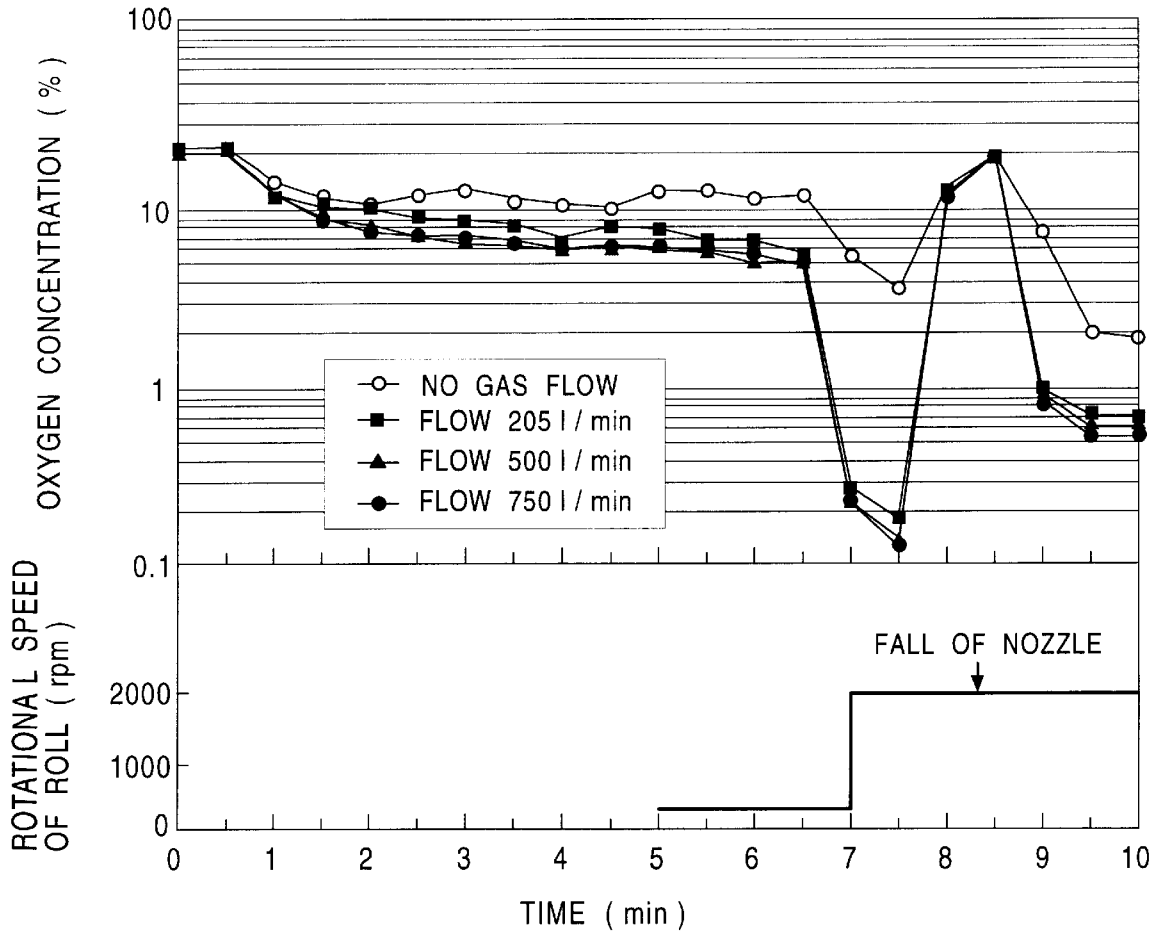
FIG. 26 is a graph showing the relation between the oxygen concentration in the vicinity of a puddle and the rotational speed of a cooling roll in Test Example 2.

Roll surface air-cutoff plate, roll front air-cutoff plate, roll top air-cutoff plate, roll face air-cutoff plate, roll side air-cutoff plate, and roll periphery air-cutoff plate FIG. 26 shows that with a low rotational speed (100 rpm) of the cooling roll, the oxygen concentration is about 5 to 10% in all cases, while after an elapse of 10 minutes after the supply of the inert gas, i.e., after an elapse of 3 minutes after the rotational speed of the cooling roll was increased (2000 rpm), the oxygen concentration was about 0.6% when the inert gas was supplied from the fifth gas flow nozzle, particularly, the oxygen concentration was 0.56% at a gas flow rate of 750 l/min.

On the other hand, when no inert gas was supplied from the fifth gas flow nozzle, the oxygen concentration was 1.83% after an elapse of 10 minutes.

It was thus confirmed that besides the first to fourth gas flow nozzles, supply of the inert gas from the fifth gas flow nozzle causes a decrease in the oxygen concentration in the vicinity of the puddle when the cooling roll was rotated at a high speed.

Test Example 3

Figure 20A:
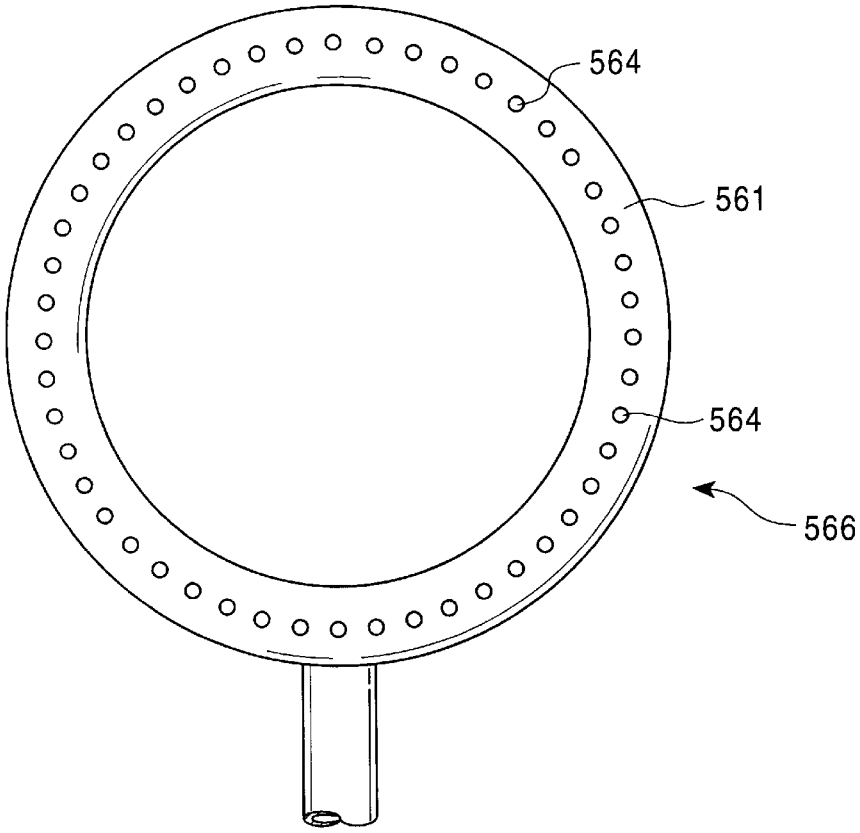
FIG. 20A is a plan view.
Figure 20B:
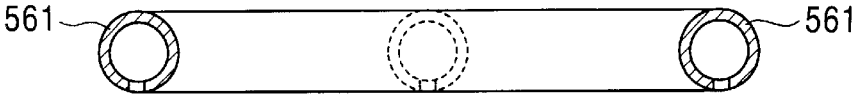
FIG. 20B is a sectional view.
Figure 21A:
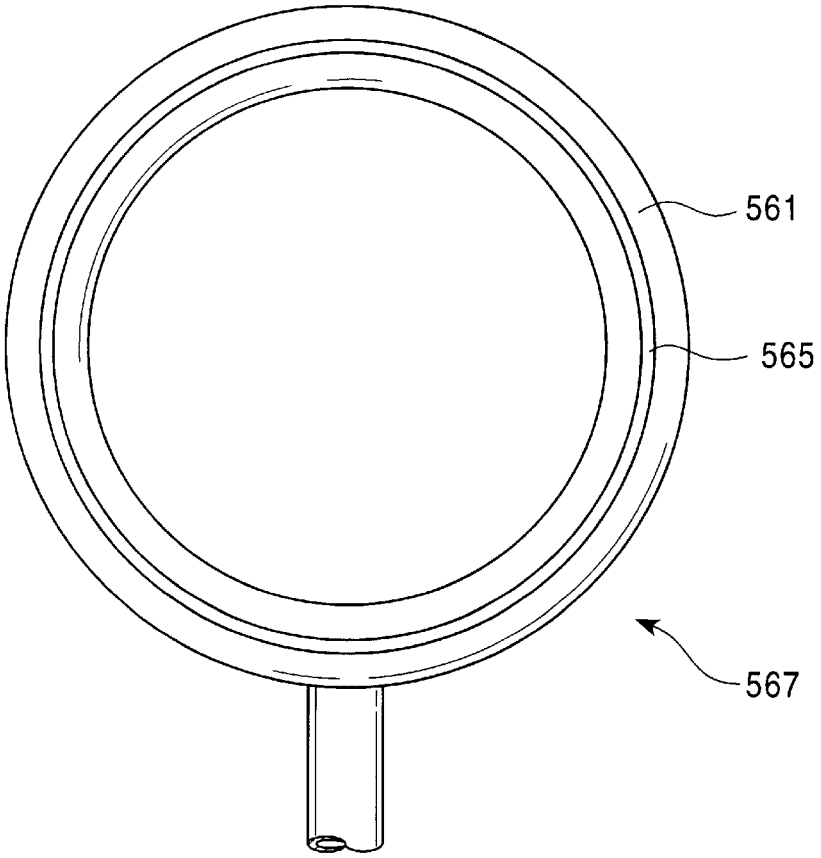
FIG. 21A is a plan view.
Figure 21B:
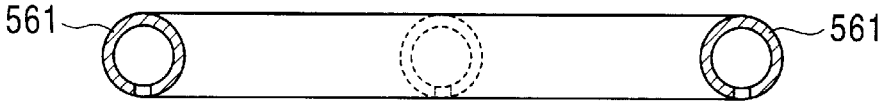
FIG. 21B is a sectional view.

Any one of the sixth gas flow nozzles 56, 566, and 567 shown in FIGS. 19 to 21 was provided in the metallic ribbon producing apparatus of the third embodiment, and the relation between the flow rate of the sixth gas flow nozzle and the oxygen concentration was examined.

In Test Example 3, the cooling roll 1 having a diameter of 300 mm was used, and the melt nozzle 2 was provided at a position 4 mm ahead of the top of the cooling roll 1.

Conditions for the first to sixth gas flows from the first to sixth gas flow nozzles 51 to 56 and the air-cutoff plates were set as described below, and the air retention portion was set in the state shown in FIG. 7 to measure the oxygen concentration.

Ar and $N_2$ were used as flow gases. The Ar gas was caused to flow by using a scale factor for controlling the flow rate.

The oxygen concentration was measured, by using LC-700H produced by Toray Co., Ltd., at a position 0.3 mm apart from the surface of the cooling roll 1 on the front side of the melt nozzle 2. The oxygen concentration was measured with the cooling roll 1 stopped and no melt blown from the melt nozzle 2.

The flow rate of the gas flow was measured by using flow panel-mounted flow meter F-7 produced by Yutaka Co., Ltd.

Conditions for Gas Flow Nozzles

First gas flow nozzle (flow rate: 432 l/min, inert gas: Ar)

Second gas flow nozzle (flow rate: 280 l/min, inert gas: $N_2$)

Third gas flow nozzle (flow rate: 250 l/min, inert gas: $N_2$)

Fourth gas flow nozzle (flow rate: 500 l/min, inert gas: $N_2$)

Fifth gas flow nozzle (flow rate: 500 l/min, inert gas: $N_2$)

Sixth gas flow nozzle (flow rate: 100 to 600 l/min, inert gas: $N_2$)

Conditions for Air-cutoff Plates

Figure 27:
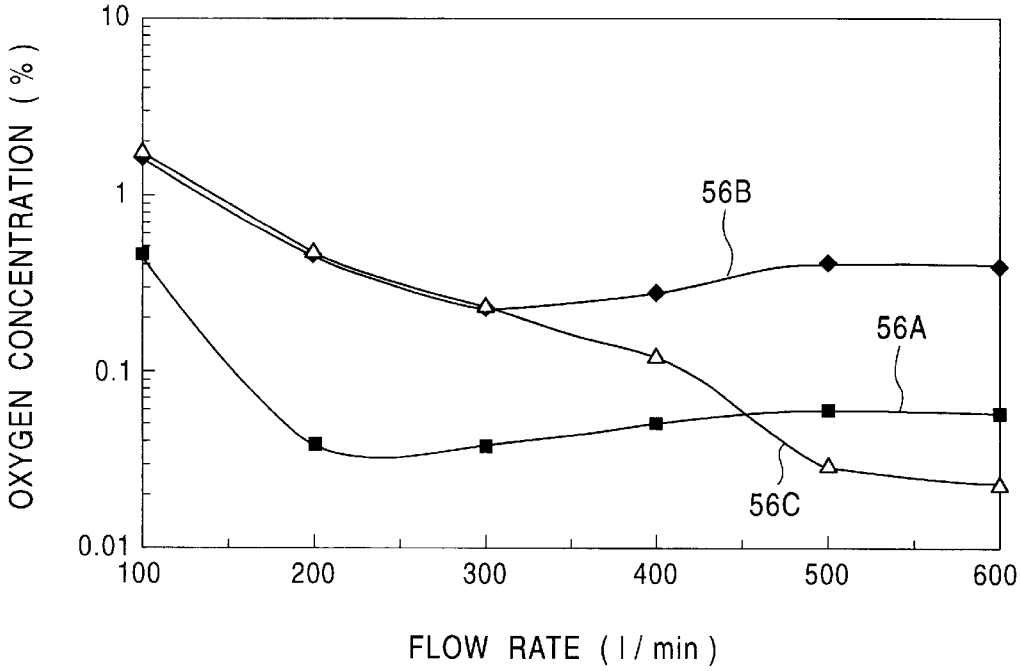
FIG. 27 is a graph showing the relation between the oxygen concentration in the vicinity of a puddle and the flow rate of each of the sixth gas flow nozzles shown in FIGS. 19 to 21.

Roll surface air-cutoff plate, roll front air-cutoff plate, roll top air-cutoff plate, roll face air-cutoff plate, roll side air-cutoff plate, and roll periphery air-cutoff plate The results are shown in FIG. 27.

In FIG. 27, reference numeral 56A denotes the sixth gas flow nozzle 56 shown in FIG. 19; reference numeral 56B, the sixth gas flow nozzle 566 shown in FIG. 20; reference numeral 56C, the sixth gas flow nozzle 567 shown in FIG. 21.

FIG. 27 indicates that in the use of the sixth gas flow nozzle 56 comprising the holes 562 provided at a position slightly inward of the center between the outer periphery and the inner periphery shown in FIG. 19, the oxygen concentration is more decreased than in the use of the sixth gas flow nozzle 566 comprising the holes 564 provided at the center between the outer periphery and the inner periphery shown in FIG. 20. It is also confirmed that at a flow rate of 500 l/min or more, the use of the six gas flow nozzle 567 shown in FIG. 21 more decreases the oxygen concentration than the sixth gas flow nozzle 56 shown in FIG. 56 does.

Test Example 4

The relation between the flow time of inert gas and the oxygen concentration was examined by using the same metallic ribbon producing apparatus as Test Example 3 except that the sixth gas flow nozzle was not provided, or the sixth gas flow nozzle 56 shown in FIG. 19 was provided with a flow rate of 100 l/min, 200 l/min, 300 l/min, 400 l/min, 500 l/min, or 600 l/min.

The conditions for the first to sixth gas flows and the air-cutoff plates were set to the same as Test Example 1, and the cooling roll was rotated at 100 rpm after an elapse of 5 minutes after the start of the gas flow, and then further rotated for 3 minutes at a rotational speed of 2000 rpm after an elapse of 2 minutes. One minute after the rotational speed of the cooling roll was increased to 2000 rpm, the melt nozzle 2 was brought near the cooling surface 1*a* of the cooling roll 1 to measure the oxygen concentration by the same method as Test Example 1.

Figure 28:
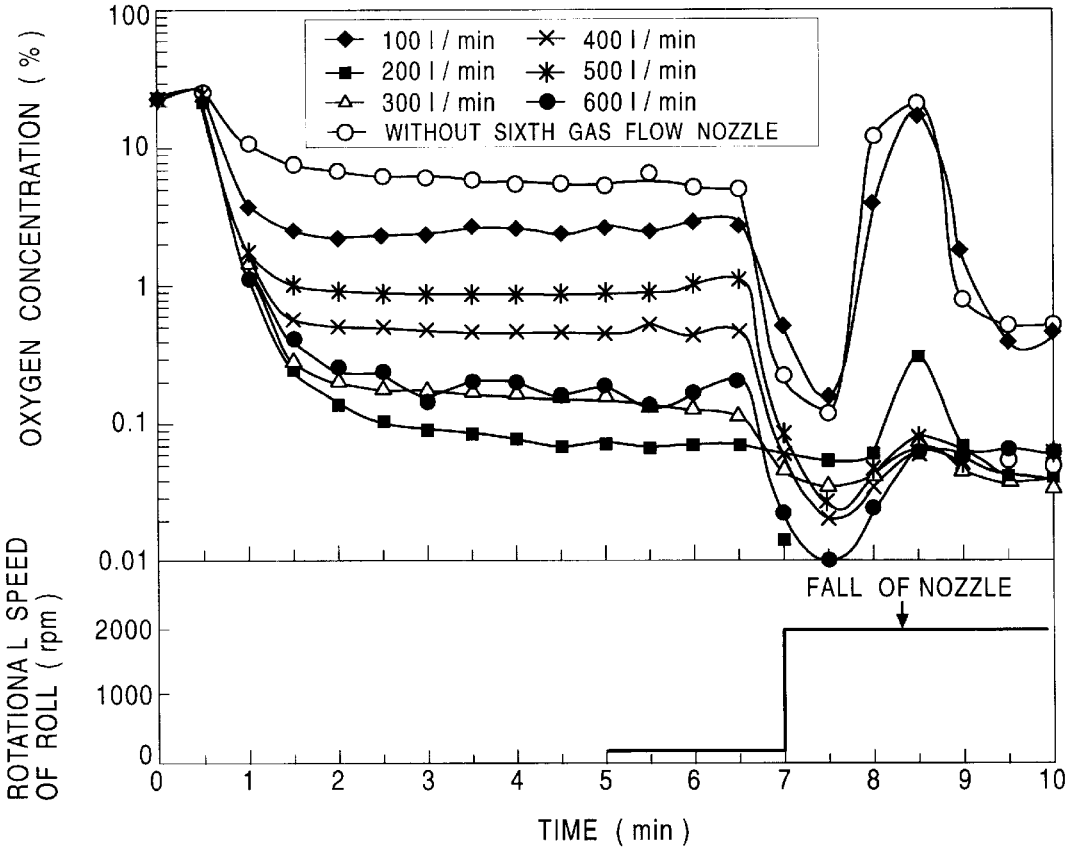
FIG. 28 is a graph showing the relation between the oxygen concentration in the vicinity of a puddle and the rotational speed of the cooling roll when the sixth gas flow nozzle shown in FIG. 19 was used and when it was not used.

The results are shown in FIG. 28.

FIG. 28 indicates that the oxygen concentration can be decreased by supplying the sixth gas flow from the sixth gas flow nozzle 56.

It is also confirmed that in the use of the sixth gas flow nozzle 56 shown in FIG. 19, at a low rotational speed (100 rpm) of the cooling roll 1, the minimum oxygen concentration is obtained at a flow rate of 200 l/min, while after an elapse of 10 minutes after the supply of the inert gas, the minimum oxygen concentration is obtained at a flow rate of 300 l/min.

In addition, after an elapse of 10 minutes after supply of the inert gas, i.e., after an elapse of 3 minutes with the cooling roll 1 rotated at high speed (2000 rpm), the oxygen concentration was 0.037% at a flow rate of 200 l/min; it was 0.035% at a flow rate of 300 l/min.

Test Example 5

Test Example 2 was repeated for examining the relation between the flow time of inert gas and the oxygen concentration by using the same metallic ribbon producing apparatus as Test Example 4 except that the sixth gas flow nozzle 566 shown in FIG. 20 was provided with a flow rate of 100 l/min 200 1/min, 300 l/min, 400 l/min, 500 l/min or 600 l/min.

Figure 29:
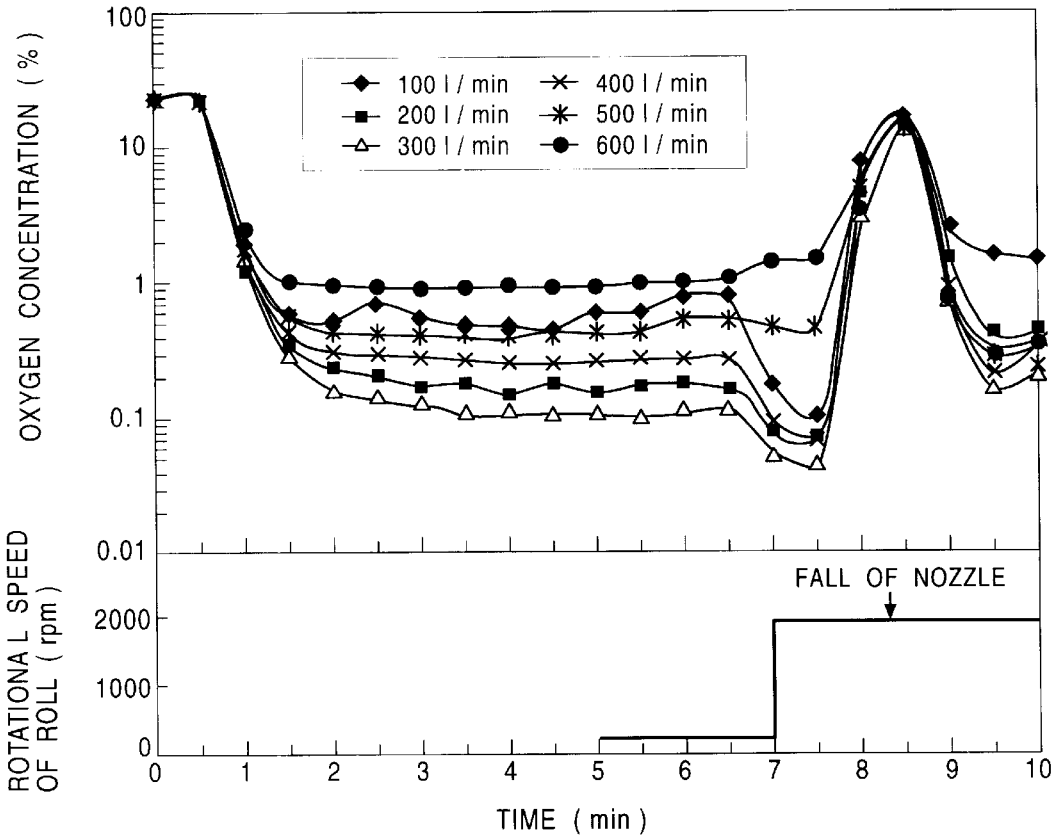
FIG. 29 is a graph showing the relation between the oxygen concentration in the vicinity of a puddle and the rotational speed of the cooling roll when the sixth gas flow nozzle shown in FIG. 20 was used.

The results are shown in FIG. 29.

FIG. 29 indicates that with the sixth gas flow nozzle 566 shown in FIG. 20, the minimum oxygen concentration is obtained at a flow rate of 300 l/min.

After an elapse of 10 minutes after supply of the inert gas, the oxygen concentration was 0.21% at a flow rate of 300 l/min.

Test Example 6

Test Example 2 was repeated for examining the relation between the flow time of inert gas and the oxygen concentration by using the same metallic ribbon producing apparatus as Test Example 4 except that the sixth gas flow nozzle 567 shown in FIG. 21 was provided with a flow rate of 100 l/min, 200 l/min, 300 l/min, 400 l/min, 500 l/min or 600 l/min.

Figure 30:
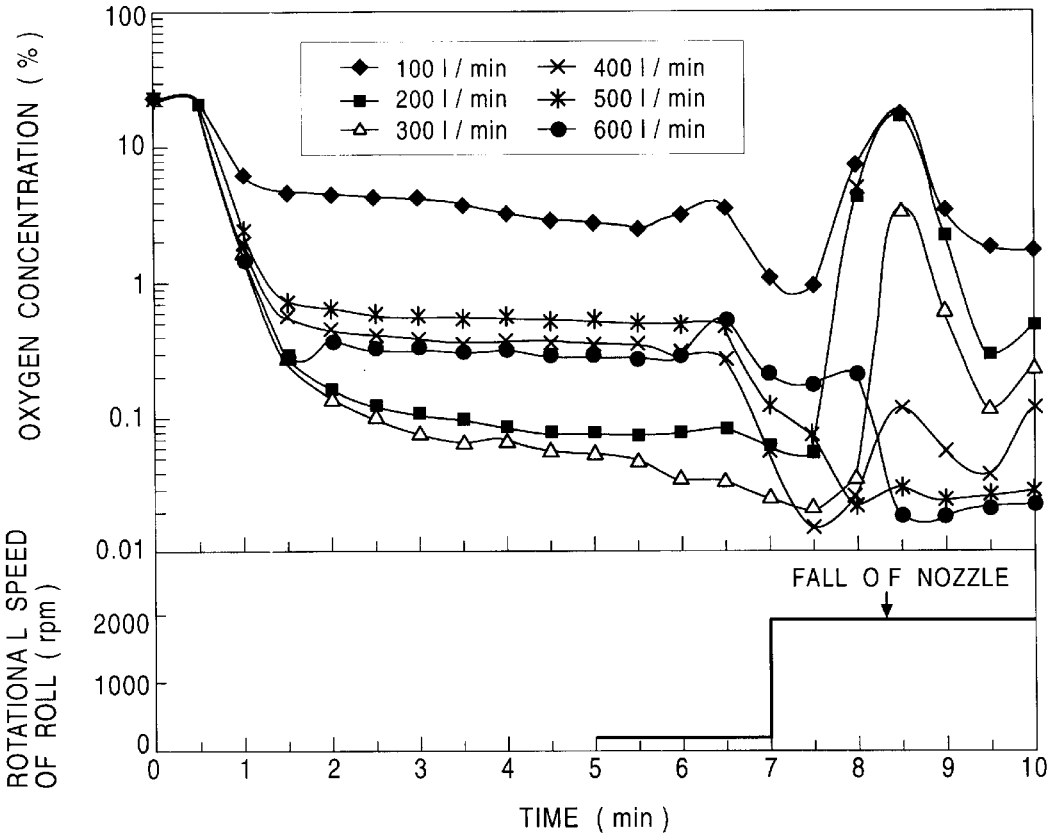
FIG. 30 is a graph showing the relation between the oxygen concentration in the vicinity of a puddle and the rotational speed of the cooling roll when the sixth gas flow nozzle shown in FIG. 21 was used.

The results are shown in FIG. 30.

FIG. 30 indicates that with the sixth gas flow nozzle 567 shown in FIG. 21, at a low rotational speed (100 rpm) of the cooling roll 1, the minimum oxygen concentration is obtained at a flow rate of 300 l/min, while after an elapse of 10 minutes after supply of the inert gas, the minimum oxygen concentration was obtained at a flow rate of 600 l/min.

After an elapse of 10 minutes after supply of the inert gas, the oxygen concentration was 0.219% at a flow rate of 300 l/min, and 0.0219% at a flow rate of 600 l/min.

The results of Test Examples 4 to 6 confirm that the sixth gas flow nozzle 56 shown in FIG. 19 can more decrease the oxygen concentration than the sixth gas flow nozzle 566 shown in FIG. 20, and can decrease the oxygen concentration to 0.1% or less with a smaller amount of gas supplied than the sixth gas flow nozzle 567 shown in FIG. 21, obtaining an excellent effect.

This indicates that in consideration of the effects of decreasing the amount of the gas supplied and the oxygen concentration, it is most preferable to use the sixth gas flow nozzle 56 shown in FIG. 19 at a flow rate of 300 l/min.

Test Example 7

Figure 22A:
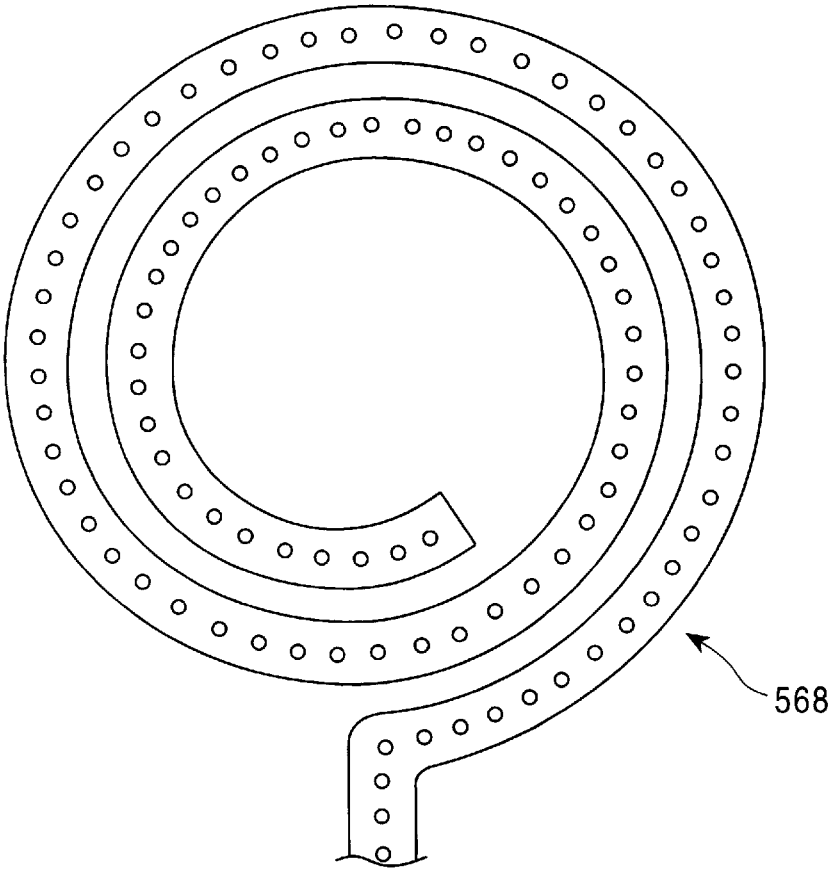
FIG. 22A is a plan view.
Figure 22B:
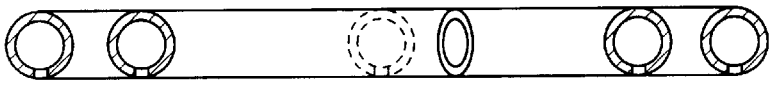
FIG. 22B is a sectional view.

Test Example 4 was repeated for examining the relation between the flow time of inert gas and the oxygen concentration by using the same metallic ribbon producing apparatus as Test Example 4 except that the sixth gas flow nozzle 568 shown in FIG. 22 was provided, and of the gas flow conditions of Test Example 3, the conditions for the sixth gas flow were as follows.

[Gas Flow Condition]

Sixth gas flow (flow rate: 600 l/min, inert gas: $N_2$)

Test Example 8

Test Example 2 was repeated for examining the relation between the flow time of inert gas and the oxygen concentration by using the same metallic ribbon producing apparatus as Test Example 4 except that the sixth gas flow nozzle 568 shown in FIG. 22 was provided, and of the gas flow conditions of Test Example 6, the conditions for the first and second gas flows were as follows.

[Gas Flow Condition]

First gas flow (flow rate: 300 l/min, inert gas: $N_2$)

Second gas flow (flow rate: 280 l/min, inert gas: $N_2$)

Test Example 9

Test Example 4 was repeated for examining the relation between the flow time of inert gas and the oxygen concentration by using the same metallic ribbon producing apparatus as Test Example 4 except that the sixth gas flow nozzle 568 shown in FIG. 22 was provided, and of the gas flow conditions of Test Example 7, the conditions for the first and second gas flows from the first and second gas flow nozzles 51 and 52 were as follows.

[Gas Flow Condition]

First gas flow (flow rate: 432 l/min, inert gas: Ar)

Second gas flow (flow rate: 280 l/min, inert gas: Ar)

Of Test Examples 7 to 9, Test Example 7 is an example of the present invention, and Test Examples 8 and 9 are comparative examples.

Figure 31:
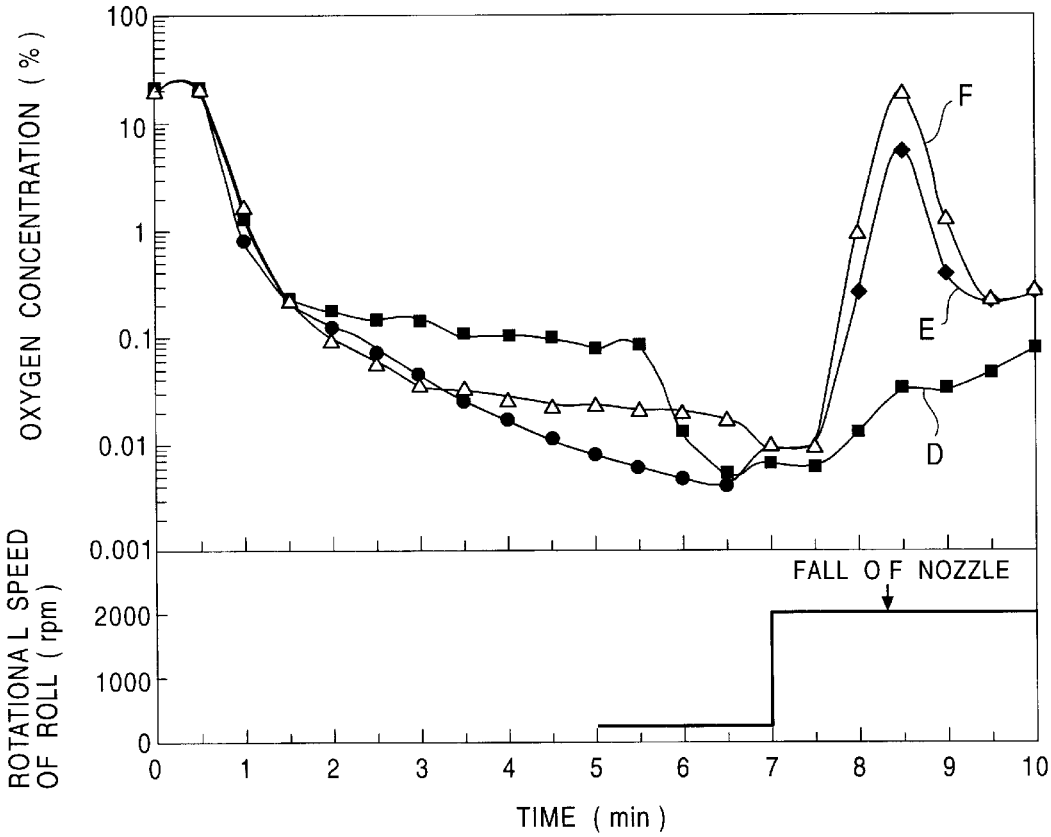
FIG. 31 is a graph showing the relation between the oxygen concentration in the vicinity of a puddle and the rotational speed of the cooling roll when one inert gas was used and when two inert gases were used.

The results of Test Examples 7 to 9 are shown in FIG. 31.

In FIG. 31, character D denotes the results of Test Example 7; character E, the results of Test example 8; character F, the results of Test Example 9.

FIG. 31 confirms that in Test Example 7 using two inert gases of Ar and $N_2$, a low oxygen concentration can be obtained, as compared with Test Examples 8 and 9 using only one inert gas.

Test Example 10

Test Example 4 was repeated for examining the relation between the flow time of inert gas and the oxygen concentration by using the same metallic ribbon producing apparatus as Test Example 4 except that the sixth gas flow nozzle 56 shown in FIG. 19 was provided, and only one gas flow was selected from the first to sixth gas flows under conditions in which of the gas flow conditions of Test Example 1, the conditions for the sixth gas flow were as follows.

[Gas Flow Condition]

Sixth gas flow (flow rate: 300 l/min, inert gas: Ar)

Figure 32:
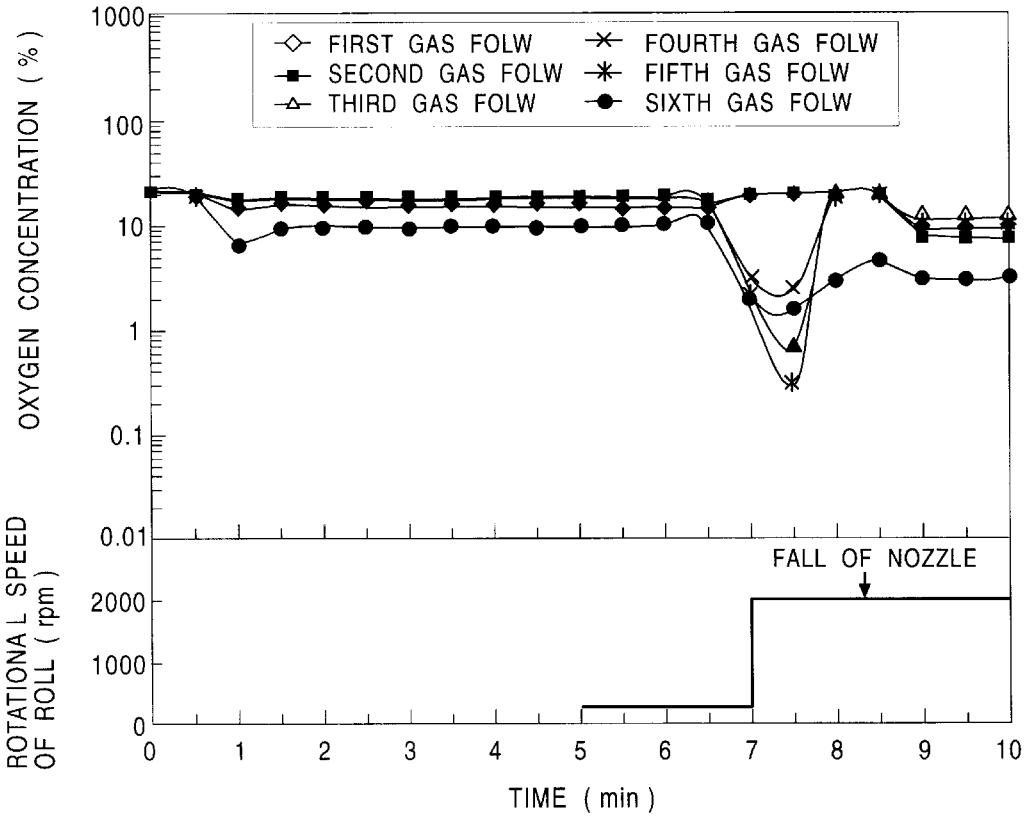
FIG. 32 is a graph showing the relation between the oxygen concentration in the vicinity of a puddle and the rotational speed of the cooling roll when only one was selected from the first to sixth gas flow nozzles.
Figure 33:
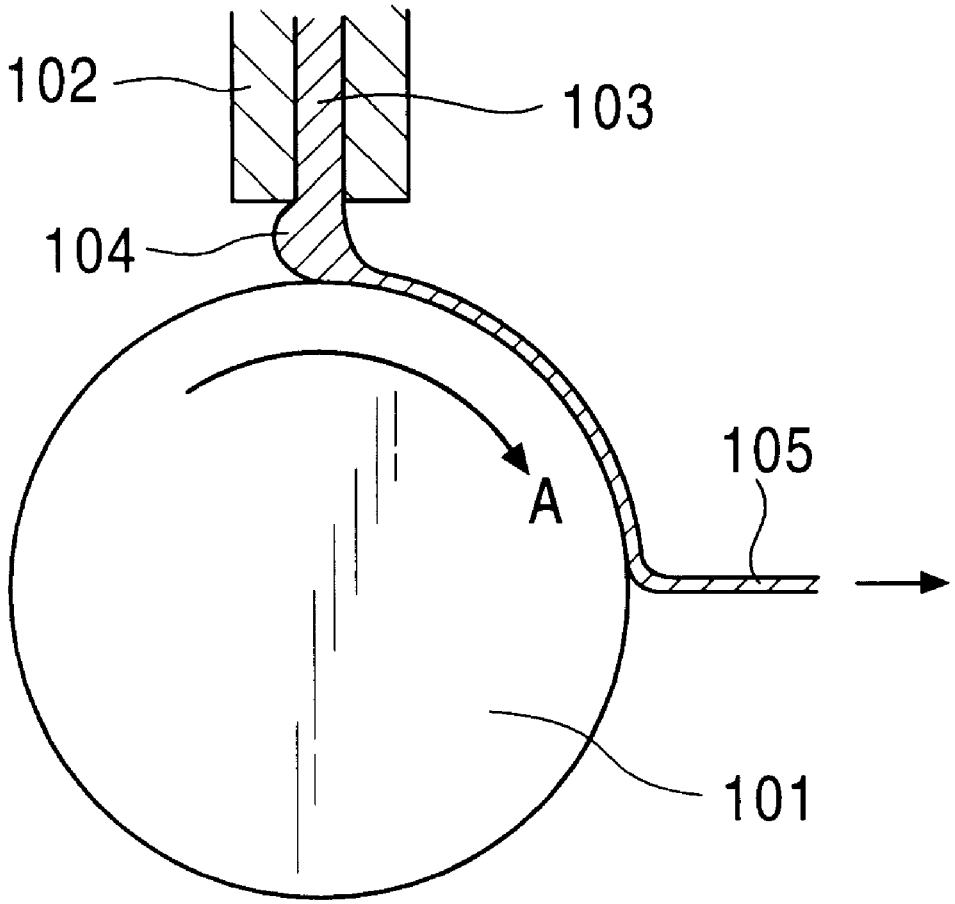
FIG. 33 PRIOR ART
FIG. 33 is a drawing showing an apparatus for producing a metallic ribbon by a single roll method.

The results are shown in FIG. 32.

FIG. 32 confirms that of the first to sixth gas flows, the sixth gas flow is particularly important for decreasing the oxygen concentration.

What is claimed is:

1. An apparatus for producing a metallic ribbon comprising:

a cooling roll having a cooling surface for cooling a melt;

a melt nozzle provided to face the cooling surface with a predetermined distance from the cooling roll;

air-cutoff measure covering at least a portion of the periphery of the cooling roll and at least a melt blowout end of the melt nozzle, for preventing an inflow of air due to rotation of the cooling roll;

the air-cutoff measure comprising:

a roll face air-cutoff plate provided in front of the cooling roll on a front side in a rotation direction of the cooling roll; a pair of roll front air-cutoff plates provided on both sides of the cooling roll with the cooling roll held therebetween on the front side in the rotation direction of the cooling roll and contacting the roll face air-cutoff plate; a roll top air-cutoff plate arranged above the cooling roll to extend from the front side to a rear side in the rotation direction of the cooling roll and contacting an upper edge of the roll front air-cutoff plates; a roll surface air-cutoff plate provided on the rear side in the rotation direction of the cooling roll and contacting the cooling surface of the cooling roll;

wherein the roll top air-cutoff plate is disposed such that it approaches the cooling surface of the cooling roll in the direction opposite to the rotation direction of the cooling roll; and wherein the melt blowout end of the melt nozzle is arranged so as to pass through a nozzle mounting hold provided in the roll top air-cutoff plate and face the cooling surface of the cooling roll.

2. An apparatus for producing a metallic ribbon according to claim 1, wherein a plurality of the air-cutoff measures are provided on at least a front side and a rear side in a rotation direction of the cooling roll, and the air-cutoff measures are positioned to form an air retention portion.

3. An apparatus for producing a metallic ribbon according to claim 1, wherein the roll top air-cutoff plate comprises at least one partition which projects into the air-cutoff measure.

4. An apparatus for producing a metallic ribbon according to claim 1, wherein the roll face air-cutoff plate comprises a pass hole for passing a metallic ribbon formed by cooling with the cooling roll.

5. An apparatus for producing a metallic ribbon according to claim 1, wherein the roll top air-cutoff plate flatly extends from the front side in the rotation direction of the cooling roll to the cooling surface of the cooling roll.

6. An apparatus for producing a metallic ribbon according to claim 5, wherein the roll top air-cutoff plate comprises at least one partition which projects into the air-cutoff means.

7. An apparatus for producing a metallic ribbon according to claim 5, wherein the roll face air-cutoff plate comprises a pass hole for passing a metallic ribbon formed by cooling with the cooling roll.

8. An apparatus for producing a metallic ribbon according to claim 1, wherein a concave roll top air-cutoff plate flatly extends from the front side in the rotation direction of the cooling roll to the cooling surface of the cooling roll.

9. An apparatus for producing a metallic ribbon according to claim 8, wherein the roll top air-cutoff plate comprises at least one partition which projects into the air-cutoff means.

10. An apparatus for producing a metallic ribbon according to claim 8, wherein the roll face air-cutoff plate comprises a pass hole for passing a metallic ribbon formed by cooling with the cooling roll.

11. An apparatus for producing a metallic ribbon according to claim 1, wherein the roll top air-cutoff plate comprises at least one partition which projects into the air-cutoff measure, and the roll face air-cutoff plate comprises a pass hole for passing a metallic ribbon formed by cooling with the cooling roll.

* * * * *